United States Patent [19]

Collet

[11] Patent Number: 4,606,366

[45] Date of Patent: Aug. 19, 1986

[54] PROTECTIVE SHELTER, SUCH AS AN UMBRELLA WITH OFFSET SUPPORT

[76] Inventor: Jean Collet, Chemin de la Tuilenie, 74410 Saint-Jorioz, France

[21] Appl. No.: 456,030

[22] PCT Filed: Apr. 23, 1982

[86] PCT No.: PCT/FR82/00073

§ 371 Date: Dec. 23, 1982

§ 102(e) Date: Dec. 23, 1982

[87] PCT Pub. No.: WO82/03538

PCT Pub. Date: Oct. 28, 1982

[30] Foreign Application Priority Data

Apr. 23, 1981 [FR] France ..... 81 08505
Jan. 27, 1982 [FR] France ..... 82 01747

[51] Int. Cl.[4] ..... A45B 11/00; A45B 25/08

[52] U.S. Cl. ..... 135/20 A; 135/20 M; 135/42; 135/DIG. 9

[58] Field of Search ..... 135/20 A; 135/20 M, 135/21, 27, 25 A, 25

[56] References Cited

U.S. PATENT DOCUMENTS

| | | | |
|---|---|---|---|
| 176,145 | 4/1876 | McRedmond et al. | 135/21 |
| 504,900 | 9/1893 | Barnes | 135/21 |
| 2,528,578 | 11/1950 | Clapper | 135/20 A |
| 2,605,778 | 8/1952 | Clapper | 135/20 A |
| 2,652,845 | 9/1953 | O'Neill et al. | 135/20 A |
| 2,764,993 | 10/1956 | Wallace et al. | 135/20 A |
| 3,120,238 | 2/1964 | Glatz | 135/21 |
| 3,182,936 | 5/1965 | Murdock | 248/530 |
| 3,765,434 | 10/1973 | Riggs | 135/20 A |
| 4,284,095 | 8/1981 | Norton | 135/21 |

FOREIGN PATENT DOCUMENTS

| | | | |
|---|---|---|---|
| 1159598 | 12/1963 | Fed. Rep. of Germany | 135/21 |
| 3229776 | 4/1983 | Fed. Rep. of Germany | 135/21 |
| 784815 | 7/1935 | France | 135/21 |
| 1062753 | 4/1967 | United Kingdom | 135/20 A |

*Primary Examiner*—Robert A. Hafer
*Assistant Examiner*—D. Neal Muir
*Attorney, Agent, or Firm*—Roland Plottel

[57] ABSTRACT

The umbrella comprises a cover (17) supported by a framework comprising a central truncated mast (15) mounted at the end of a radial arm (7) hinged to a fixed support structure. The ribs are hinged to a fixed hub (14) mounted on the central mast (15) and the counter ribs are hinged to a hub (11) sliding on the mast. A rib (8) is interlocked with the radial arm (7).

20 Claims, 142 Drawing Figures

1
2
3
4

Fig.7
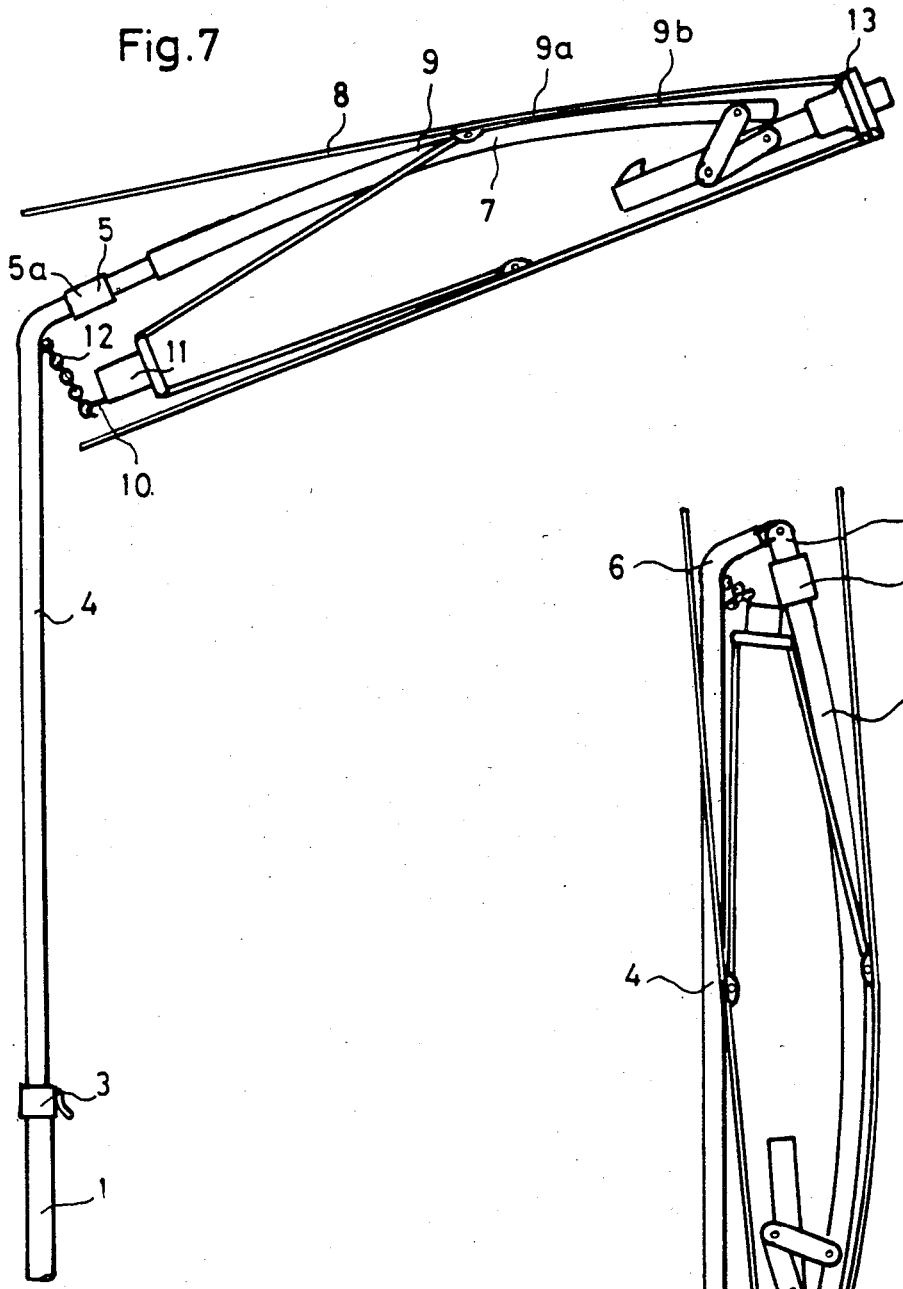
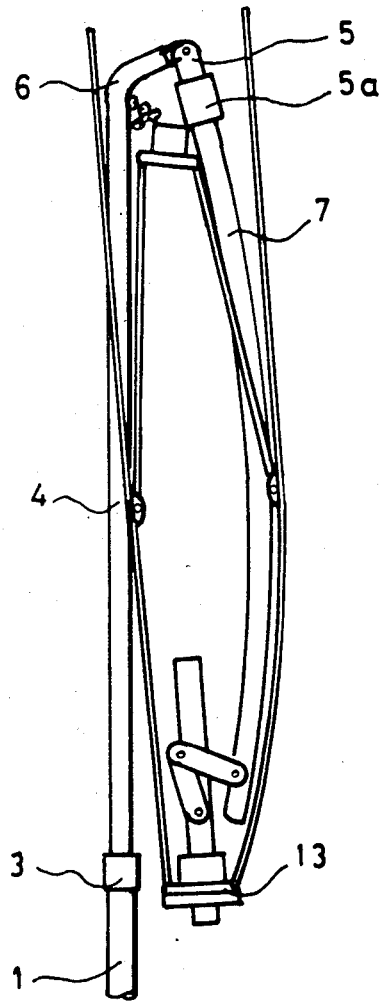
Fig.6

Fig.14
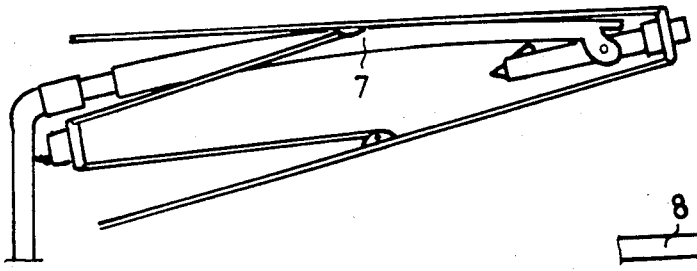
Fig.13
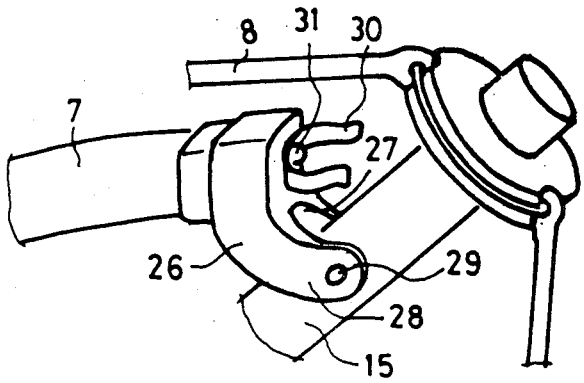
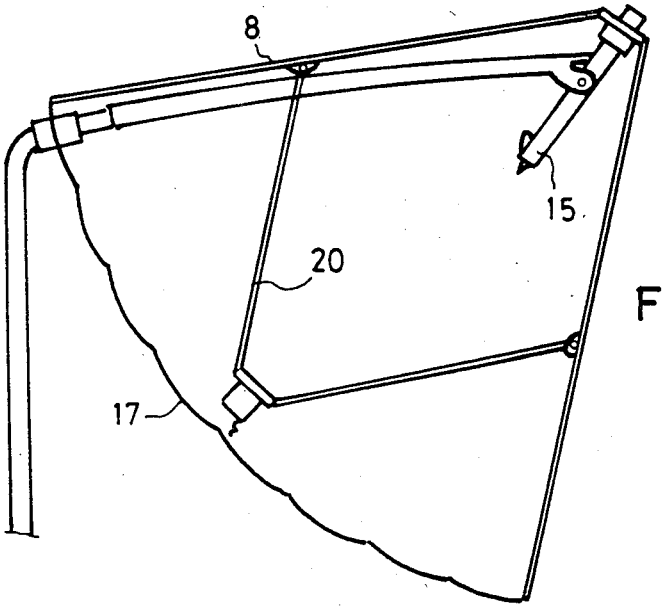
Fig.15
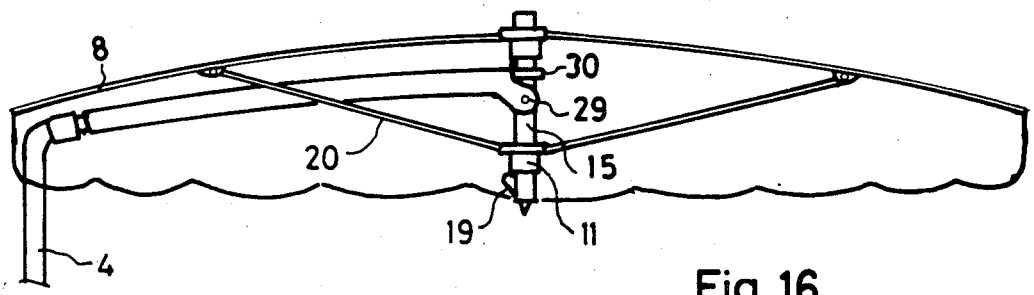
Fig.16

Fig.17
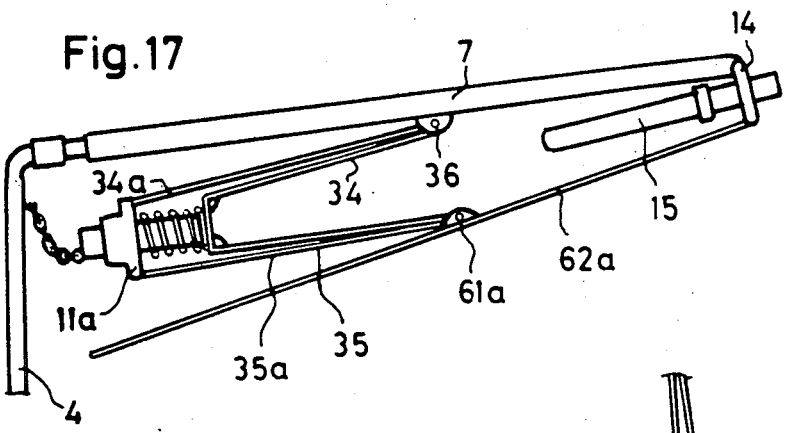
Fig.18
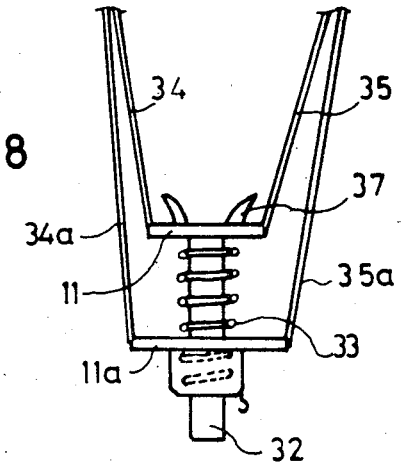
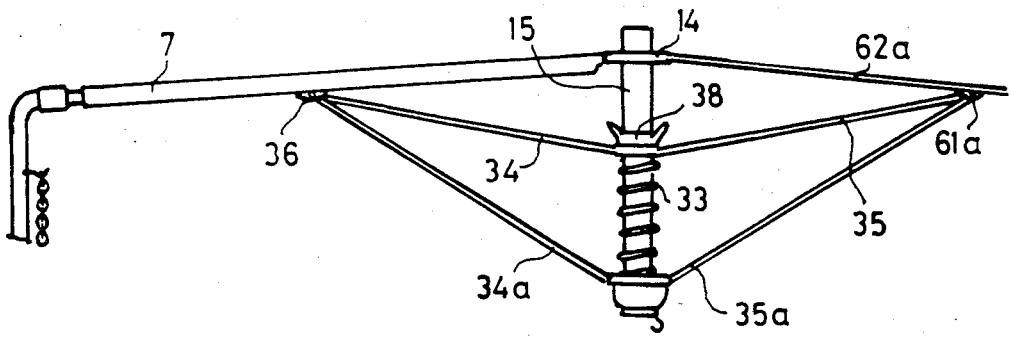
Fig.19

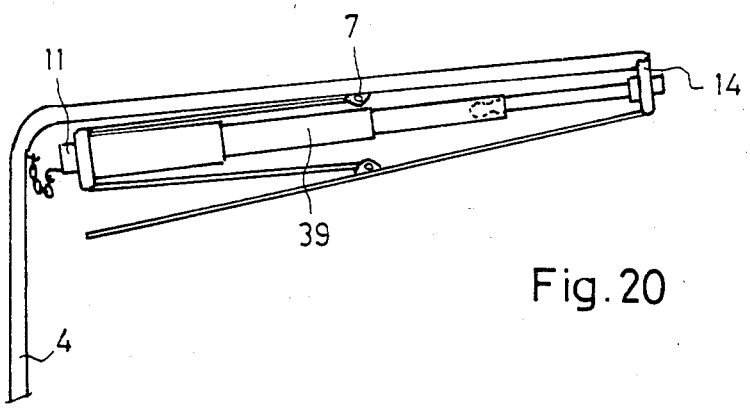
Fig. 20
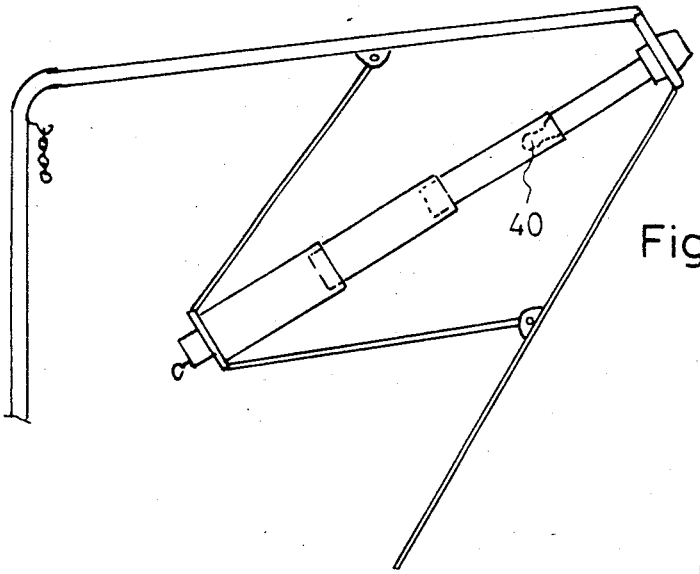
Fig. 21
Fig. 22
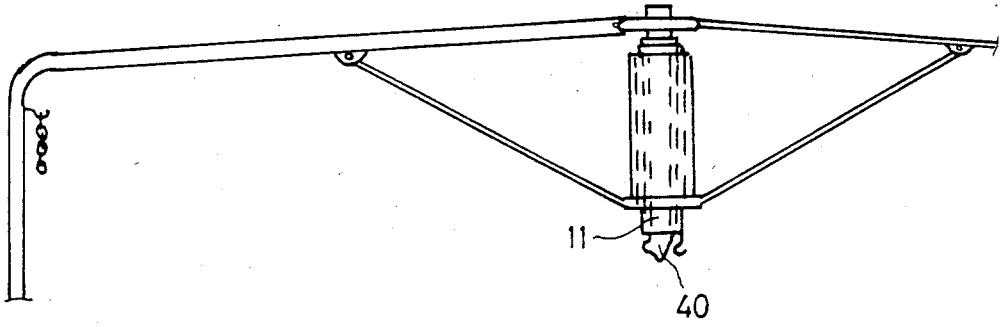

Fig. 29
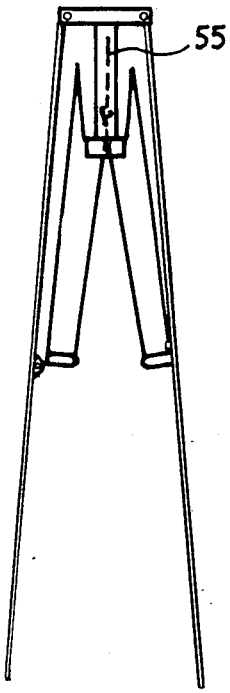
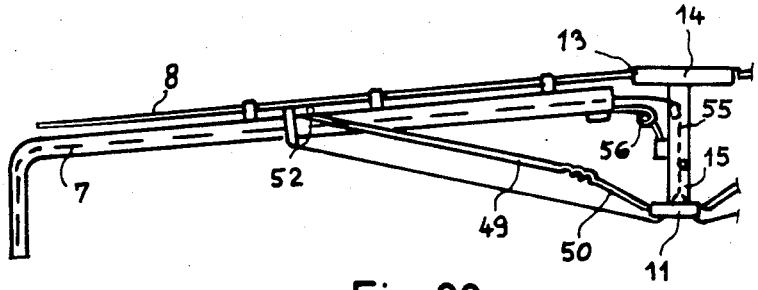
Fig. 30
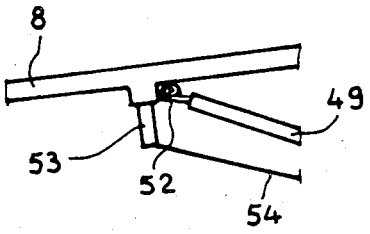
Fig. 32
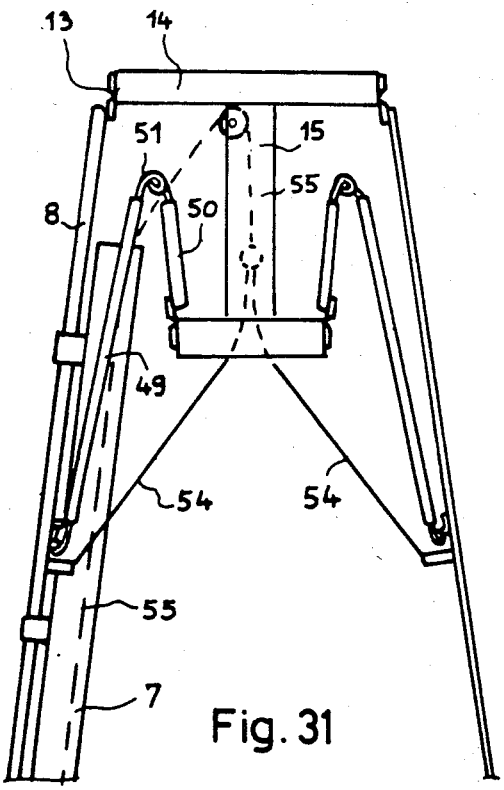
Fig. 31
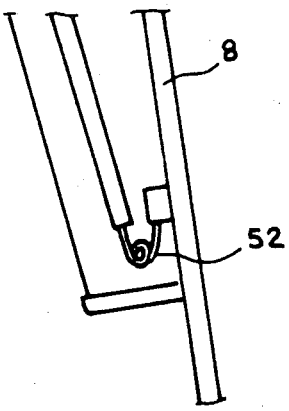
Fig. 33

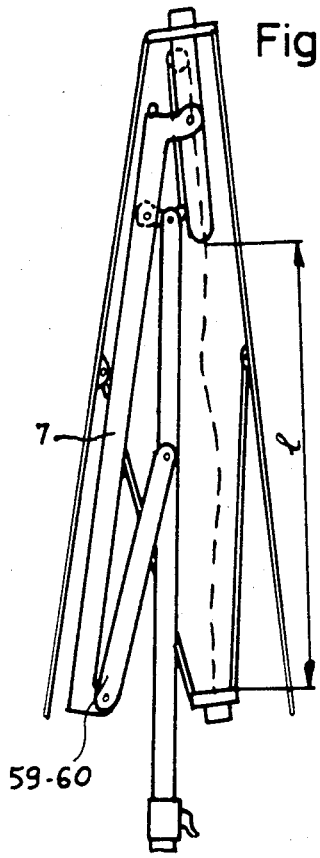
Fig. 34
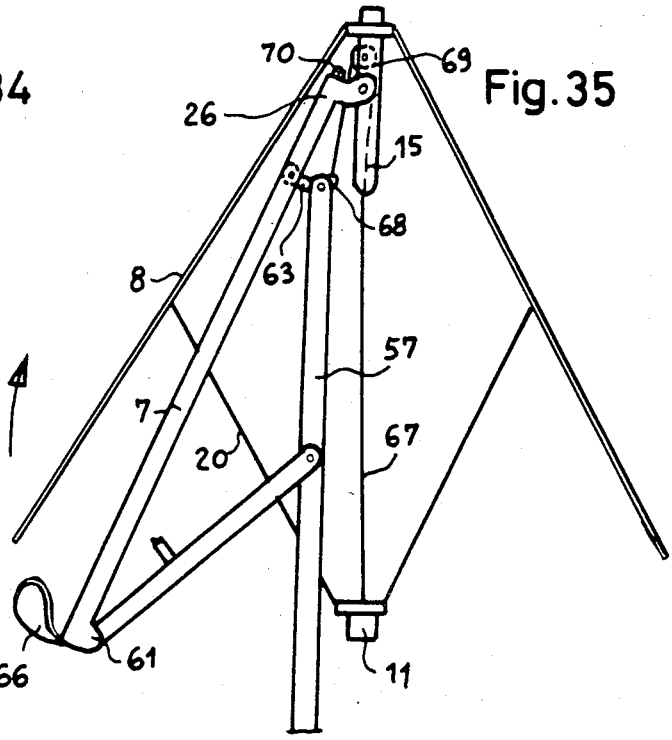
Fig. 35
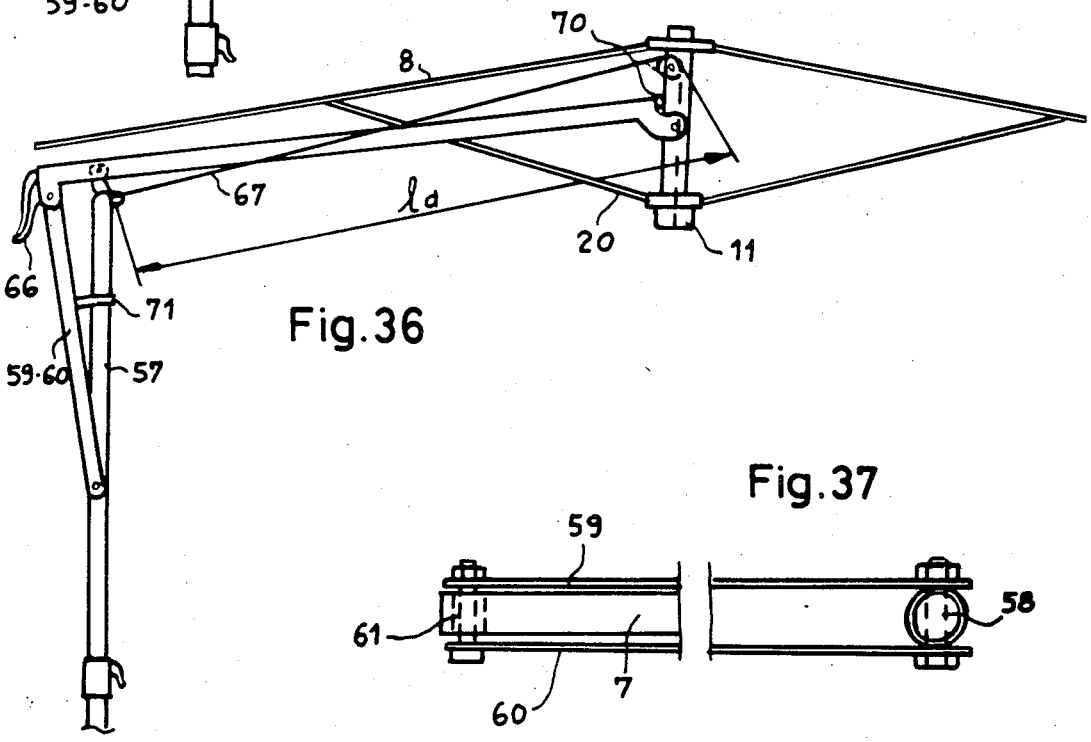
Fig. 36
Fig. 37

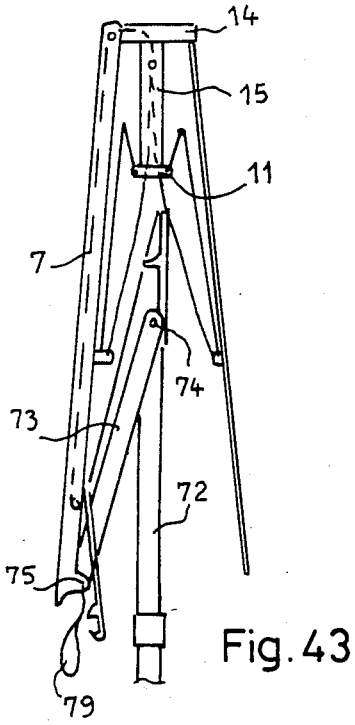
Fig. 43
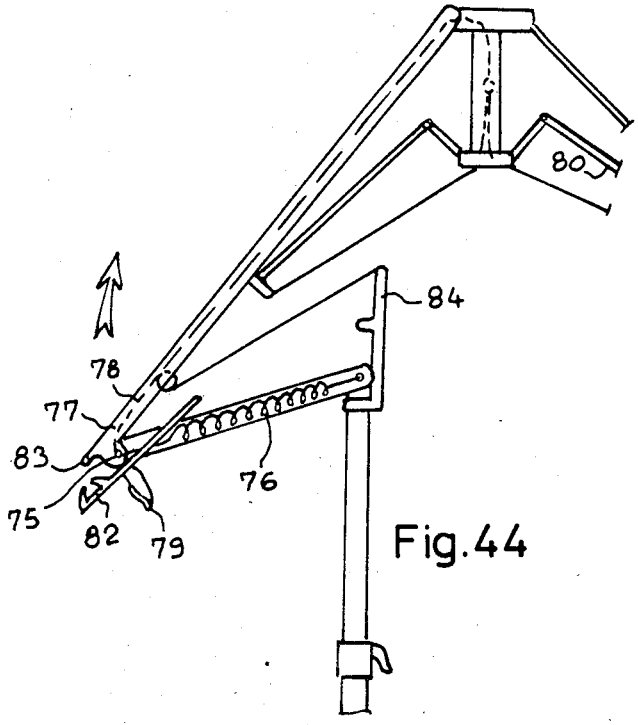
Fig. 44
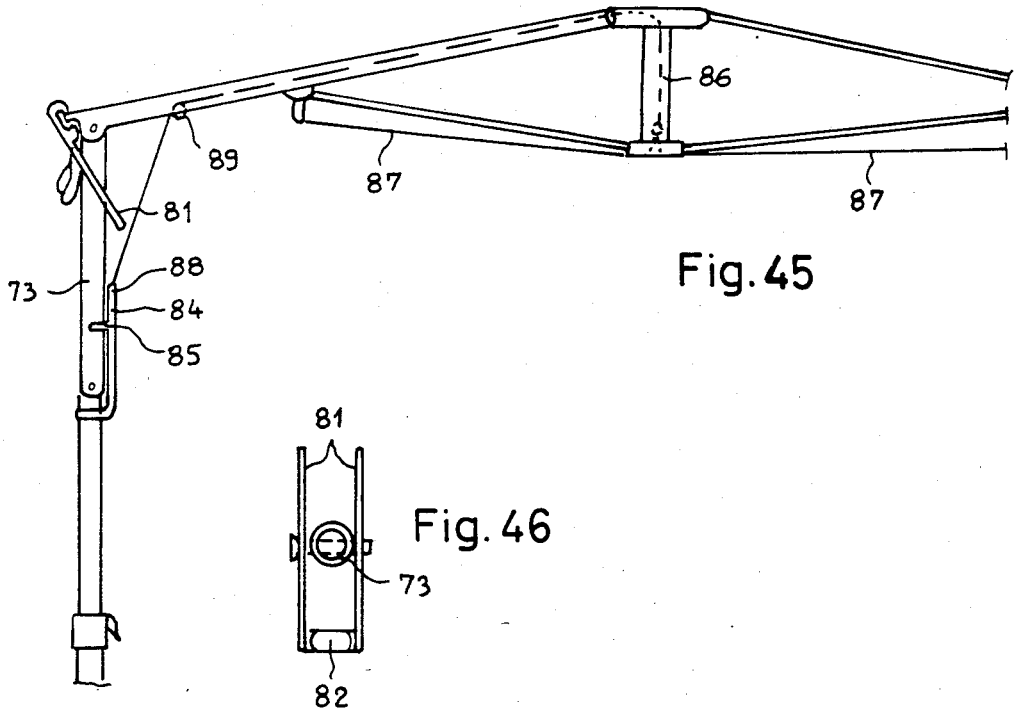
Fig. 45
Fig. 46

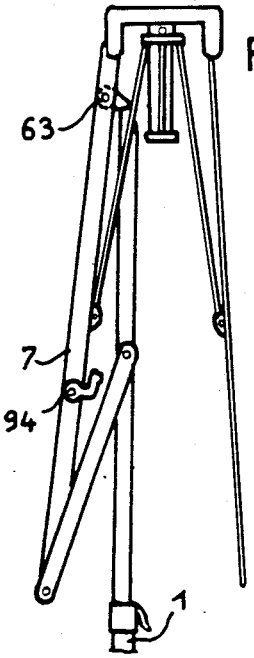
Fig.50
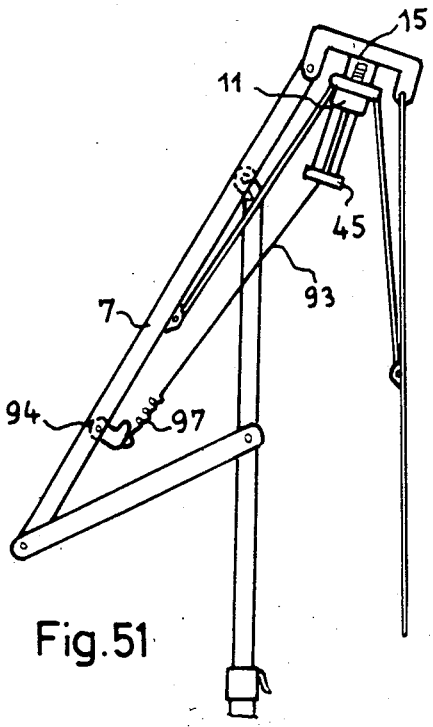
Fig.51
Fig.52
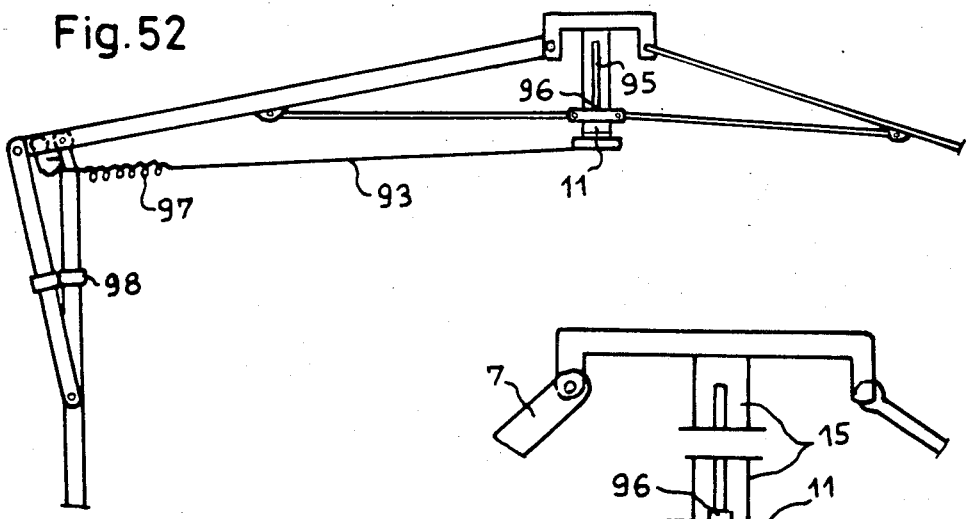
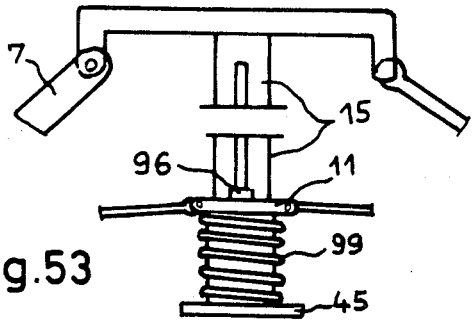
Fig.53

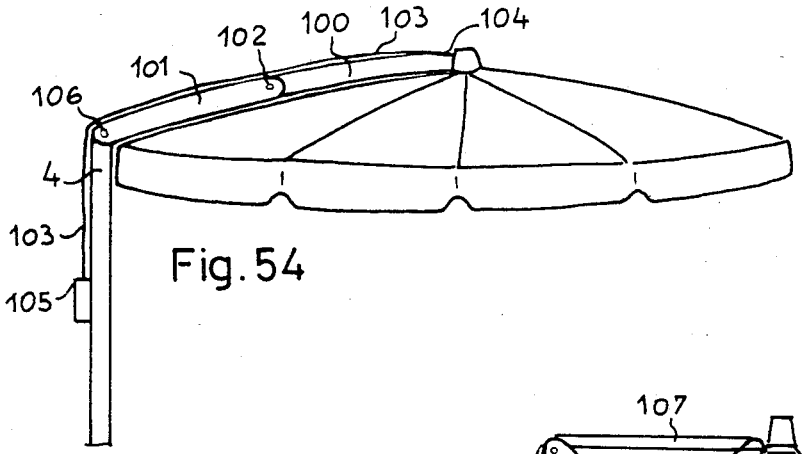
Fig. 54
Fig. 55
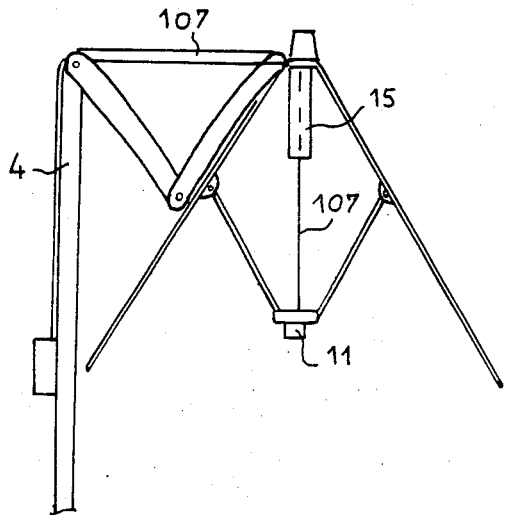
Fig. 56
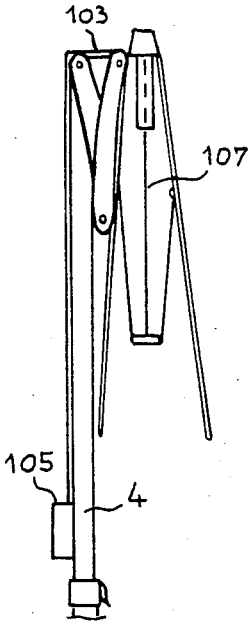
Fig. 57
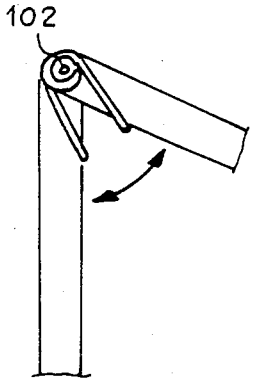
Fig. 58
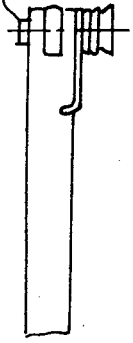

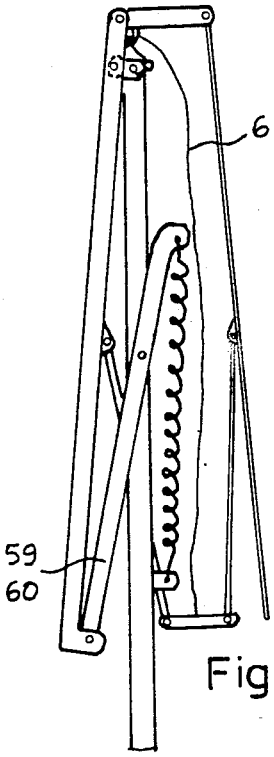
Fig.62
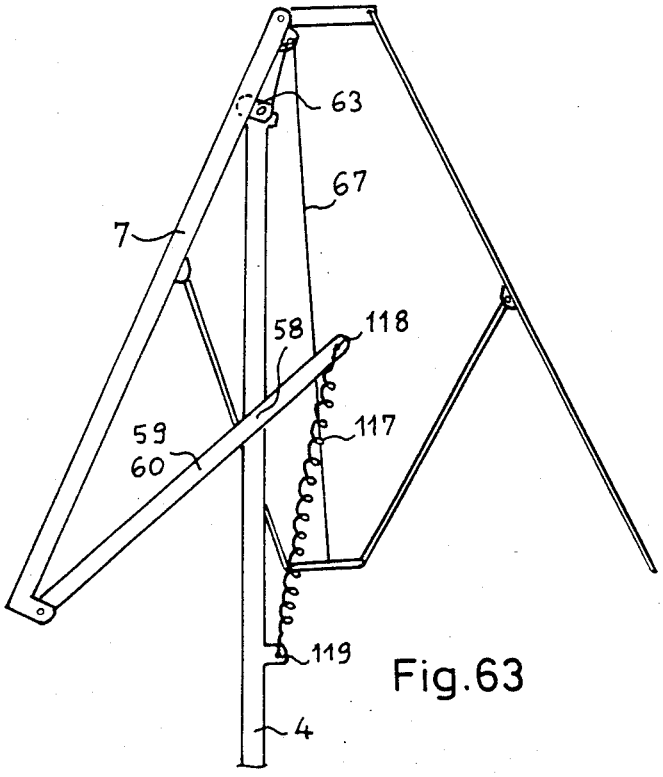
Fig.63
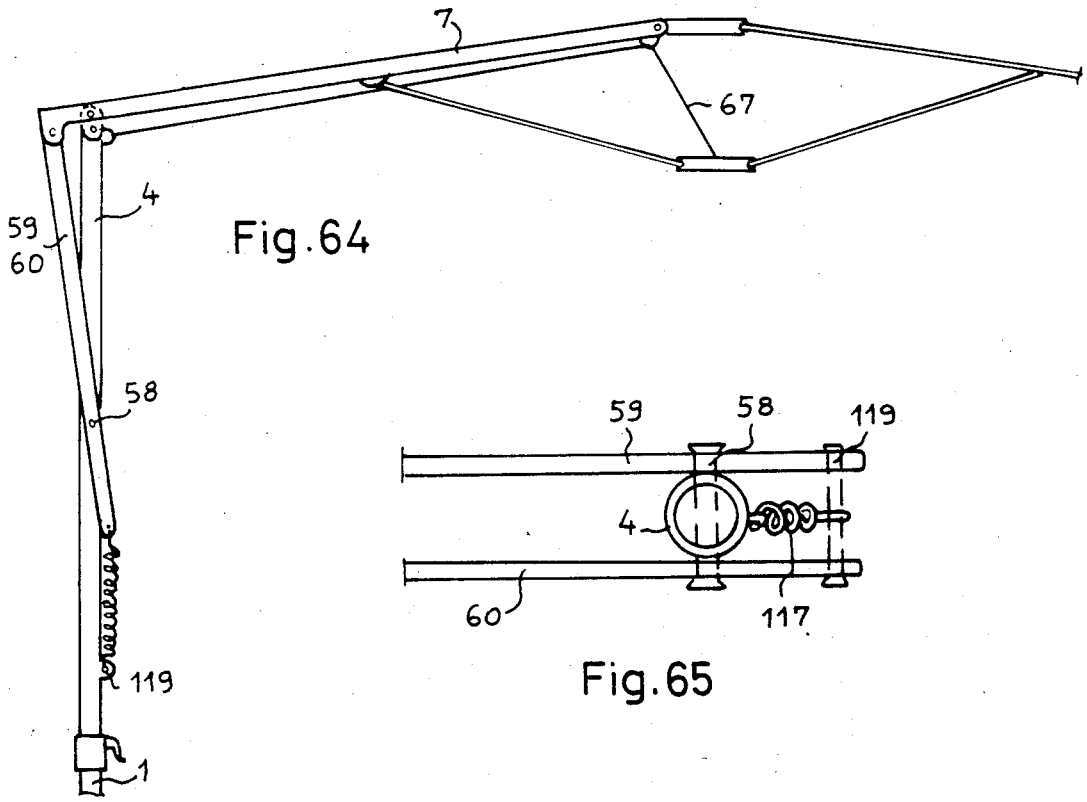
Fig.64
Fig.65

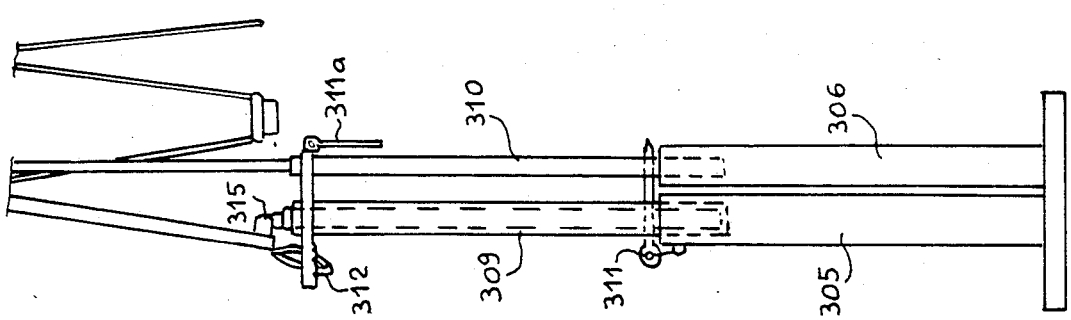
Fig.67
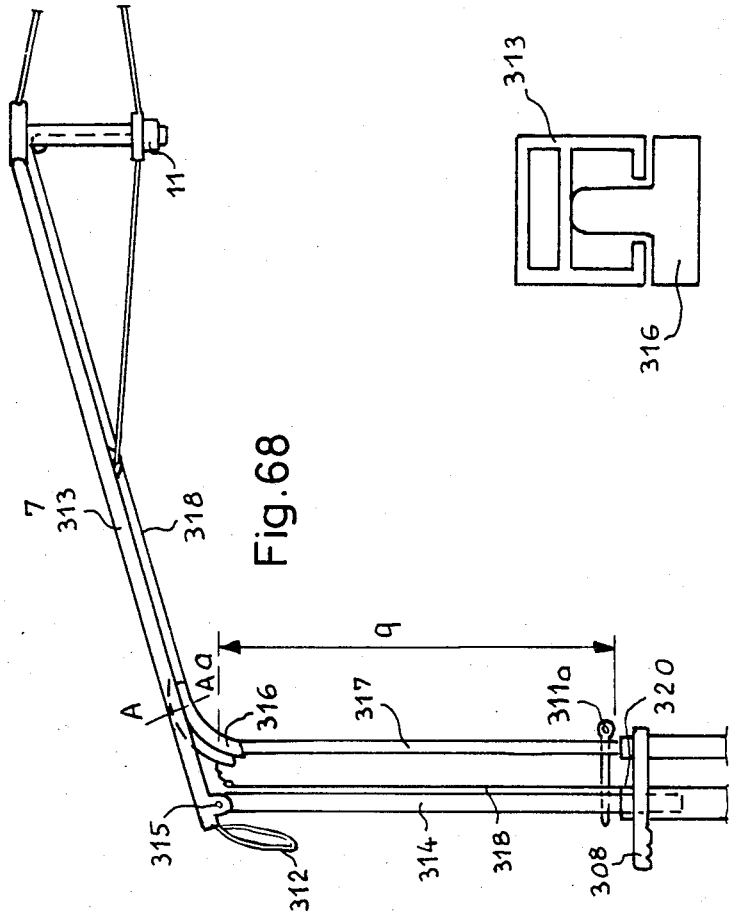
Fig.68
Fig.69
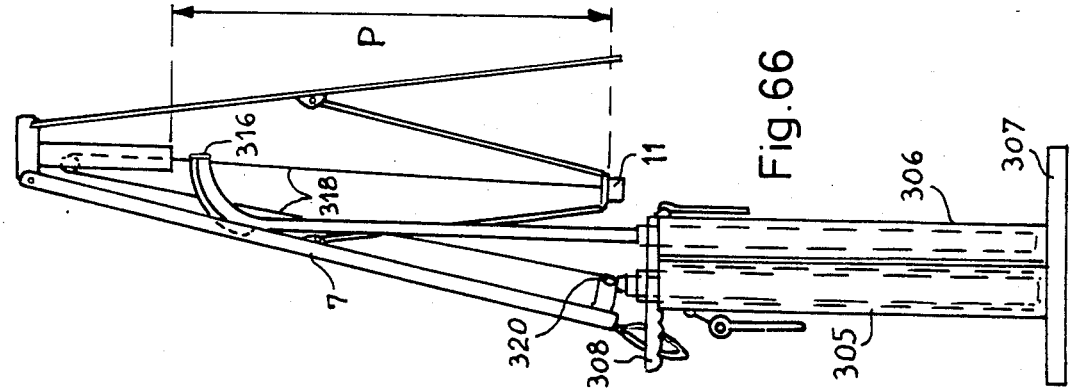
Fig.66

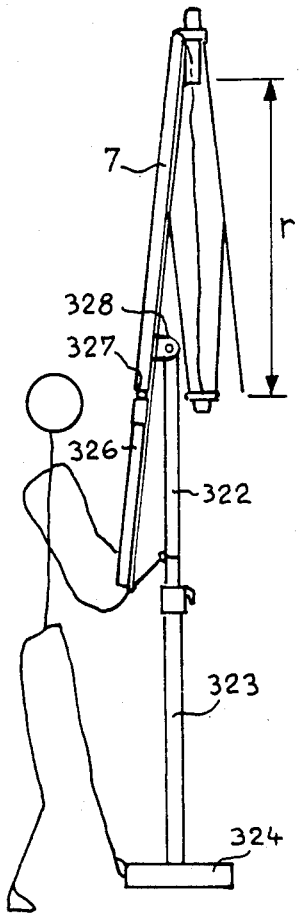
Fig.70
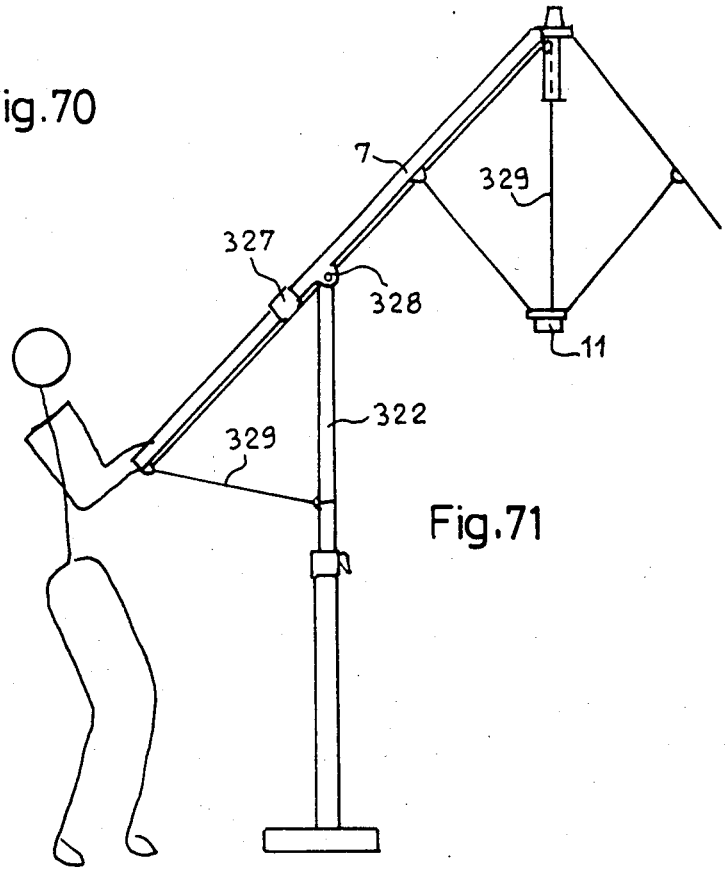
Fig.71
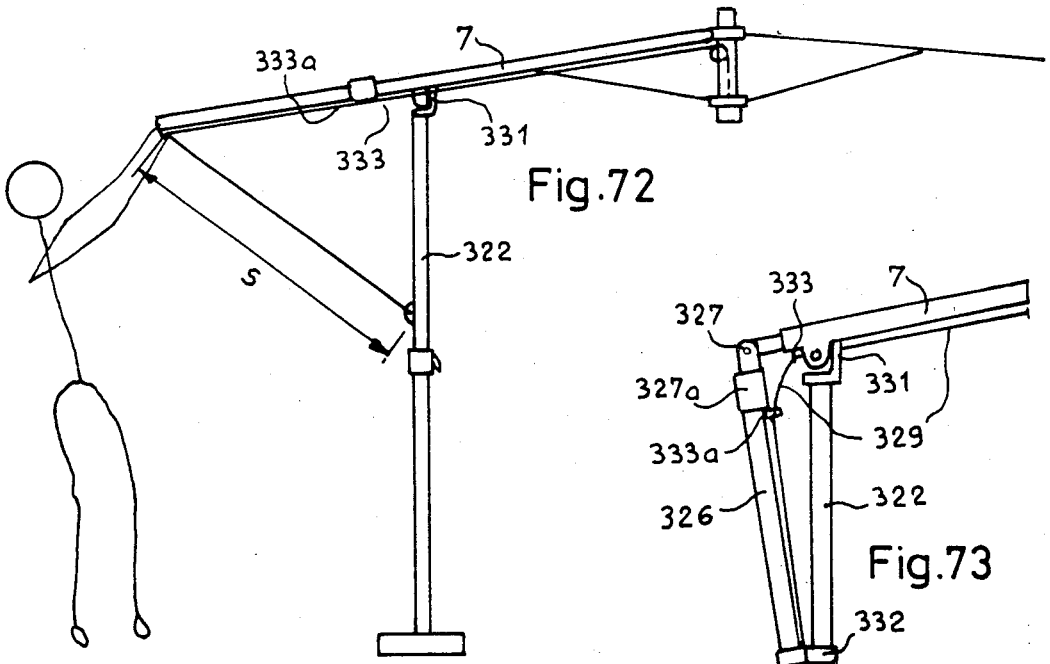
Fig.72
Fig.73

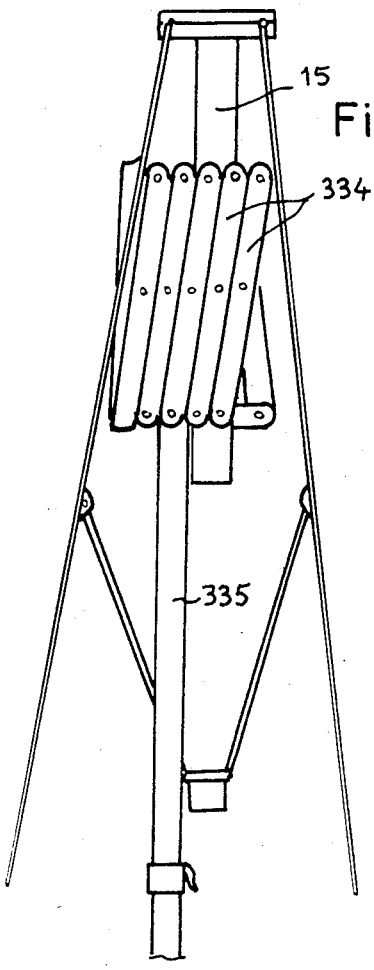
Fig.74
Fig.75
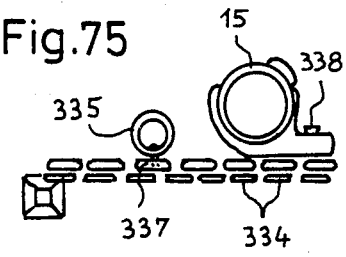
Fig.76
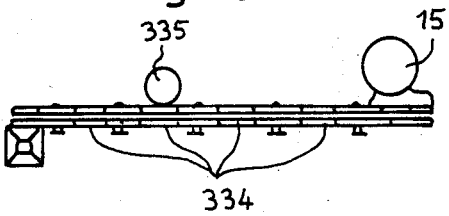
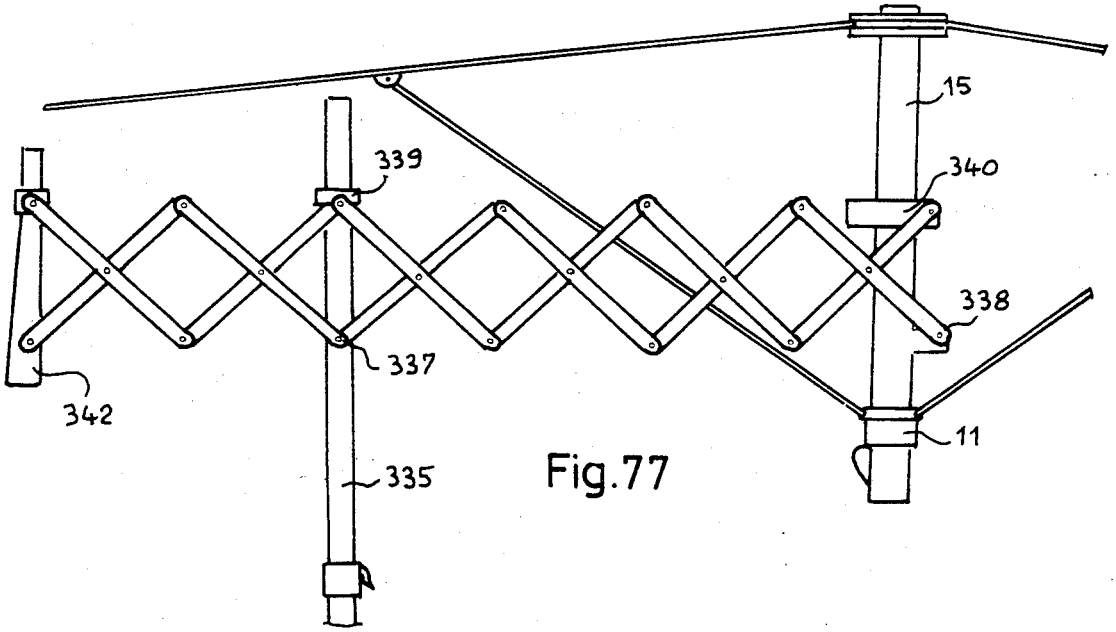
Fig.77

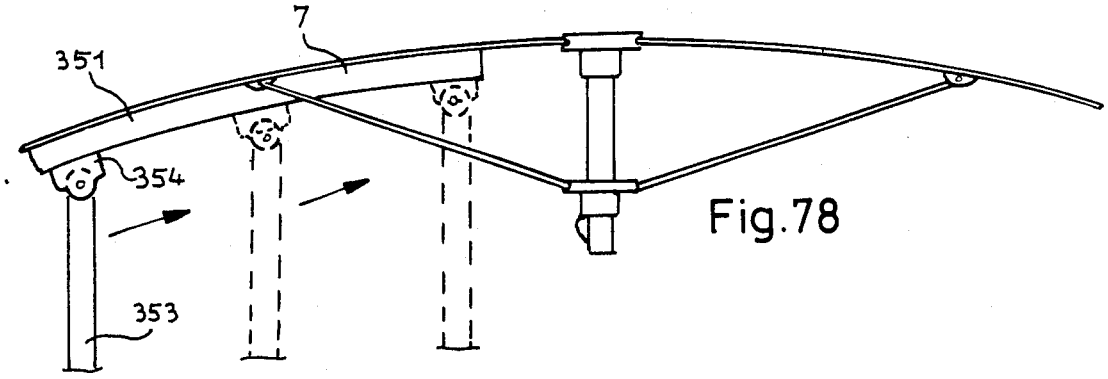
Fig.78
Fig.79
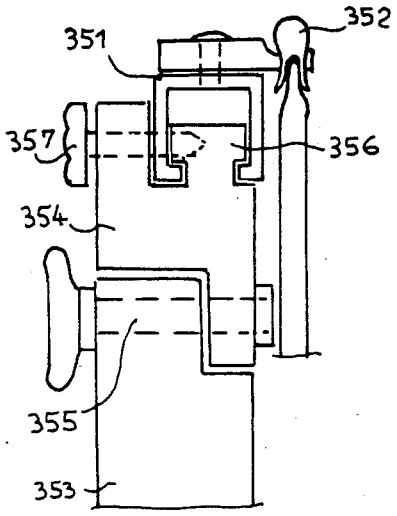
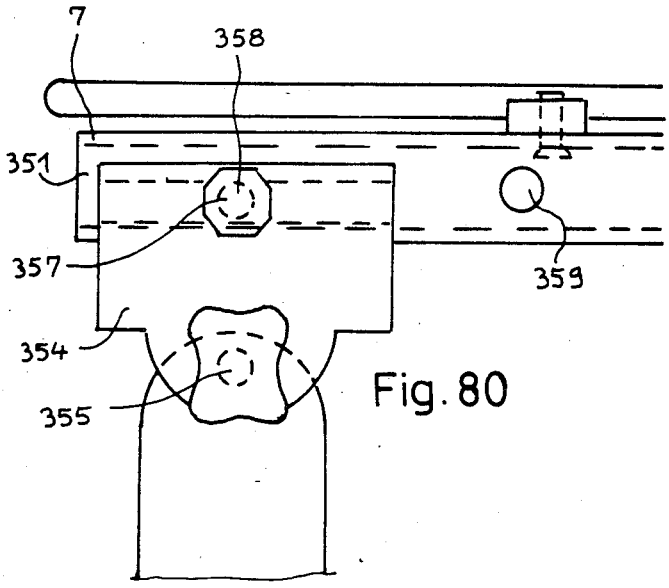
Fig. 80
Fig. 81
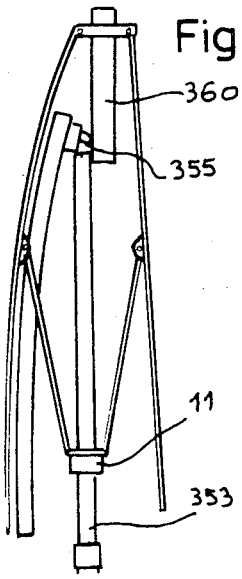
Fig.82
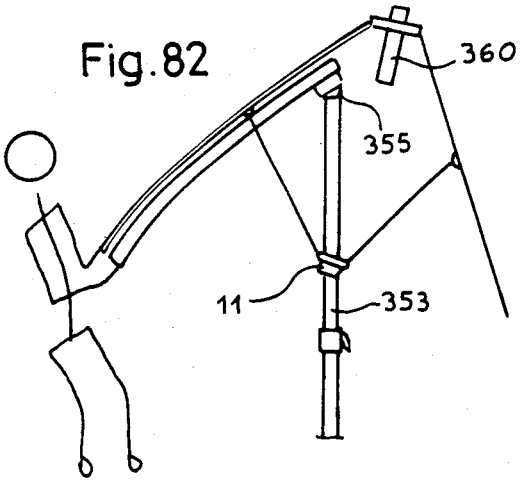

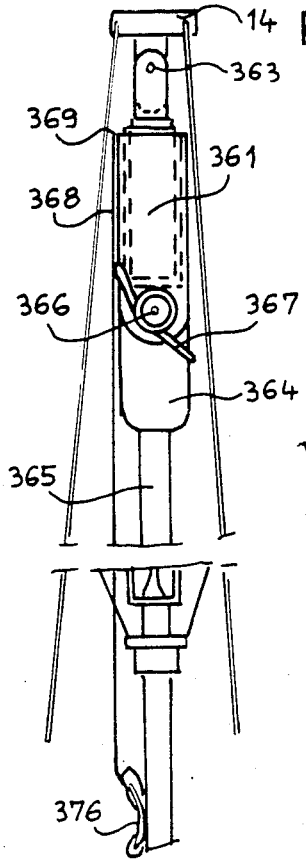
Fig. 83
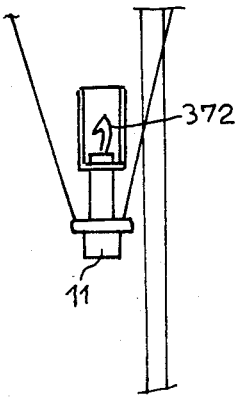
Fig. 84
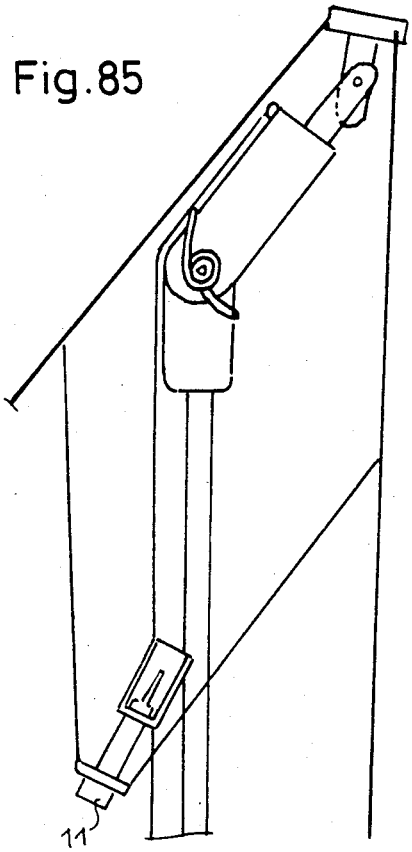
Fig. 85
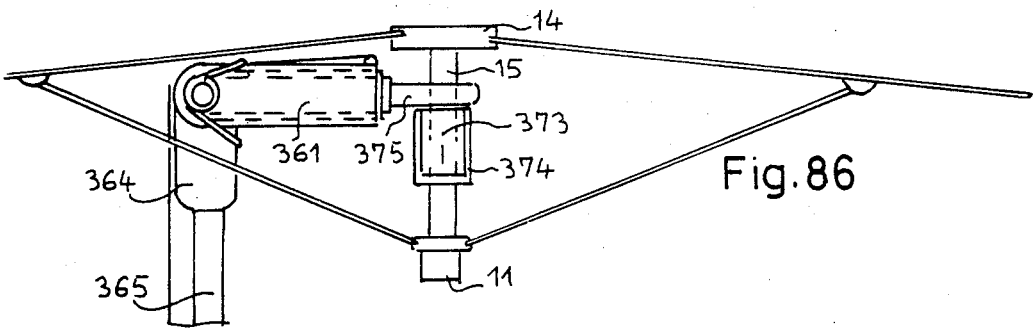
Fig. 86
Fig. 87
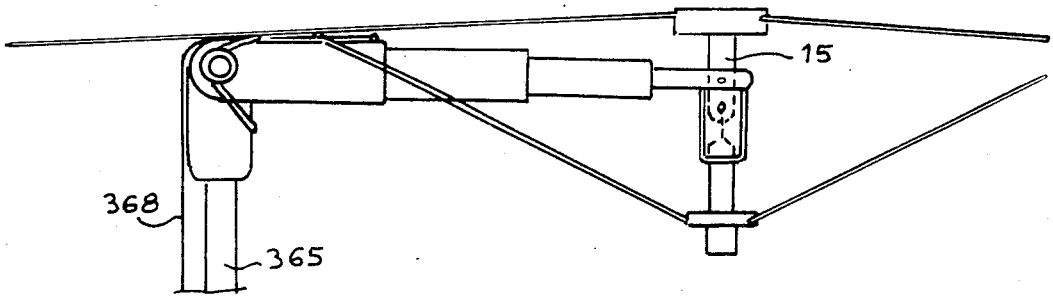

Fig.93
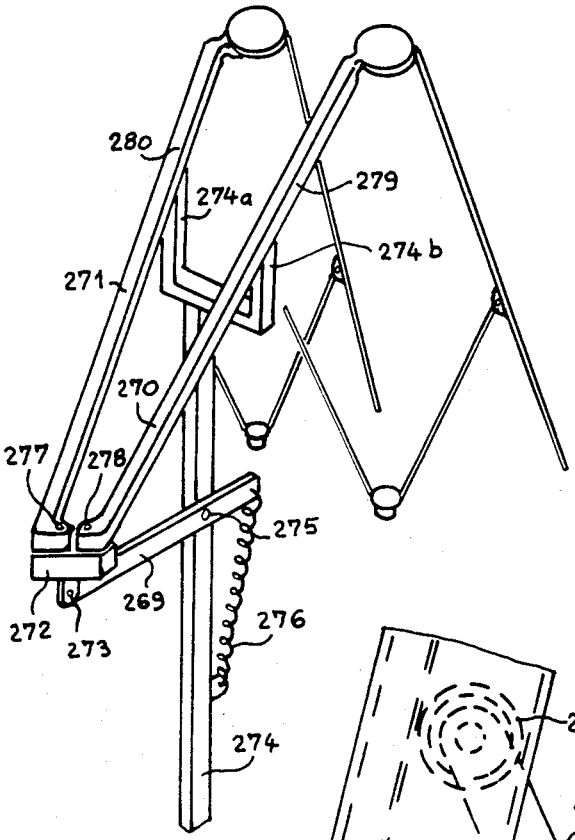
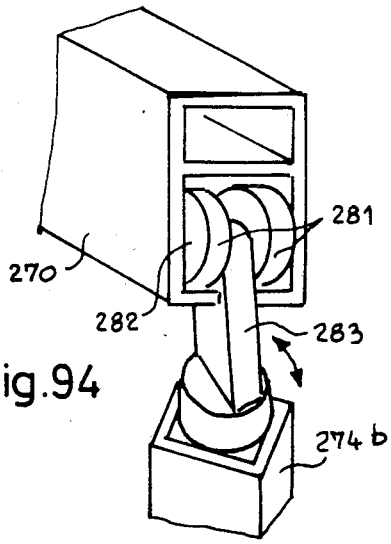
Fig.94
Fig.95
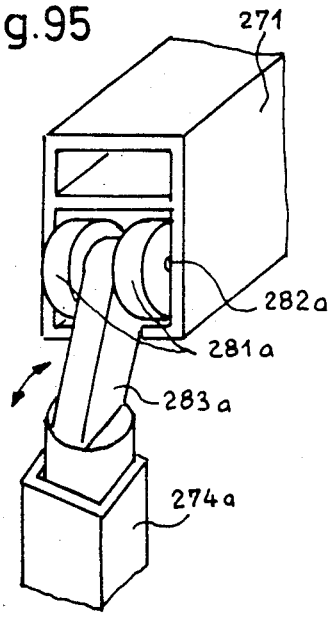
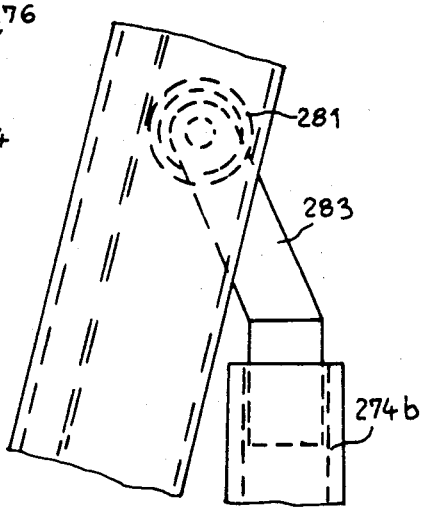
Fig.96
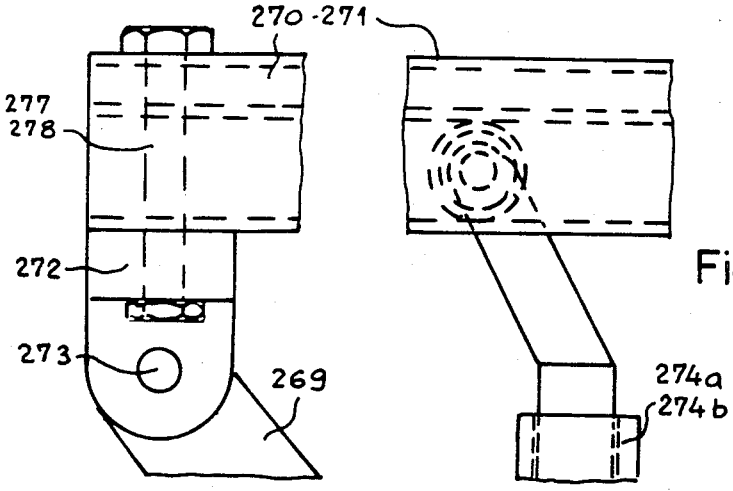
Fig.97

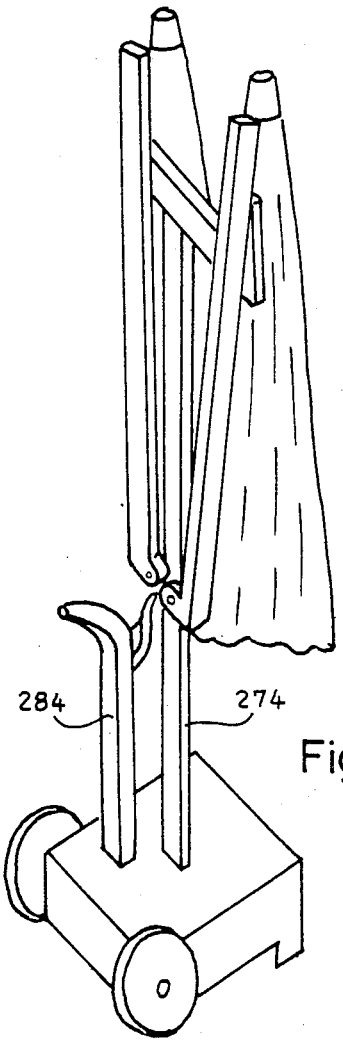
Fig.98
Fig.99
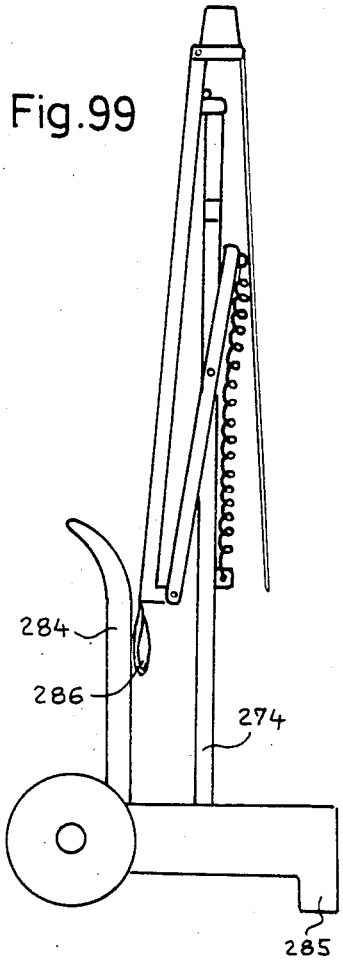
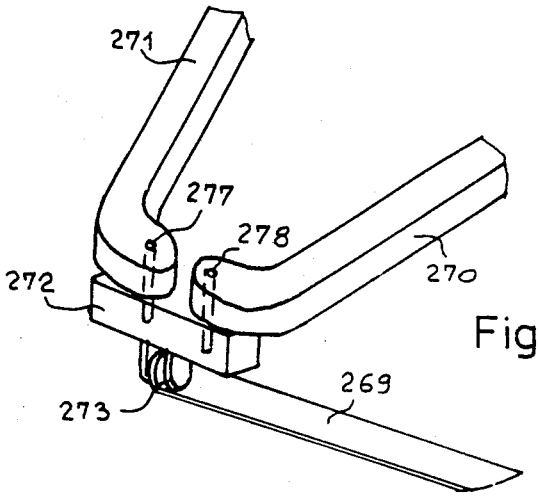
Fig.100

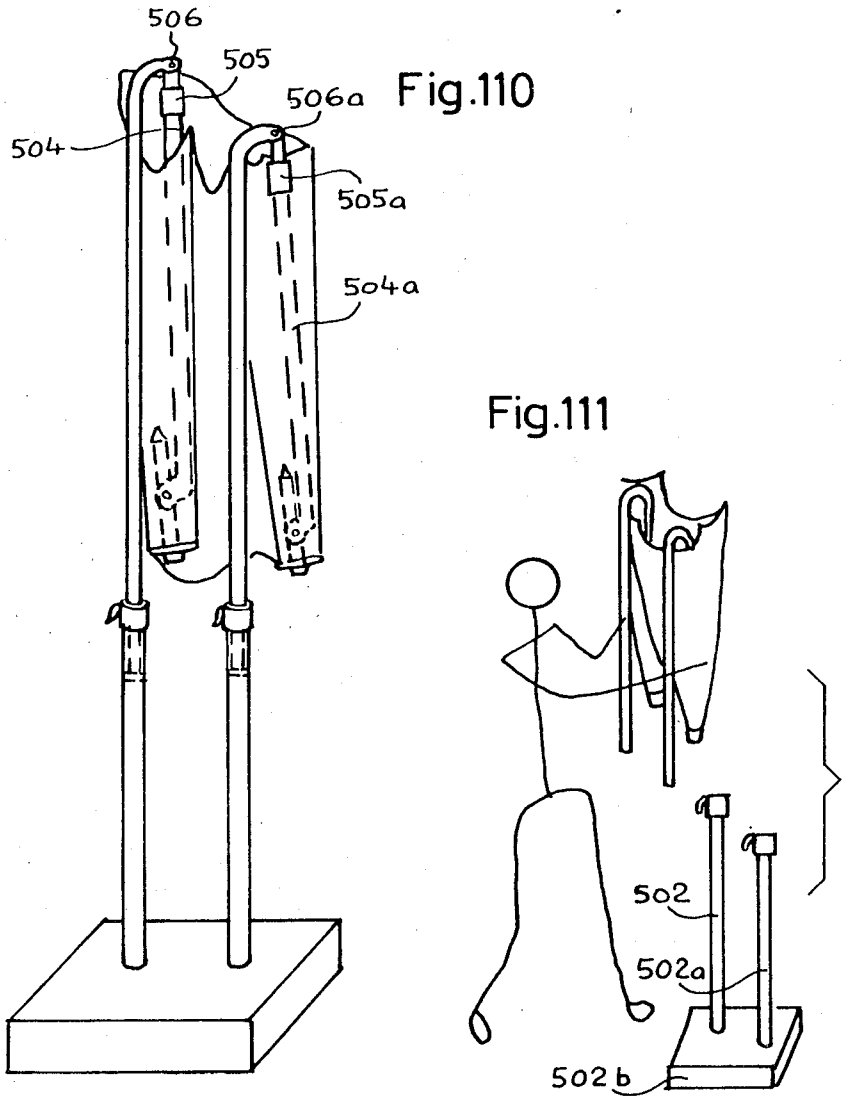
Fig.110
Fig.111
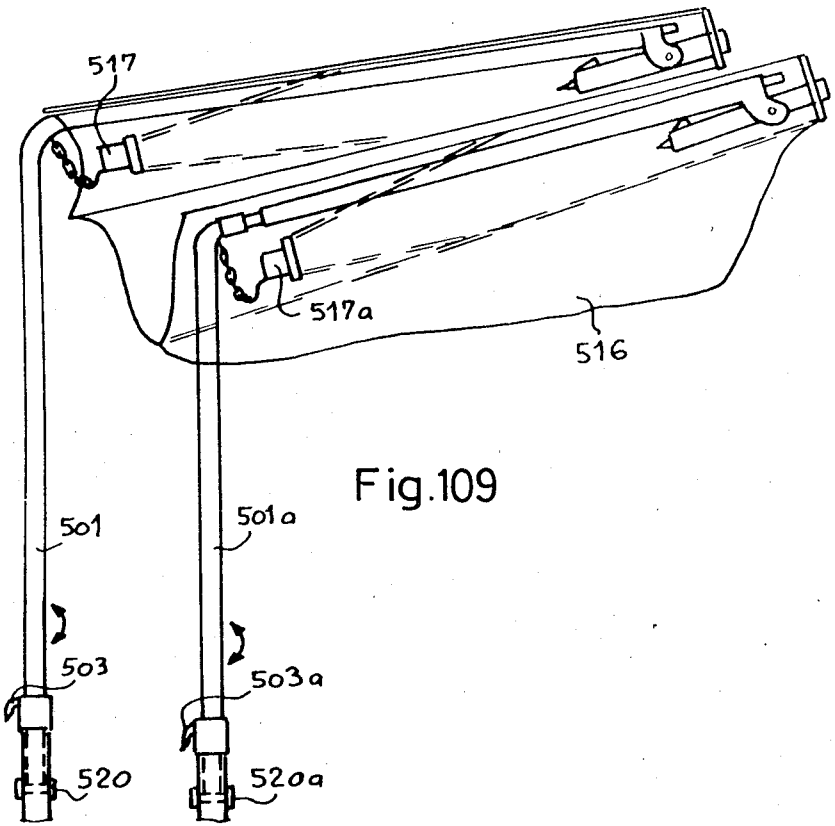
Fig.109

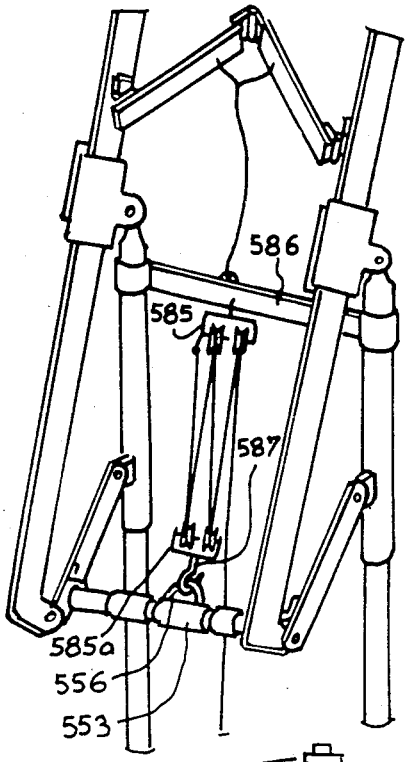
Fig.127
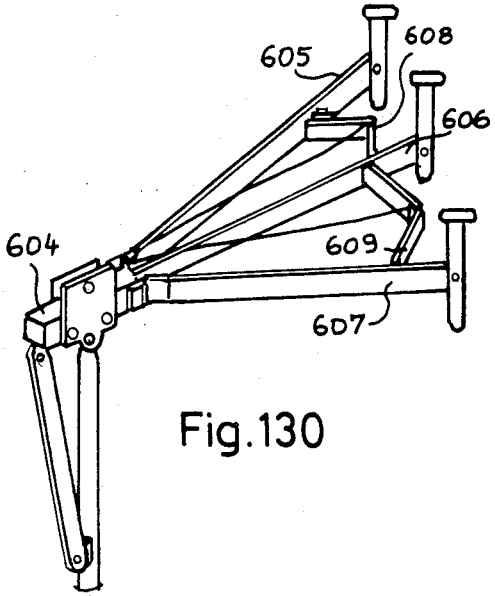
Fig.130
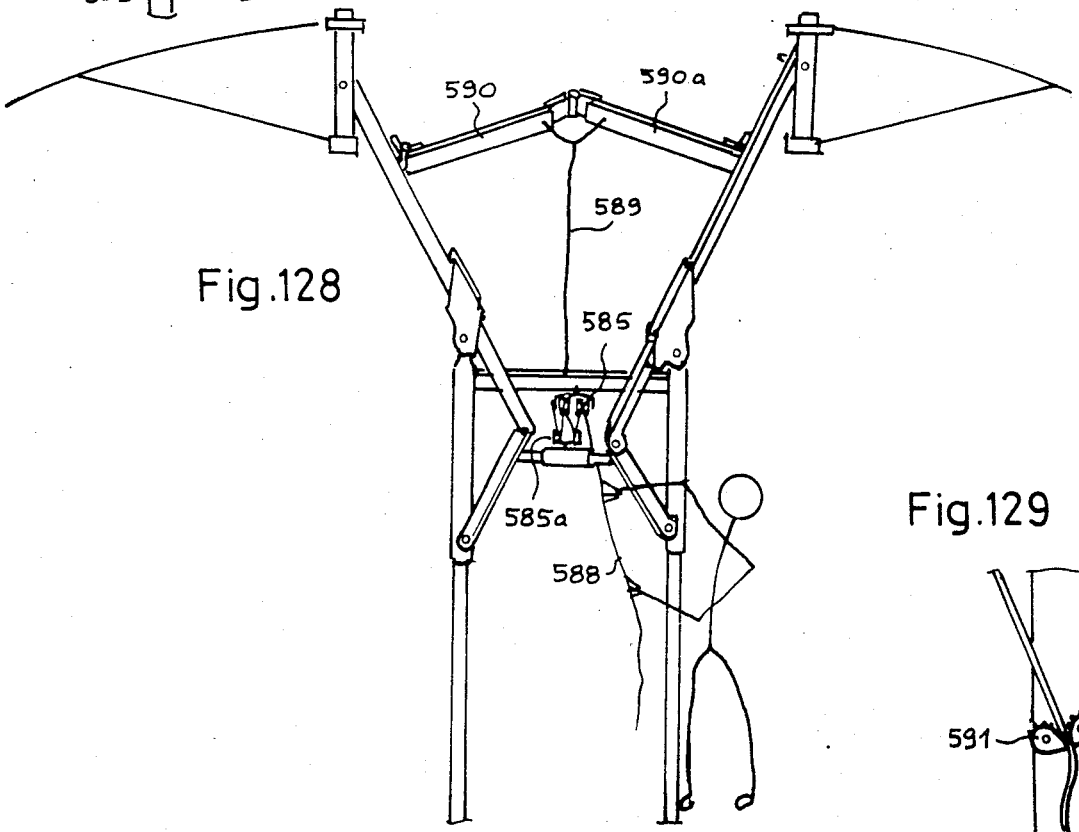
Fig.128
Fig.129
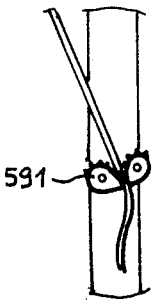

Fig.133
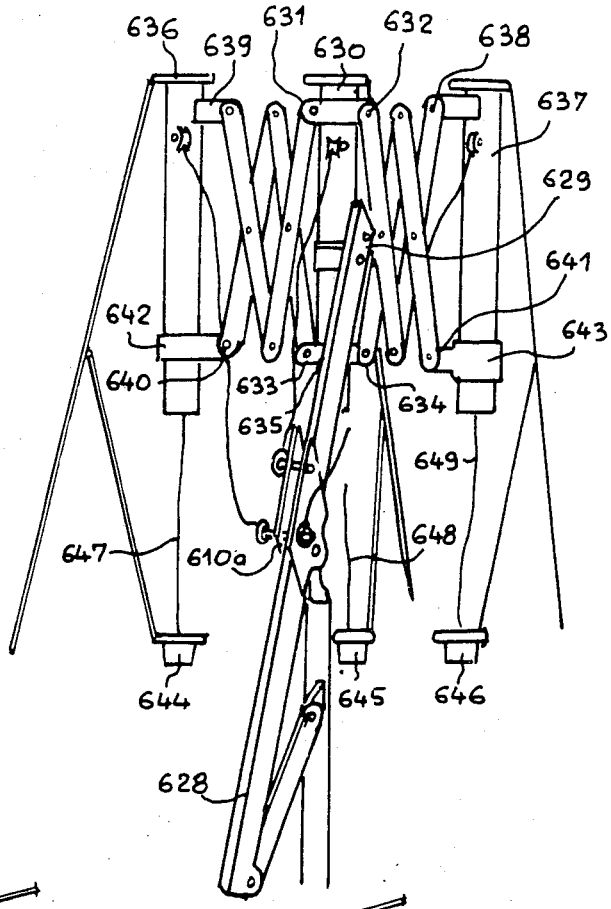
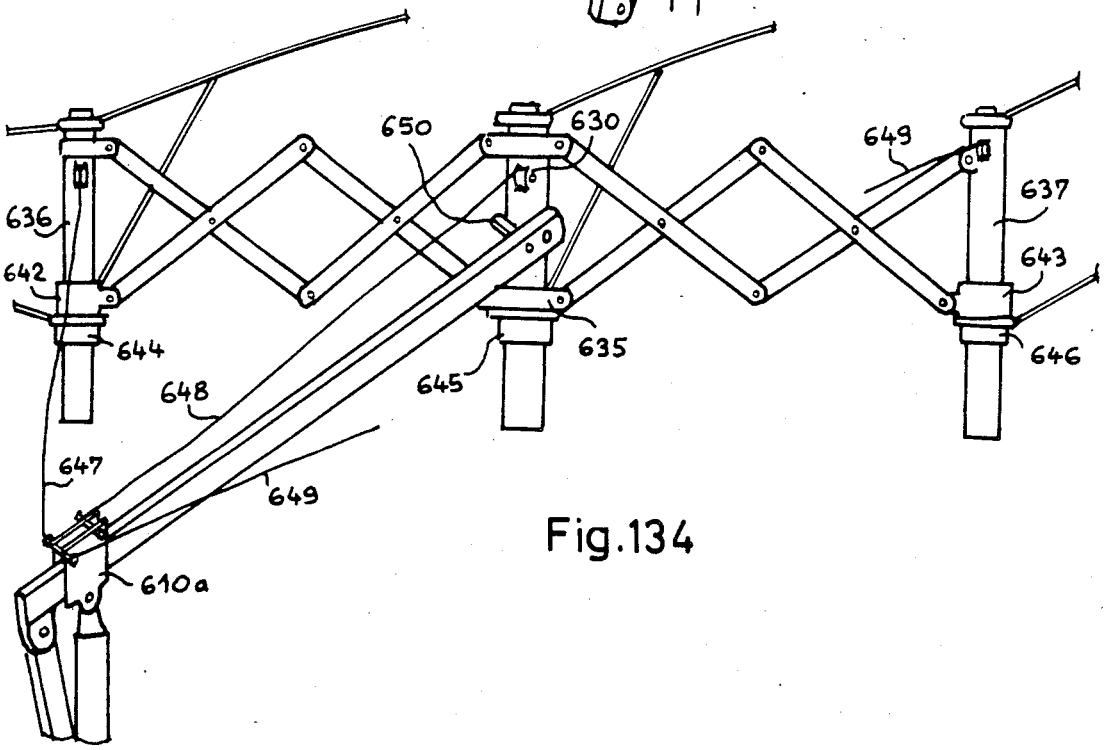
Fig.134

PROTECTIVE SHELTER, SUCH AS AN UMBRELLA WITH OFFSET SUPPORT

The present invention relates to protective shelters such as umbrellas or sunshades for pleasure or professional purposes or for open-air stalls or booths, usable in any location resuiring protection from the sun or the rain.

More specifically, the invention relates to protective shelters in which the support is offset with respect to the fabric cover so as to free entirely the space situated under the cover.

The most generally known umbrellas are manufactured from a framework comprising elements called ribs and a vertical mast on which slides a slider or lower hub so as to stretch the fabric cover of the umbrella by means of counter ribs.

This central vertical mast causes considerable inconvenience to the user and, in the center of a garden or restaurant table, the umbrella only provides a relative comfort. First of all, caught by the wind, it creates oscillations which make the equilibrium of the laid table unstable. During conversation, the persons sitting opposite each other are inconvenienced by the presence of the central mast which gets in the way.

In the case of large tables, it is often necessary to use two umbrellas, which is particularly unsuitable. In fact, in the case of circular umbrellas, the center of the table is completely uncovered. In the case of rectangular umbrellas a well defined size is required so that they may be adapted to the hole formed in the table, which requires the use of certain tables to the exclusion of others.

But more especially, opening and closing operations are difficult for, once the umbrella is installed in its spike, a downward movement must be made to open it while bending towards the center of the table and, thus, at arms' length make an effort in an off balance or cantilever position. Then, when the ribs move away from each other, the user is pushed back outwardly from the center while bending back to avoid being hurt by said ribs and, while maintaining his effort, he must position himself under the umbrella to finish tightening the slider still at arms' length.

This operation is only tolerable for fairly small diameter umbrellas for, in the case of large sizes, it is necessary to have masts of considerable height so that the slider which stretches the ribs may slide and, therefore, the user has not sufficient physical resources to reach the open position. He must then use rods or pull handles which assist him in the operation. Such setting up is inconvenient, dangerous because of the weight and unaesthetic.

For use on a beach, the central spike prevents proper positioning of the mattress and the user may hurt himself against the spike when he moves.

To partly remedy some of these disadvantages, umbrellas have been proposed without a central mast, but whose design proves to be insufficient. More particularly, in French patent No. 1 283 388, opening is obtained by pushing the slider on the concave face side, and for that it must be at the height of the waist, which considerably limits the diameter of the umbrellas. Moreover, the operations for stabilizing and setting at a suitable height take place when the umbrella is open, which is difficult, heavy and inconvenient. Then, it cannot be closed again temporarily as is usual; in fact all the operations must be carried out again in the reverse direction. It is difficult to imagine all these operations around a table.

The device described in French patent No. 1 250 940 does not allow large sized umbrellas to be constructed, for the slider would touch the ground. Thus, we come back to the case of umbrellas with a central mast, in particular when the user closes the umbrella again he is completely underneath. The slider describes moreover the same vertical path perpendicular to the ground. Opening operations cannot be carried out, or only with difficulty, when the umbrella is above a table.

In U.S. Pat. No. 2,605,778, emphasis is laid on the support which makes the umbrella stand out, and adjustment is made in a fixed way. Furthermore, tools are needed for clamping.

French patent application No. 2 437 178 describes an umbrella with offset support whose framework, formed from ribs, is suspended from a cross-piece. Such a device is relatively difficult to transport and to fold up and, once folded, takes up an excessive amount of room.

Umbrellas are further known with a composite framework, that is to say formed from two generally circular half frames and supporting two circular cover portions connected by a rectangular cover portion. With such umbrellas shelters of larger dimensions may be constructed, but they still comprise two non offset masts disposed below the cover. The space under the cover is thus partially occupied by the masts, which makes the use of the shelter relatively inconvenient for disposing tables or other furniture below the cover fabric. Furthermore, the operations for closing these umbrellas are difficult and the whole once folded up is space consuming and makes it difficult for a single person to carry the device.

French patent No. 1 030 826 describes a retractable umbrella suspended from a tiltable cross-piece. Use of this device requires access to the top of the umbrella, which would not be possible in the case of a large sized umbrella which forms the subject of the present invention.

U.S. Pat. No. 1,328,901 also describes an umbrella, having an inclined handle for holding the frame in an offset position. With this device large sized umbrellas cannot be constructed either, and more particularly it comprises no fixed stand and means for hingeing the arm to this stand. These are devices whose purposes and means are different from those of the present invention.

One object of the present invention is to propose a device for constructing large sized umbrellas occupying a reduced space once folded up.

According to another object of the invention, the device is easy to set up and take down by a single person, and it may be opened or closed again by a single operation by the user. By means of a special arrangement, a pre-opening or pre-closing phenomenon is created for initiating the final operations. The user is thus freed form a part of the weight of the umbrella. This special arrangement also facilitates access to the operating device for providing better comfort.

Another object of the invention is to provide large sized umbrellas with a mast of relatively small height, requiring no particular assisting means for the opening and closing operations.

Another object of the invention is to propose a device able to be adapted to the back of a wall and to obtain the same use as a blind, while considerably limiting the installation costs.

According to another object of the invention, the height occupied by the frame below the cover is reduced to a maximum so as to completely free the covered volume.

For this, and according to one feature of the invention, the umbrella comprises a fixed stand and at least one cover held in place by at least one frame formed from radial ribs hinged to a first hub and counter ribs themselves hinged to a second hub and to the ribs; at least one radial arm is provided hinged to the fixed stand, and able to be opened out between a first position in which the arm is folded against the stand and an opened out position in which it is held stretched substantially horizontally; locking means are provided for selectively holding the radial arm in one and other of the endmost positions; one of the frames at least is mounted at the end of a radial arm so as to be offset with respect to the stand, the ribs of the frame forming a cone orientatable with respect to the arms; means permanently hold a radial portion of the cover in the vicinity of the radial arm. With this arrangement an umbrella may be constructed which, in the folded up position, takes up less space for the cover and the ribs are located substantially parallel to the stand, the radial arm then being brought back against the stand, either inside or outside the bundle of ribs; furthermore, the opening out movement of the ribs and the pre-opening of the cover is tied to the opening out movement of the radial arm so that the operations for setting up the device are appreciably reduced, the force to be supplied by the user being furthermore smaller.

According to another feature of the invention, a first hub of the frame is integral with the radial arm, the second hub being mobile so as to allow in a way known per se the ribs to be opened out and folded up again; in the case of umbrellas formed from several partial frames, the mobile hubs are subjected to lateral thrusts tending to bring them closer to the center of the umbrella under the action of the weight and the tension of the ribs and of the cover; in the case of umbrellas with a single frame, dissymetrical thrusts also occur on the ribs tending to move the hubs away from each other. To counter the forces, the mobile hubs are further urged by guide means limiting their movement towards the center of the umbrella with respect to the fixed hub. These guide means may be formed in several ways: the mobile hub may slide on a truncated mast integral with the first hub—or the two hubs are connected together by means of a telescopic mast—or the mobile hub is connected to the radial arm by a link—and/or a cable may draw the two hubs together. With all these arrangements, more especially, the whole of the covered volume may be freed, the frame occupying a small height.

According to another feature of the invention, particularly advantageous in the case of umbrellas comprising several partial frames, the partial frames are hinged to different radial arms; the radial arms may be fixed and divergent, so that, in the folded up position, they are relatively close to one another so as to reduce the space occupied by the device and, in the opened out position, their ends supporting the central mast are spaced apart as much as possible so as to stretch the cover and form a large sized shelter.

According to another feature of the invention, the frame comprises a central truncated mast which is hinged with respect to the first end of the radial arm so as to be orientated between a first position in which the mast is parallel to the arm with the lower hub directed towards the second end of the arm and a second position in which the mast is held substantially perpendicular to the arm by locking means. This arrangement ensures good rigidity of the umbrella in the open position, without however appreciably increasing the height of the frame in the opened out position so as to free as much as possible the space situated under the cover.

According to another feature of the invention, in the case of umbrellas having several partial frames, the radial arms may open out in radial directions, and are further orientatable through a rotation movement with vertical axis for moving them apart or together; means hold them spaced apart from each other when they are in the opened out position so as to stretch the cover. For that, it is more especially provided for the stand to comprise elements orientatable with respect to a fixed part about a vertical axis of rotation and to which the radial arms are hinged. The central masts may be connected together by a telescopic bar for adjusting and maintaining their spacing apart, or else the orientatable elements may be locked in position by locking means which interlock them with the fixed part. Thus a large sized cover may be stretched.

According to another feature of the invention, the radial arm is connected to the stand by its second end by means of a purely rotational hinge with horizontal axis, locking in the opened out position being provided by a ring sliding on the arm and covering the hinge. Thus, a shelter is formed in which, in the folded up position, the umbrellas have a downwardly directed head, the cover being disposed along the radial arms and folded back against the stand. The opening out and folding operations are carried out in a particularly simple way requiring reduced force from the user. Thus, a large surface is covered without requiring an increased height of the device during the operation.

According to another feature of the invention, the radial arm is slidably mounted in the housing of the stand, with its second end connected to the lower part by a link hinged both to the arm and to the stand below the housing and at a distance substantially equal to the length of the link. Thus a shelter is formed in which, in the folded up position, the umbrella has an upwardly directed head, without however increasing the height required for operation. The radial arm and the bundle of ribs are brought back against the stand, the arm being inside the bundle if the frame stretches the cover from underneath and being outside the bundle if the frame is above the cover.

If required, for automatic opening out of the ribs, a cable is fixed to the sliding hub, passes into the tubular central mast and passes along the radial arm for fixing to the stand. The opening out movement of the radial arm causes simultaneously opening or pre-opening of the ribs.

Other features and advantages of the present invention will become clear from the following description of particular embodiments, made with reference to the accompanying figures in which:

FIGS. 6 to 9 show the construction of an offset support in accordance with the invention in this first embodiment, the support being shown in different successive phases during opening out of the umbrella;

FIGS. 13 to 16 illustrate, in several successive positions during opening out, the means for locking the central mast cut off at the end of the radial arm;

FIGS. 17 to 19 illustrate one embodiment in which the frame of the umbrella is provided with an automatic or assisted opening device;

FIGS. 20 to 22 illustrate, in several positions, one embodiment in which the hubs of the frame are connected together by a telescopic mast;

FIGS. 29 to 33 show another embodiment in which the counter ribs comprise springs for assisting opening;

FIGS. 34 to 37 illustrate one embodiment in which the radial arm pivots and slides on the fixed support so as to hold the head of the umbrella upwardly directed;

FIGS. 43 to 49 illustrate one embodiment in which the radial arm is hinged to the fixed stand by means of an intermediate link for reducing the height of the assembly in the folded up position;

Figure 59:
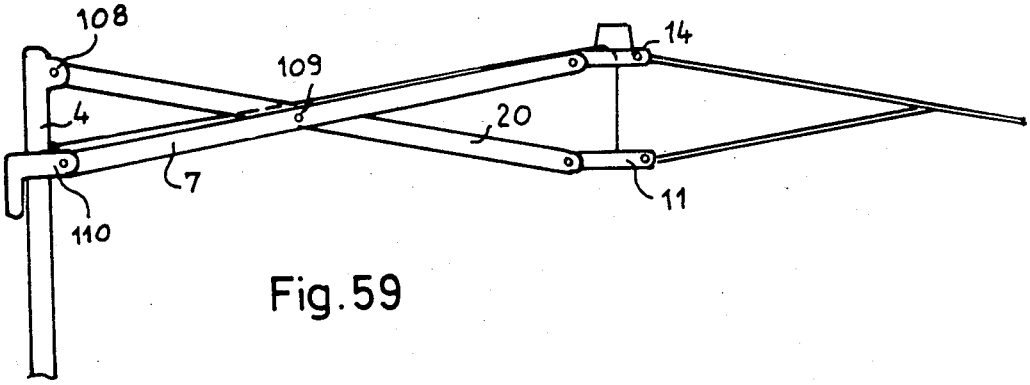
Figure 60:
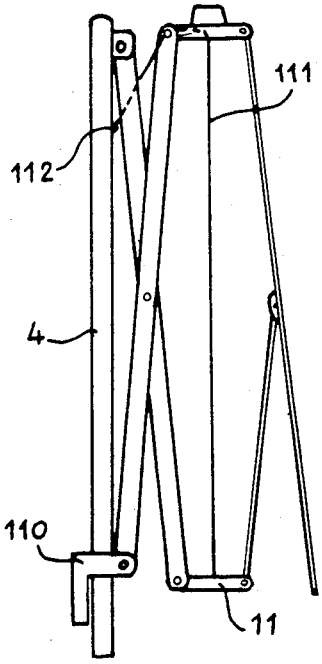
Figure 61:
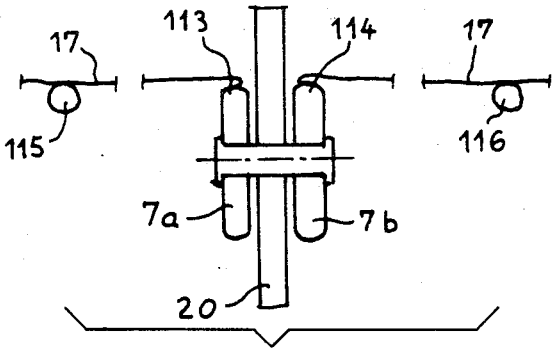
Figure 88:
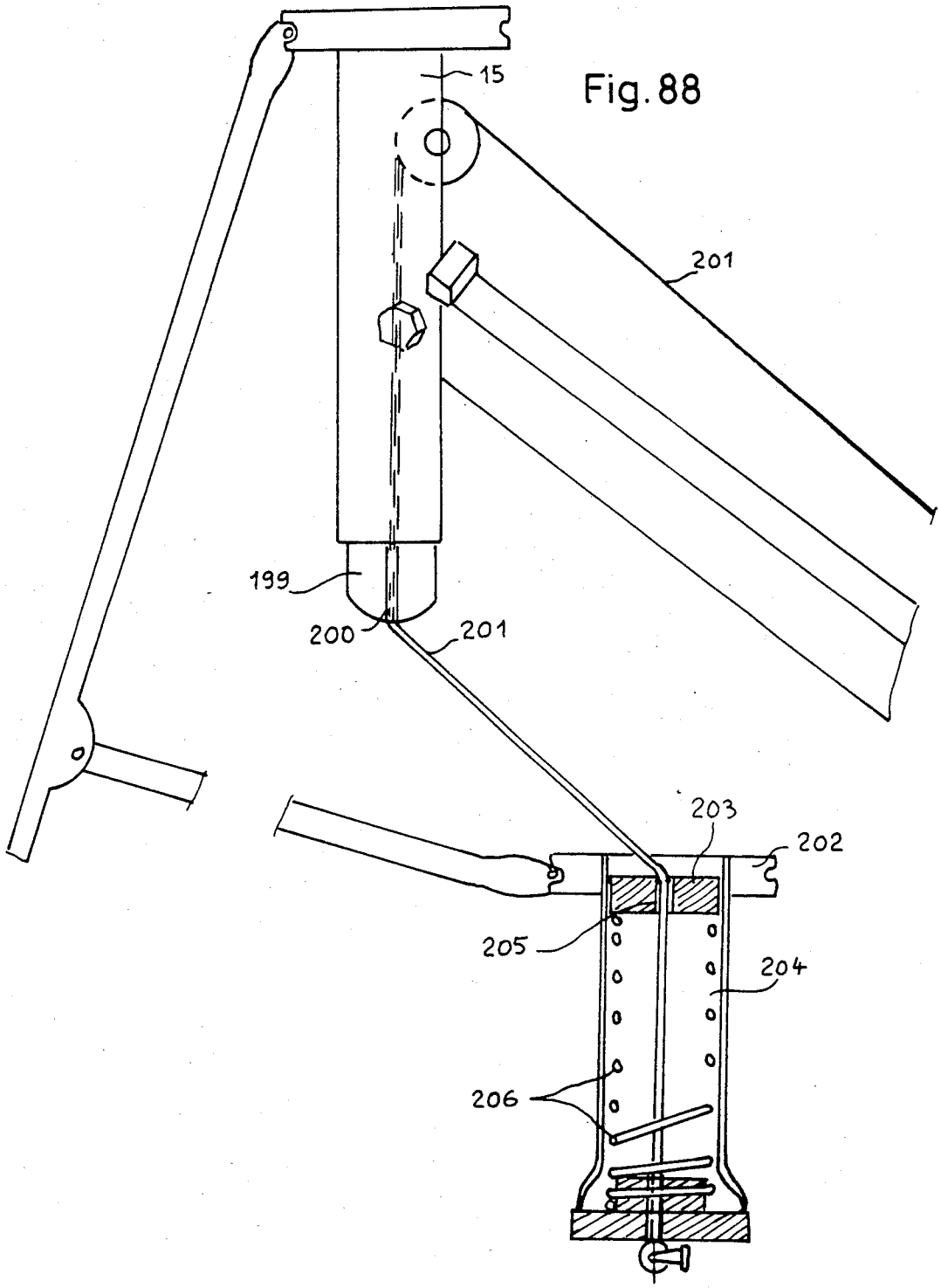
Figure 90:
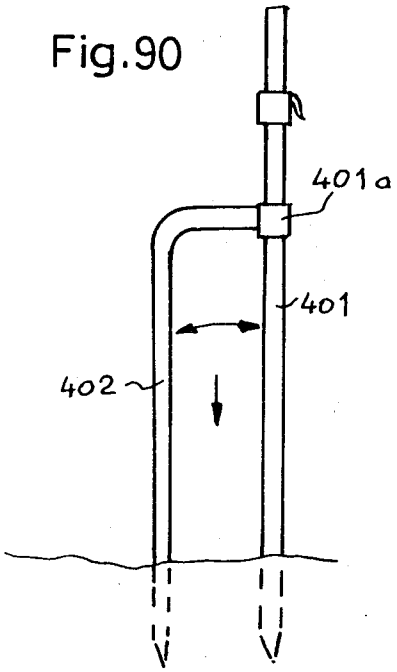
Figure 89:
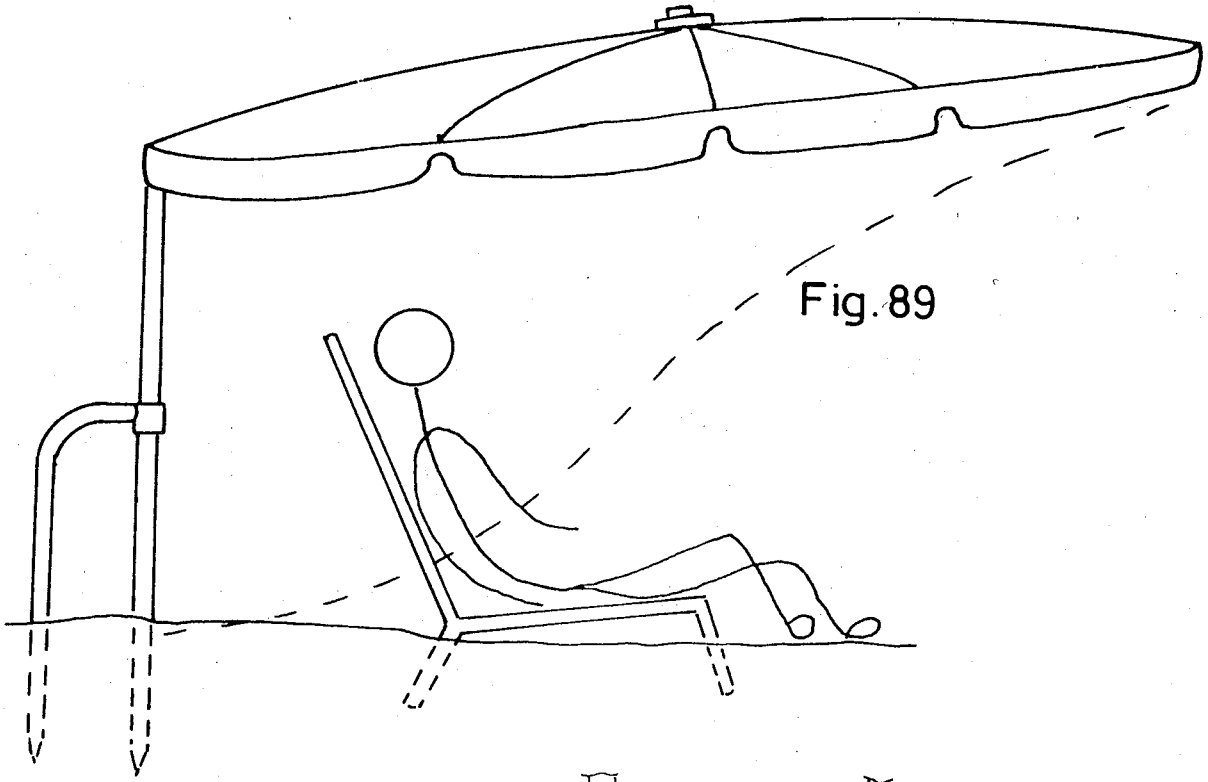
Figure 112:
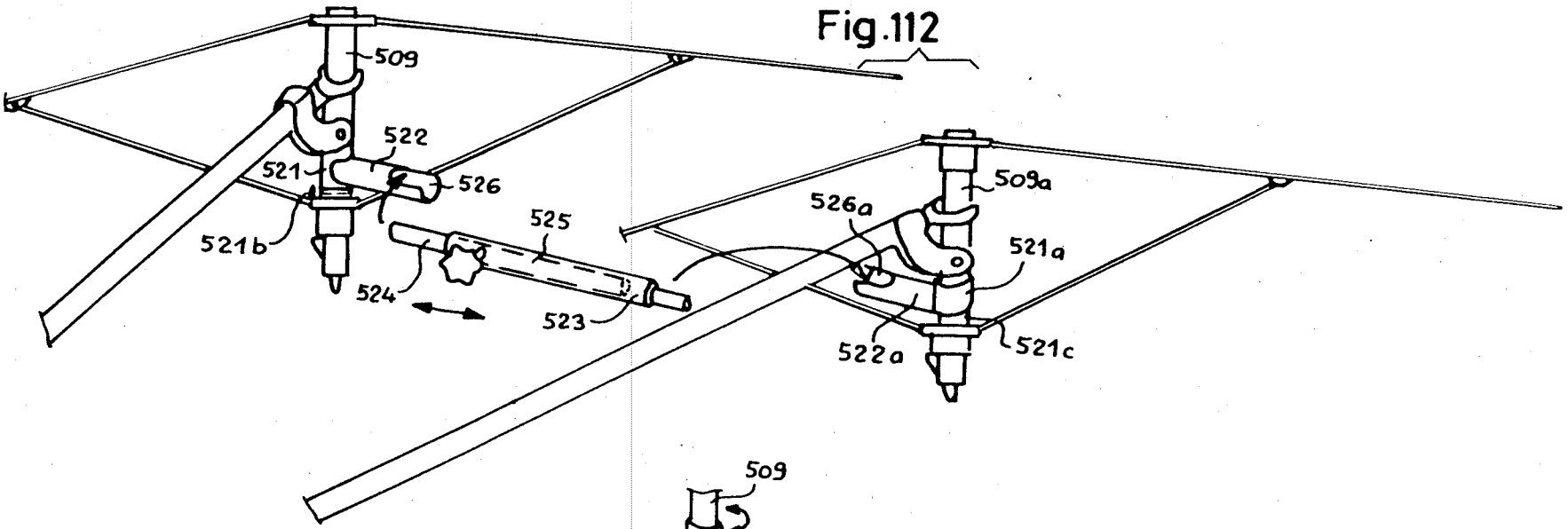
Figure 113:
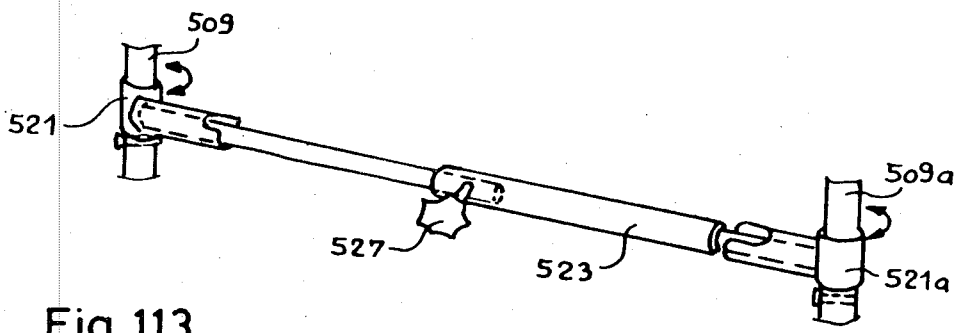
Figure 115:
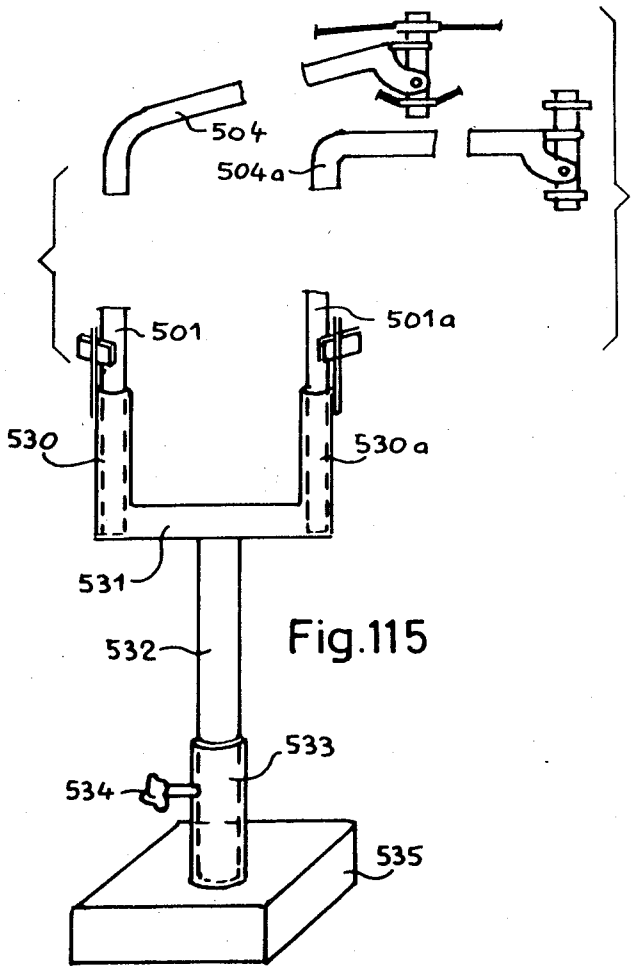
Figure 114:
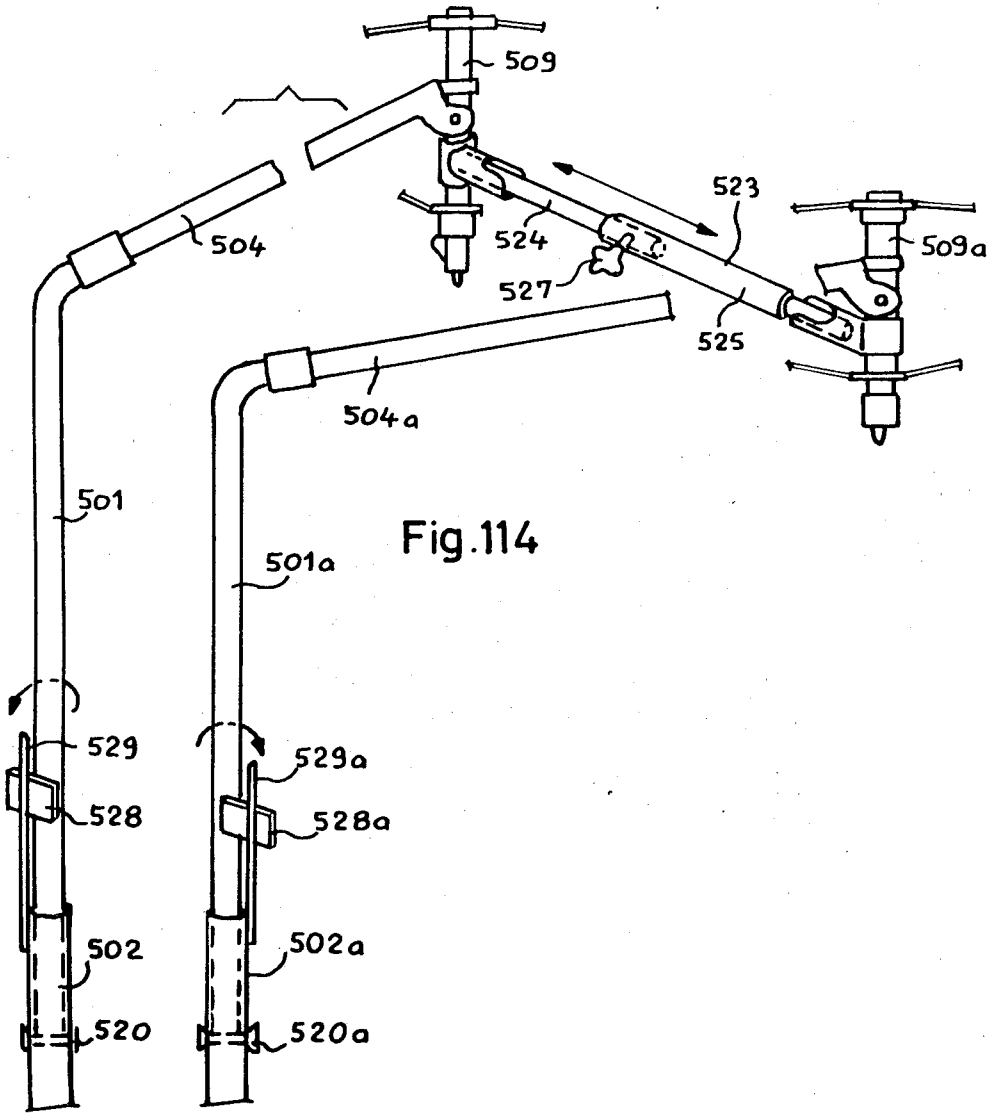
Figure 135:
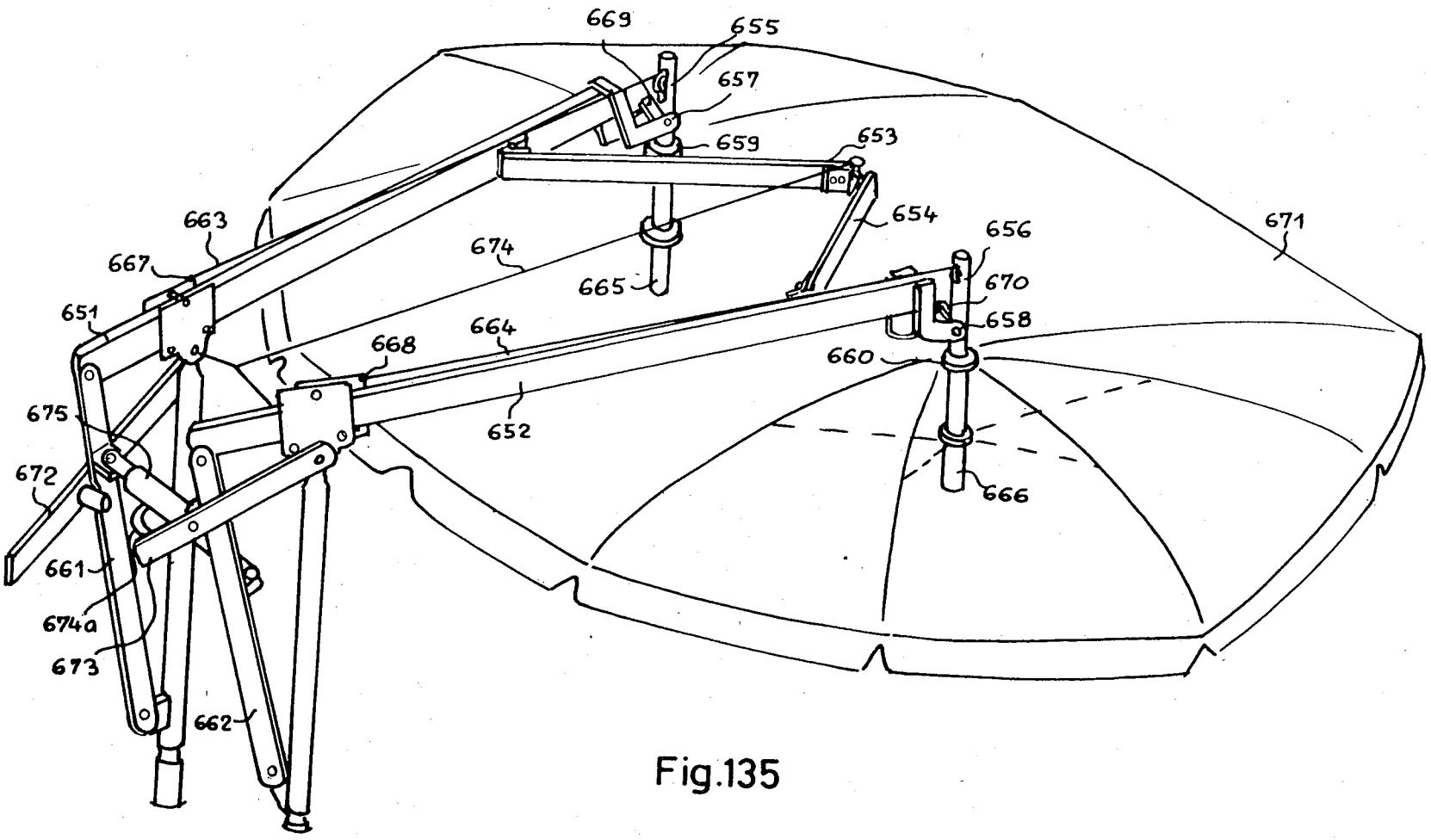
Figure 136:
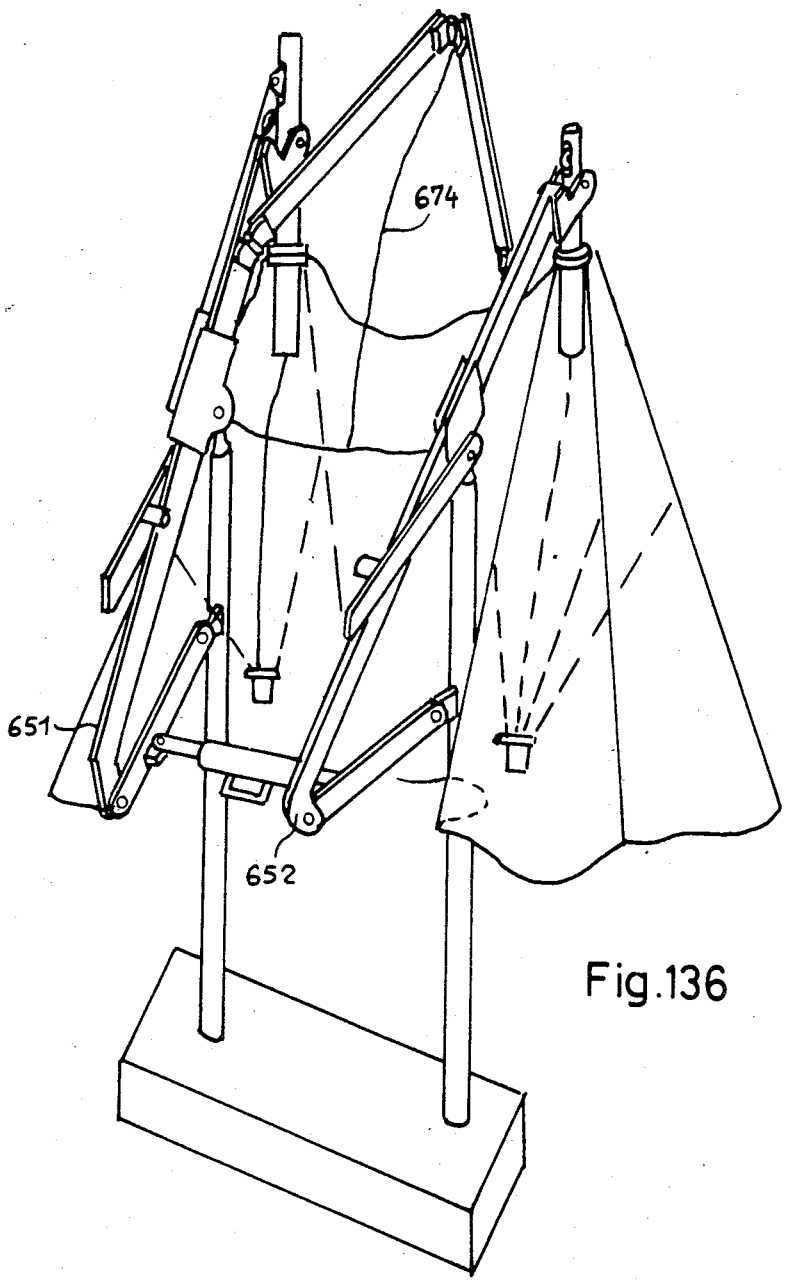
Figure 137:
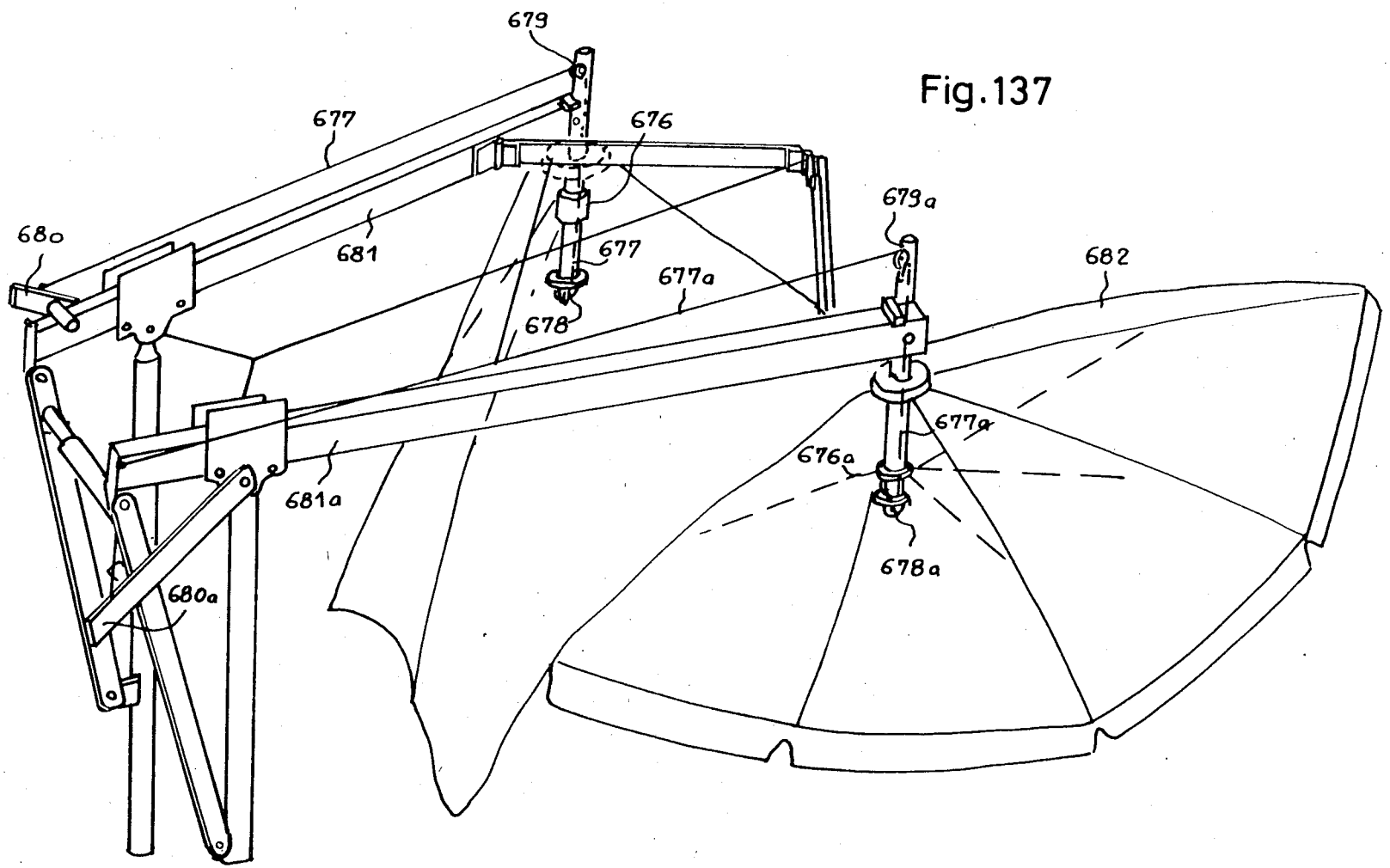
Figure 138:
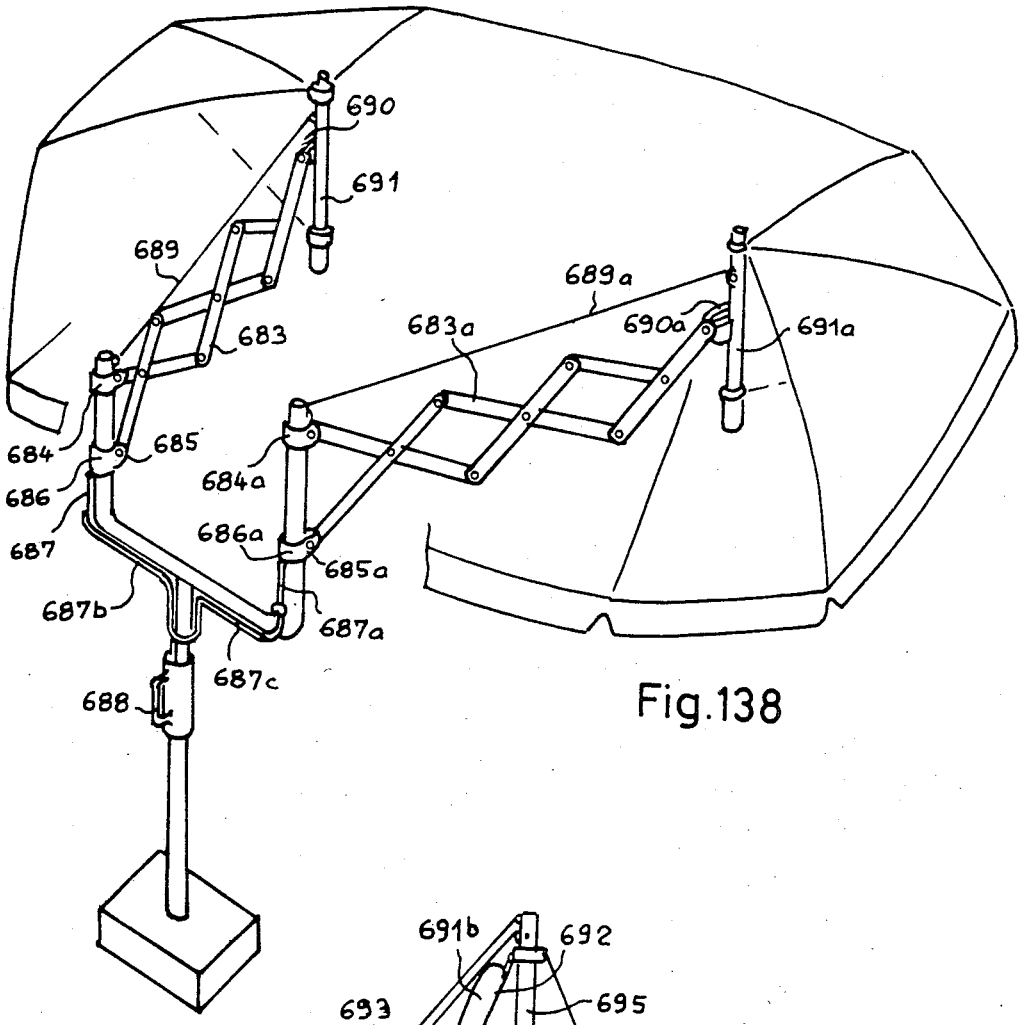
Figure 139:
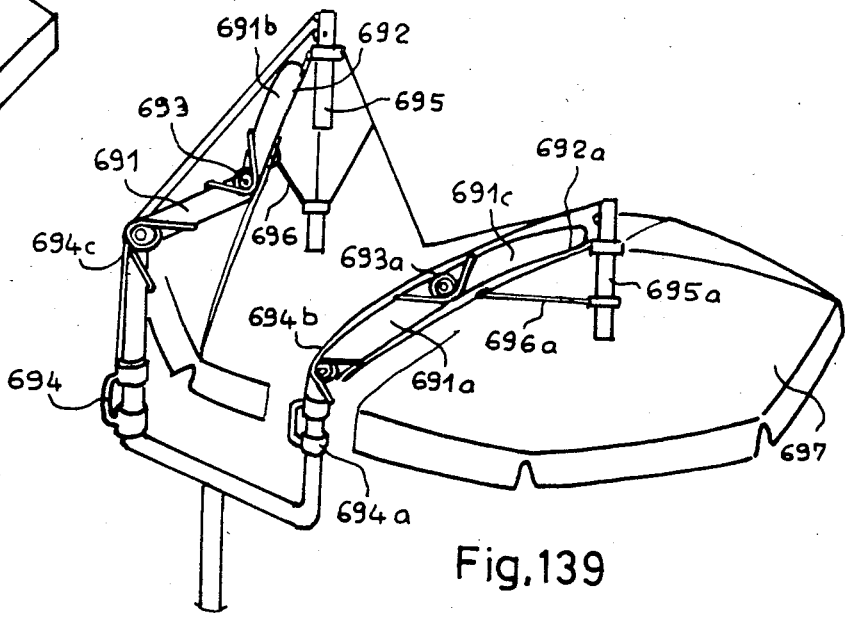
Figure 140:
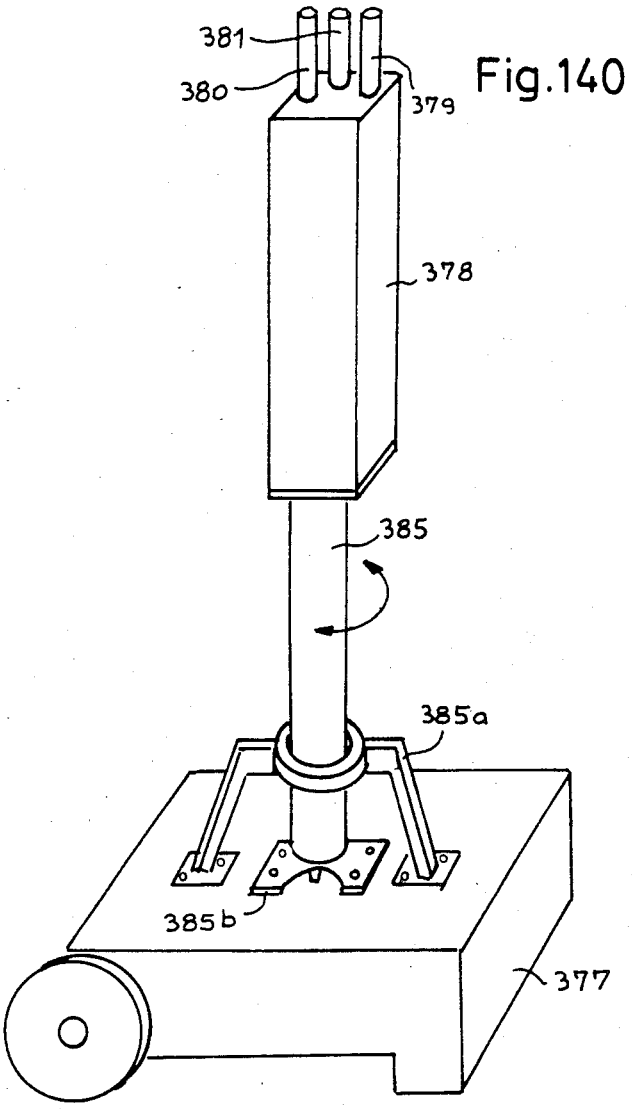
Figure 141:
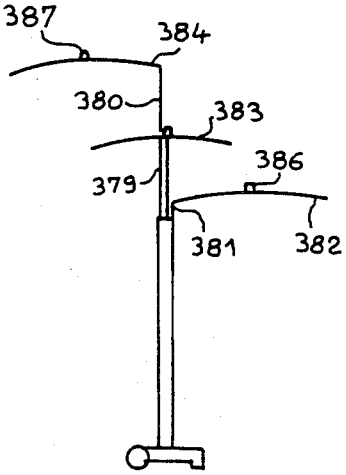
Figure 142:
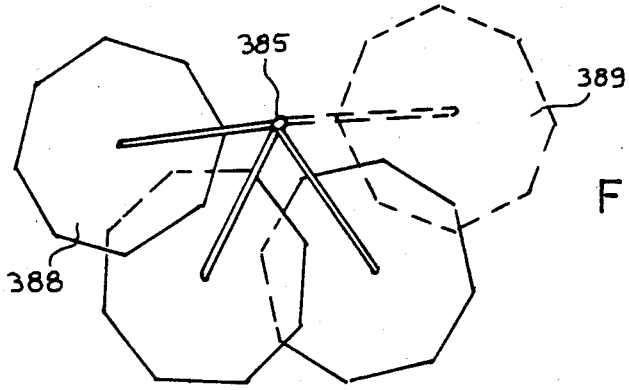

In the embodiment shown in FIGS. 50 to 53, the pivoting and sliding radial arm is associated with a short travel frame movement;

FIGS. 54 to 58 show one embodiment in which the radial arm comprises several hinged segments;

FIGS. 59 to 61 show a radial arm with a strut;

FIGS. 62 to 65 show means for reducing the force required during opening and opening out of the radial arm;

FIGS. 66 to 69 show one embodiment in which the fixed stand comprises telescopic elements for opening out the device without projecting rearwardly;

FIGS. 70 to 73 show a simplified embodiment for opening out the ribs simultaneously with positioning of the radial arm;

FIGS. 74 to 77 show a radial arm with struts,

FIGS. 78 to 82 show a device for adjusting the off-set of the umbrella with respect to the fixed stand by translation;

FIGS. 83 to 87 show one embodiment in which the radial arm comprises a telescopic tube;

FIG. 88 illustrates one embodiment of the means for guiding the mobile hub with respect to the fixed hub;

FIGS. 89 to 92 show the spikes for planting the fixed stand in the ground;

FIGS. 93 to 101 illustrate one embodiment in which two disjointed umbrellas are joined together on the same fixed stand by means of two radial arms with simultaneous opening out;

FIGS. 102 to 111 show, in different phases of use another embodiment for an umbrella with two partial frames;

FIGS. 112 and 113 illustrate the means for holding the two partial frames spaced apart;

FIGS. 114 and 115 show an embodiment of the means for orientating the umbrellas;

FIGS. 116 to 119 show an umbrella with partial frame and pivoting and sliding radial arms;

FIGS. 120 to 124 illustrate embodiments of the means for spreading out the partial frames;

FIGS. 131 to 134 show other embodiments of umbrellas comprising secondary arms with struts;

FIGS. 135 to 137 show one embodiment in which the frame is disposed above the cover;

FIG. 138 shows an umbrella with partial frames and with a radial arm comprising struts;

FIG. 139 shows another embodiment of umbrellas with partial frames in which the radial arms comprise several hinged segments; and FIGS. 140 to 142 illustrate an embodiment in which the fixed stand comprises means for orientating the umbrella.

Figures 1, 2, 3, 4, 5:
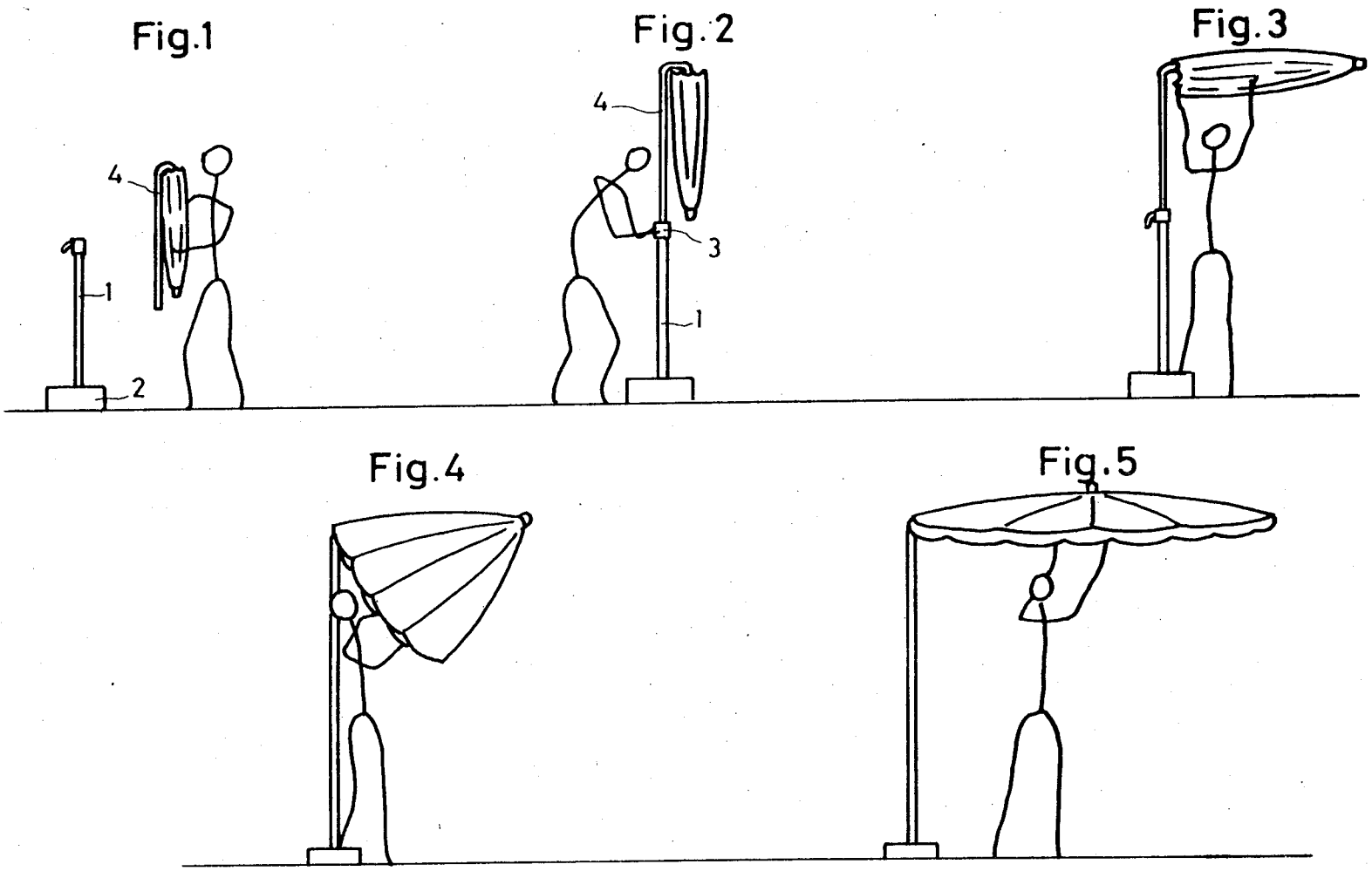
FIGS. 1 to 5 are intended to illustrate the construction of an umbrella according to a first simplified embodiment of the present invention.

In the embodiment shown in FIGS. 1 to 5, in FIG. 1 the umbrella is being brought close to the spike 1 with a downwardly turned head; this spike 1 is connected to a base 2 of known design and used for current umbrellas. In FIG. 2 the eccentric 3 connecting the mast of umbrella 4 to spike 1 is tightened. In FIG. 3, by means of a hinge, the umbrella is placed in a practically horizontal position: this is also an out of service position. The assembly of the ribs is held by an appropriate fixing means. In FIG. 4, the ribs are released and the umbrella opens partially because of its weight and thus generates a pre-opening phenomenon. In FIG. 5, all that is required is to stretch the umbrella by means of the slider as in current umbrellas.

FIGS. 6 to 9 show schematically by way of non limiting example the frame of the umbrella during the setting up thereof described with reference to FIGS. 1 to 5. To facilitate understanding of the drawing only two ribs have been shown. In FIG. 6, the umbrella is secured to spike 1 through mast 4: a hinge 5–5*a*, currently used for tilting umbrellas, and slightly modified, allows said umbrella to be folded with its head turned downwards. This hinge comprises a ring 5*a* covering the axis of rotation 5 for locking same. A bend 6 in mast 4 facilitates stowing of the frame. The cover of the umbrella is held in position by means of a strap so as to remain folded up in the smallest volume. The cover is not shown so as to facilitate clarity of the drawing.

In FIG. 7, the umbrella is brought into a practically horizontal position by means of hinge 5–5*a*. It can then be seen that the frame of the umbrella is supported by the radial arm 7 which is a tube, or any other appropriate section. The frame of the umbrella is interlocked with radial arm 7 through rib 8 by means of clips 9–9*a*–9*b*. The bundle of ribs is held in this horizontal position by means of a hook 10 integral with the lower hub 11 and fixed to chain 12 which is fixed to mast 4.

Figure 8:
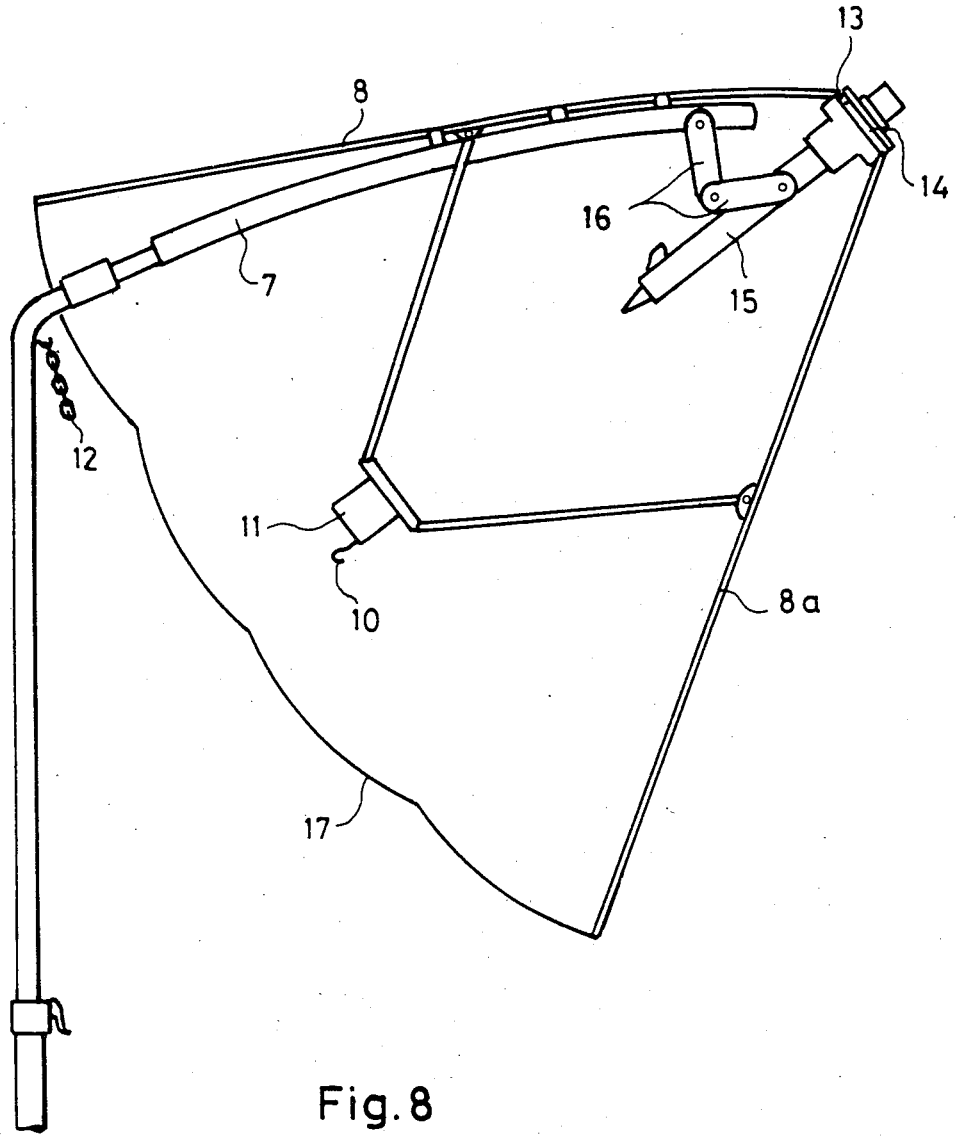

In FIG. 8, by freeing the hook 10 of chain 12, the assembly of ribs falls under the effect of their weight and takes up a conical beam position which is stabilized in this equilibrium position or pre-opening position. This is made possible by hinge 13, the junction between rib 8 and the upper hub 14. The truncated mast 15 also pivots from the head of the rib, contrary to what happens for current umbrellas, whose mast remains fixed but whose ribs move away from the central mast. Links 16 connect the radial arm 7 to the truncated mast 15 to stabilize laterally the bundle of ribs. Thus, the umbrella is hung up by rib 8 integral with radial arm 7. The umbrella has opened itself and a sort of preopening has been obtained. The user may then easily stand inside the cone formed by the ribs and completely open the umbrella.

Figure 9:
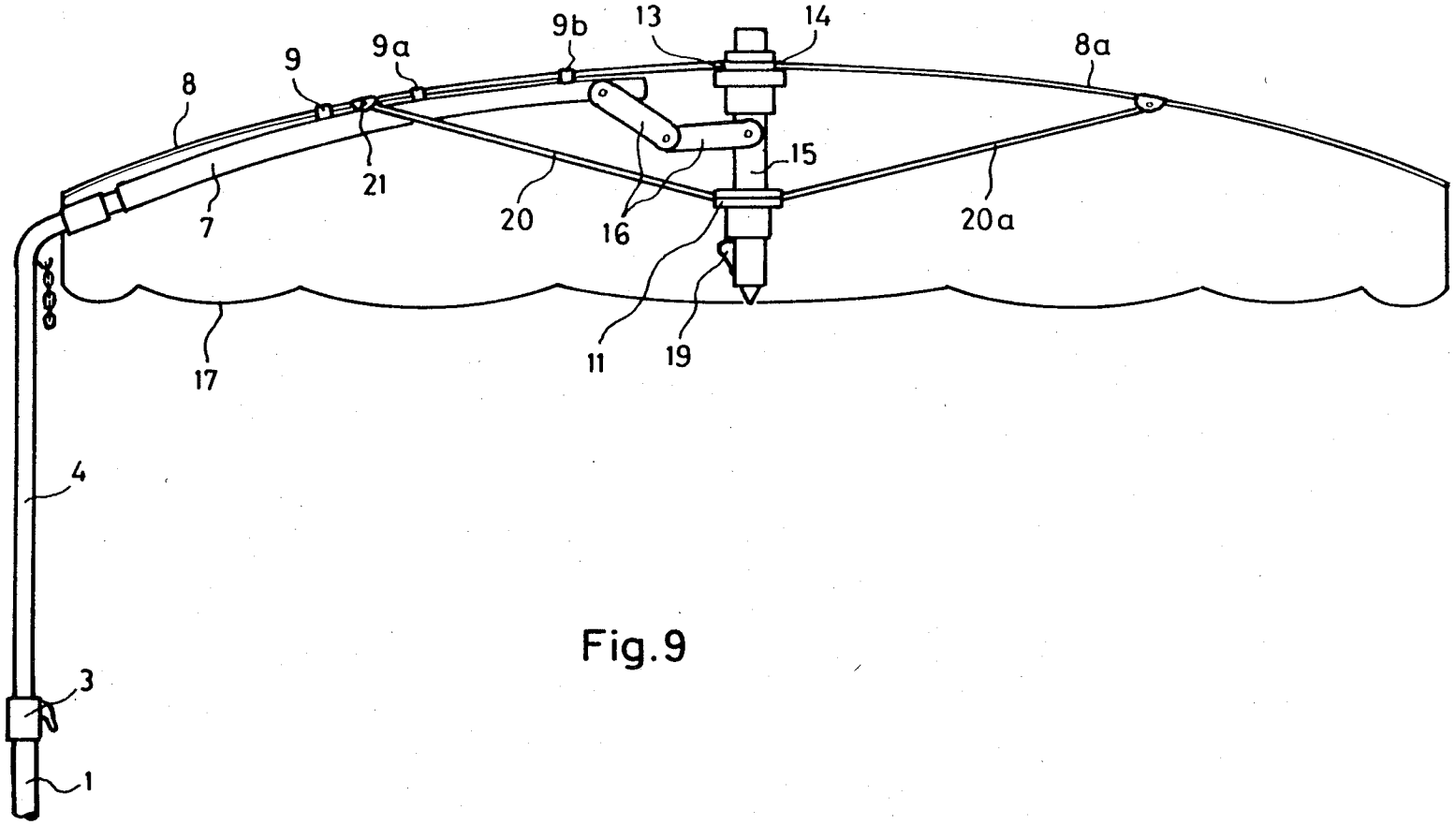

In FIG. 9, the user, after having fitted the central mast 15 into the lower hub 11, brings the two hubs close to one another so as to stretch the cover, the lower hub remaining locked by means of the appropriate spring 19. It will be noted that it is advantageous in accordance with the invention for the hinge of rib 8 and of counter rib 20 to be close to a securing clip 9 for the weight of a part of the umbrella is transferred to this point through the lower hub 11. To close the umbrella again, it is sufficient to free the lower hub 11 from spring 19. The umbrella is stabilized when it is in its intermediate equilibrium position shown in FIG. 8, which is in this case a pre-closing position; then the user connects the assembly to chain 12 and may leave his umbrella in this out of service position, or else fold it up permanently through hinge 5-5*a*.

Figure 10:
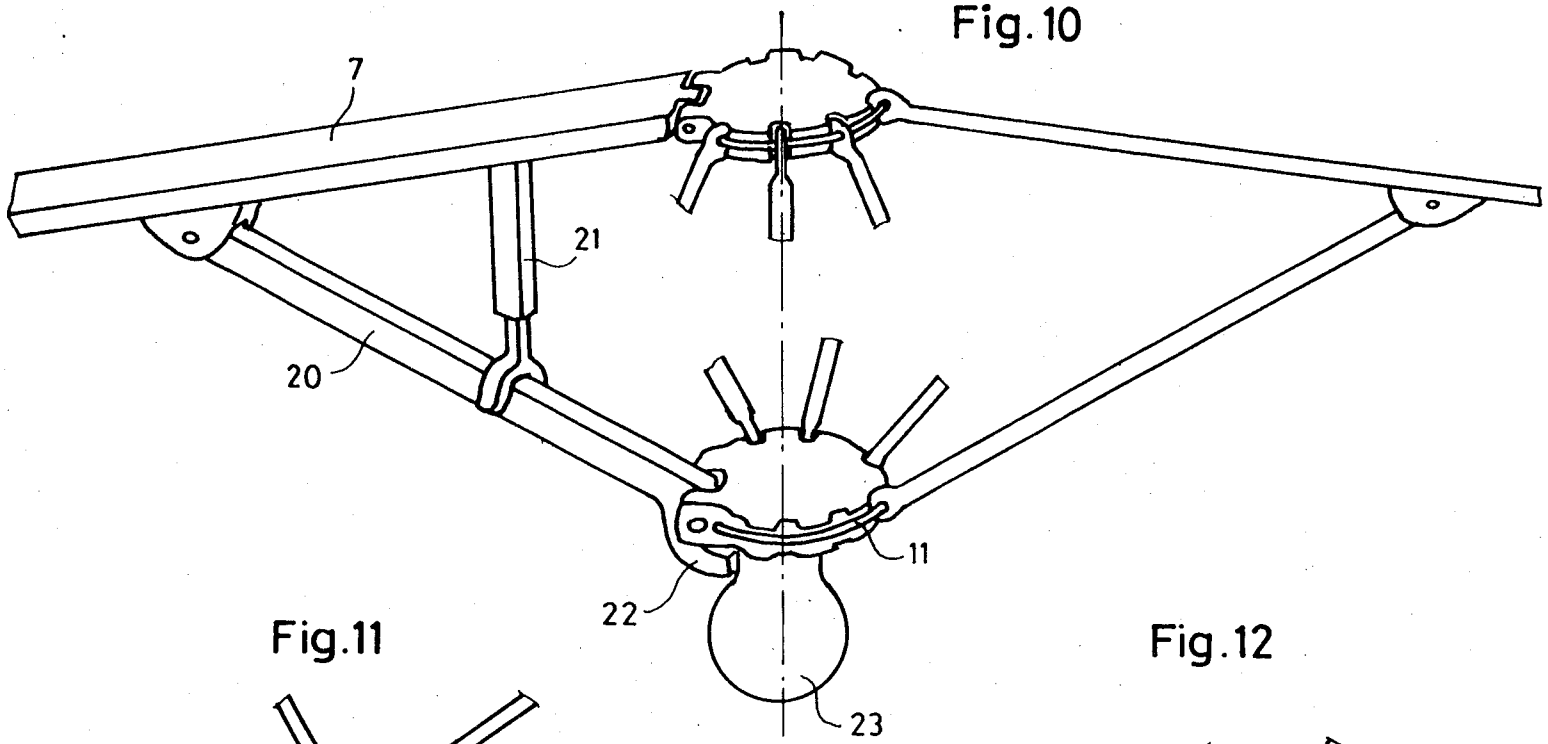
FIGS. 10 to 12 show several embodiments of the assembly of the counter ribs of the frame of the umbrella.

It is also advantageous, in accordance with the invention, for the counter rib 20 to have a larger cross section than the others because it supports a part of the weight of the frame assembly, so as to serve as sole connection between the lower hub 11 and the radial arm 7. Thus, such a strengthened counter rib 20 has been shown in FIG. 10. This figure further illustrates a different embodiment in which the central mast 15 has been omitted: the counter rib 20 tensions the frame assembly through a system of clips 21. A nose 21 integral with the counter rib 20 assists the correct positioning of the lower hub 11 which would tend to skew because of the opposing action of the counter ribs. A handle 23 integral with the lower hub will help the user in his operations.

Figure 12:
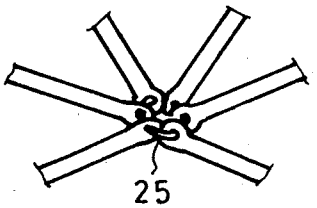
Figure 11:
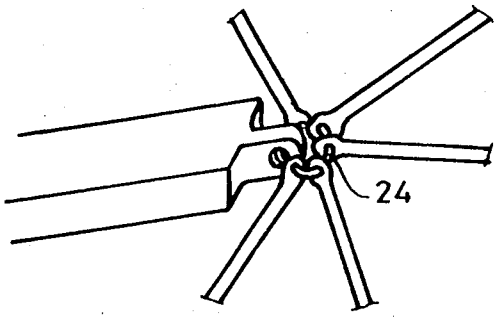

Furthermore, as shown in FIGS. 11 and 12, there also exists a possibility for obtaining the effect provided in accordance with the invention by virtually doing away with the upper and lower hubs, by connecting the heads of the ribs together by means of a wire 24 and the heads of the counter ribs together by means of a wire 25.

In the embodiment shown in FIGS. 13 to 16, the radial arm 7 and the nearest rib 8 are no longer integral with each other but independent. The arm is interlocked with the truncated mast 15 by means of a piece 26, shown in FIG. 13, comprising two bent legs 27 and 28 allowing operation of the cut mast 15 in accordance with known processes: the assembly is hinged by a pin 29.

FIG. 14 shows the umbrella folded horizontally along the radial arm 7, the frame of the umbrella being held in this position by the previously described means. When the bundle of ribs is released, the umbrella maintains its equilibrium position shown in FIG. 15, and the cover 17 which connects the ribs together momentarily holds the upper rib 8 against the radial arm 7. Mast 15 is tilted, the assembly forming a conical beam, giving ready access to the user inside the umbrella. All that is then required is to lock mast 15 in its final vertical position by means of a clip 30, shown in FIGS. 13 and 16, this clip being secured to the radial arm 7 by means of a screw 31.

FIG. 16 shows the umbrella open and held in this position by securing mast 15 in clip 30, and by the action of spring 19 on the lower hub 11. Securing of mast 15 to clip 30 may moreover take place before introducing the lower hub 11 into mast 15.

In the embodiment shown in FIGS. 17 to 19, the umbrella comprises an upper hub 14 integral with a cut mast 15 and two lower hubs, so as to obtain automatic opening. As shown in detail in FIG. 18, a first lower hub 11 is integral with a tube 32; a second hub 11*a* slides on tube 32. The movement between the two hubs is created by a compression spring 33 surrounding tube 32. Now, since the counter ribs 34 and 35, 34*a* and 35*a* are secured respectively to hubs 11 and 11*a* as shown in the figure, under the action of the spring the two lower hubs are moved apart which causes the counter ribs to move apart. Moreover, since hinge 36 is fixed to the radial arm 7, shown in FIG. 17, there occurs simultaneously a thrust from the cut off mast 15 and opening of the ribs of the umbrella. To facilitate introduction of mast 15 into tube 32, a nose 37 is provided at the entrance to this tube.

FIG. 19 shows the umbrella open, mast 15 is then introduced into tube 32 and the two lower hubs have reached their endmost position with respect to each other. A stop 38 fixed on mast 15 limits the travel of the two hubs. For closing, it is sufficient to bring the lower hub 11*a* manually, or by any other appropriate means, against the vertical mast 4. Spring 33 is then tensioned and the two lower hubs are lowered.

In the embodiment shown in FIGS. 20 to 22, the upper 14 and lower 11 hubs are connected together by a system of telescopic tubes 39. FIG. 20 shows the umbrella in its horizontal out of service position; FIG. 21 shows the umbrella in a position of equilibrium or pre-opening, after release of the lower hub 11. FIG. 22 shows the umbrella in the open position. The telescopic assembly has been closed so as to obtain a very short mast in accordance with the invention. A spring 40, secured to the narrowest part of the telescopic assembly, after passing into the lower hub 11, snaps into position and holds the telescopic mast in its vertical and fixed position and so the frame in its open position. To close the umbrella it is sufficient to pull the lower hub 11 so as to cause the spring to move back into the tube system.

Figure 23:
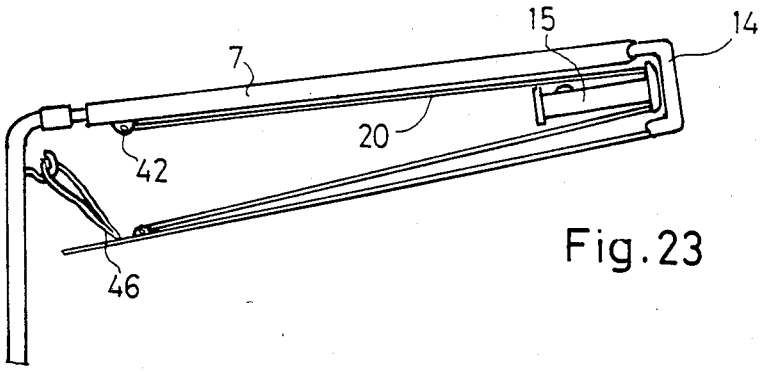
FIGS. 23 to 25 show an umbrella whose mobile hub has a short travel and in which a rib also serves as radial arm.
Figure 24:
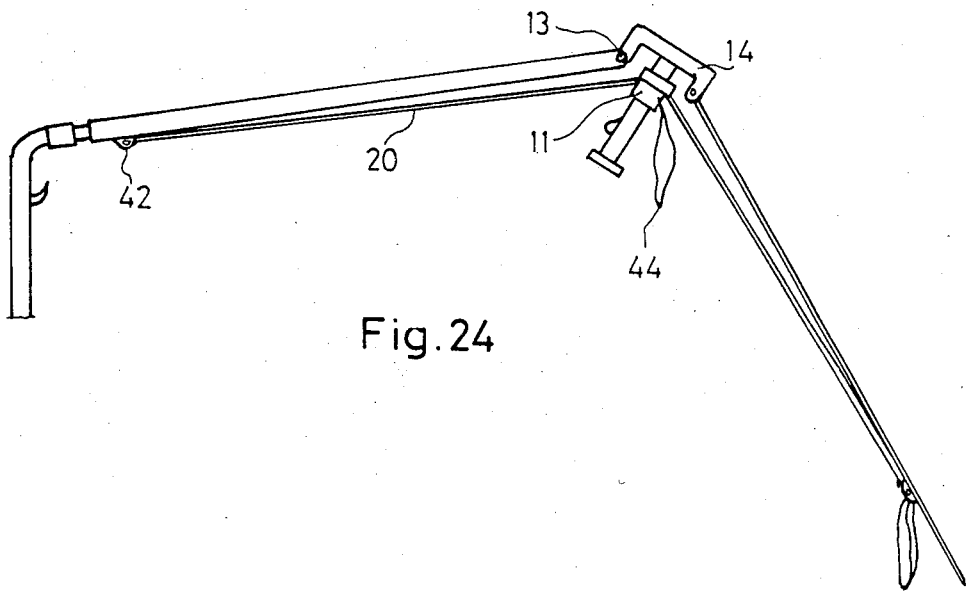

In accordance with certain variations of the invention umbrella frames are used in which the relative movement of the lower and upper hubs is very short. In particular, FIGS. 23 to 26 show one embodiment in which the lower hub 11 travels a short distance with respect to the upper hub. FIG. 23 shows the umbrella in its out of service position folded against the radial arm 7. A cut mast 15 is secured to an upper hub 14 of known shape, having a cavity 41 shown in FIG. 26. The lower hub 11 is housed in this cavity. The counter rib 20 is fixed at 42 to the radial arm 7 and at 43 to the lower hub 11. The upper hub 14 is hinged to the radial arm 7 through hinge 13. The counter rib 20 is provided longer than the part 42–13 of the radial arm. When the ribs are released, the assembly takes up the shape of conical beam as shown in FIG. 24. The user may then easily reach the flexible handle 44 fixed to the lower hub 11, and pull the handle. The counter ribs then move away from the ribs and thus open the umbrella. Simultaneously, the upper hub 14 pivots on hinge 13. An appropriate spring 19 locks the lower hub, after being retracted when the hub passes thereover. A stop 45 prevents the lower hub from leaving the mast.

For closing the umbrella, it is sufficient to press spring 19 while simultaneously pushing the lower hub on mast 15. The bundle of ribs folds up against the radial arm and remains held in the rest position by means of a loop 46.

Figure 27:
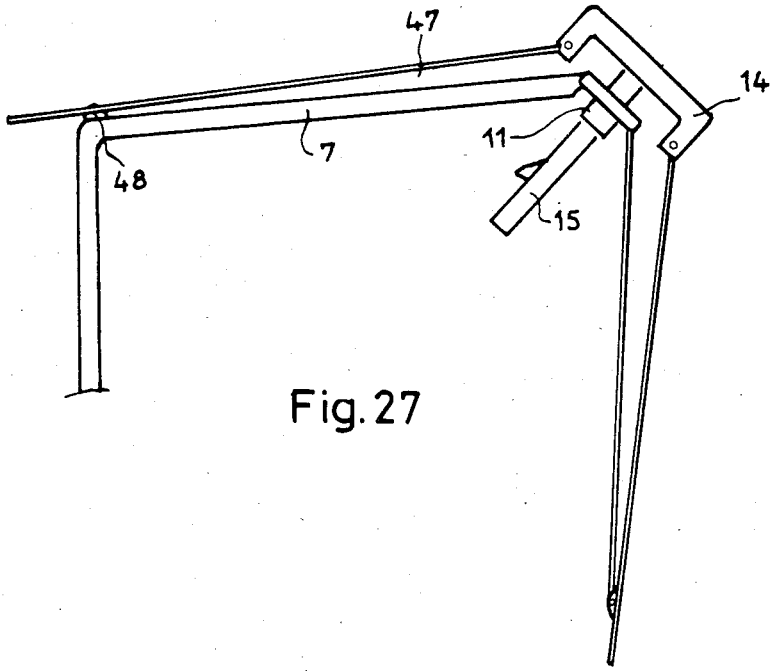
Figure 28:
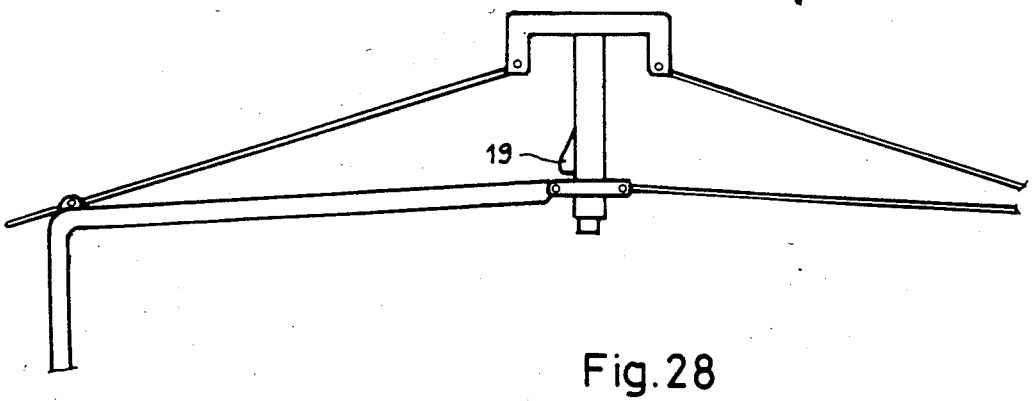
Figure 38:
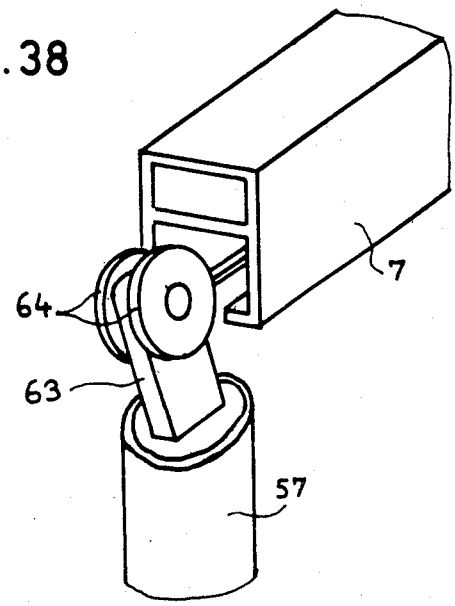
FIGS. 38 to 42 show one embodiment of the junction between the radial arm and the fixed support.

In the embodiment shown in FIGS. 27 and 28, the radial arm serves as counter rib for the frame, the lower hub 11 being hinged at the end of the radial arm 7. The upper rib 47 is connected to the radial arm in the vicinity of its end 48. The upper hub is integral with a cut mast which slides in the lower hub 11. FIG. 27 shows the device in the pre-open position, and FIG. 28 shows it in the open position.

FIGS. 29 to 33 show one embodiment relating to a modification of the counter ribs. FIG. 29 shows a closed frame. FIG. 30 shows this umbrella frame adapted on a radial arm 7. FIG. 31 shows, in an enlarged view, the frame in the closed position. Each counter rib is made from two unequal parts 49 and 50, connected together by current hinges, in particular here by means of a torsion spring 51. The purpose of each spring is to facilitate opening of these two parts so as to make them rectilinear, that is to say that parts 49 and 50 form substantially an extension of each other in the open position shown in FIG. 30. The counter rib 49–50 connecting together the lower hub and the radial arm may be fixed to the radial arm as described in the preceding embodiments. However, it is advantageous to form this hingeing together of the counter ribs with the ribs by means of torsion springs 52 as shown in FIGS. 32 and 33. Thus, counter rib 49–50, when opening, pushes the corresponding rib and contributes to completely opening the umbrella.

For the closing operation, each rib comprises a part 53, shown in FIG. 32, to the end of which is fixed a cable 54. All the cables are connected by a coupling point to a cable 55 which serves as straining cable for closing the ribs. The upper and lower hubs are connected together by a hollow tube or cut mast 15, a change of direction pulley returning cable 55 to the radial arm and the user. To assist opening out of the cut mast 15 comprising the two hubs, it is advantageous, in accordance with the invention, to add a torsion spring 56, shown in FIG. 30, which facilitates opening; this spring is however not shown in the other figures for the sake of clarity of the drawing.

In the preceding embodiments, folding up of the umbrella takes place along a substantially horizontal radial arm, which is connected to a vertical mast offset to the periphery of the umbrella. But the out of use positions of the umbrella are either horizontal or with the head turned downwards, and manual operation must be carried out for use of the umbrella.

According to the following embodiments, these manual operations are reduced so as to obtain, from simple operations external to the umbrella, opening and closing without having to handle any slider or any other means for acting on the ribs. Opening and closing are facilitated by using the weight of the umbrella itself to obtain pre-opening. According to the invention, two substantially opposite movements are created simultaneously, one for opening out the radial arm from a vertical out of use position to a radial horizontal position and the other simultaneous movement for opening the ribs and tensioning same. A feature of the invention is to use these opposite reactions, one of the weight of the frame assembly which, swinging on an offset mast creates a considerable weight, the other reaction being the opening of the counter ribs opposing the weight of the radial arm-rib and cover assembly.

Figure 39:
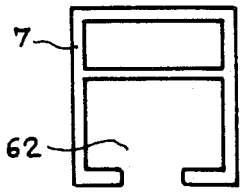

One embodiment showing such an operation is shown in FIGS. 34 to 42. On spike 1, for example integral with a base, there is fitted by clamping cam 56*a* a hinge system comprising an intermediate vertical mast 57 to which are connected two link arms 59–60 by a common pin 58. The other end of links 59–60 is connected by pin 61 to the radial arm 7 of the umbrella. FIG. 37 shows the right-hand end of the links connected by shaft 58 to the mast and the left-hand end connected to support 7 by shaft 61. Radial arm 7, in this embodiment, comprises a cavity 62 as shown in FIG. 39. In this cavity slides a special piece 63, shown in FIGS. 38 to 42. This piece plays two roles for the radial arm 7, by allowing it to roll and pivot at the same time. Piece 63 comprises rollers 64 mounted on the end of the mast 57, and shaped to be introduced into cavity 62.

Figure 40:
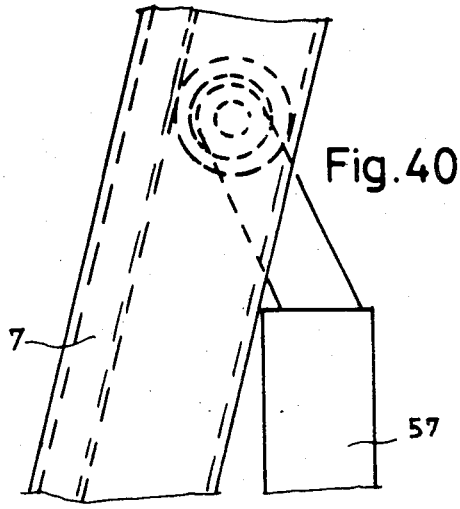
Figure 41:
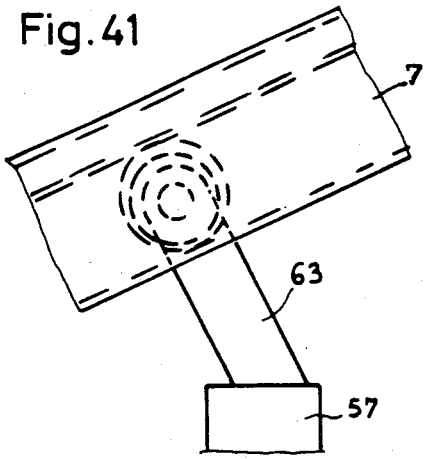
Figure 42:
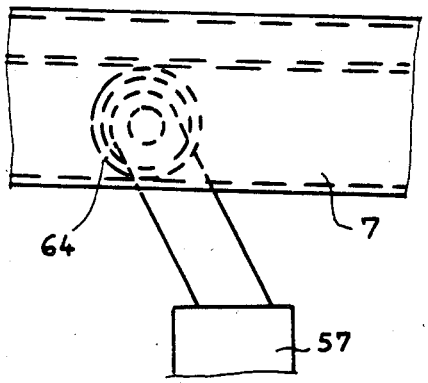

FIG. 40 shows the radial arm 7 in the out of use vertical position; FIG. 41 shows the same arm in an intermediate position and FIG. 42 shows it in a horizontal position. Thus it can be seen that rollers 64 allow passage of support 7 and a change of orientation thereof, by passing from the vertical position to the horizontal position. By raising hinge 61 with strap 66, the radial arm 7 is caused to swing which remains in abutment on mast 57 through piecee 63.

As shown in FIG. 35, a cable 67 is secured to mast 57 by the fixing means 68, and to the mobile hub 11. It is returned by pulley 69 of the lower hub to the fixed point 68 of the mast. The cable pulls on the lower hub simultaneously with the advance of the radial arm until the ribs are completely opened. The lower hub 11 fits on to the cut mast 15 at the end of its movement. Tensioning of the cover is obtained by forcing links 59–60 so as to secure them to mast 57 by a clip 71. The cut mast 15 is hinged to the radial arm 7 by a fork joint 26 and a transverse rotation pin disposed below pulley 69. A stop 70 limits the swinging of the mast (FIG. 36). The counter rib 20 may be omitted; rib 8, integral with the cover, is rounded because of the other ribs which stretch the cover.

The radial arm slides on the rollers and, since the cable is of fixed length, the cut mast 15 moves away from the fixing point 68; when the lower hub 11 is fitted into mast 15, since the cable is not long enough, tension is then exerted from the links. That allows tensioning of the cover, not shown in the figures. The fixing points for the change of direction pulley 69 of the cable will be adapted so that the distances "1" and "1*a*" in FIGS. 34 and 36 are substantially equal. In fact, the free movement of the slider or lower hub characterized by the part "1" increased by the free movement produced by rotation of mast 15 on the fork joint, must be found at "1*a*". For closing the umbrella, it is sufficient to pull handle 66, which releases links 59 and 60 and, under the effect of its weight, the frame will fold up by itself since the cable frees the lower hub.

FIGS. 43 to 46 illustrate another embodiment using hinged counter ribs. To the radial arm 7 of the frame of the umbrella is hinged the lower hub 14. A cut mast 15 of a fixed length connects together the two hubs 11 and 14. The device comprises a hinged mast having a fixed part 72 and a tubular part 73 hinged together by pin 74. The hinged relation between arm 7 and tubular part 73 is provided by a transverse pin 75. In this embodiment, the radial arm has no bearing point in its upper part. To assist raising thereof, a traction spring 76, shown in FIG. 44, is installed in the mobile tube 73 and connected by a cable 77 to the mobile arm 7 at a point 78, as shown in the figure. The cable passes over the hinge pin 75 and thus exerts a tension opening the two parts. For opening, a downward movement is exerted on the flexible handle 79, which movement is facilitated by the action of the spring. The hinged counter ribs, such as counter rib 80, are hinged as for the embodiment shown in FIG. 31 by means of springs which cause opening thereof. The final open position shown in FIG. 45 is stabilized by means of a hand lever 81 whose upper end comprises a cavity 82 for clipping on to a ball 83 integral with the radial arm 7. This hand lever is fixed to arm 73 and comprises a double branch, as shown in FIG. 46, so that the cavity 82 to be clipped is in the axis of support 7. To stabilize simultaneously mast 72 with the tubular part 73, a clip 85 is fitted on to rod 84 extending mast 72 for receiving tubular part 73 in the vertical position.

To close the umbrella again, the user pulls the flexible handle 79, freeing the tubular part 73 of clip 85 and, while holding the handle, frees by means of the hand lever 81 the radial arm 7 and arm 73 parts; spring 76 exerts a retaining force for folding up the umbrella. Moreover, the return of the counter rib 80 is provided by cable 86 shown in FIG. 45. This cable is connected to the ribs by intermediate cables 87, as shown in the figure. Cable 86 is connected to the mast at 88. The simultaneous return of the ribs, with closure of the umbrella, is provided by the position of points 88 on rod 84. Since the cable is of constant length, by continuing to pull the flexible handle 79, the umbrella is closed again. The position of the change of direction pulley 89 allows the simultaneous adjustment of the positioning of the radial arm with operation of the ribs.

Figure 47:
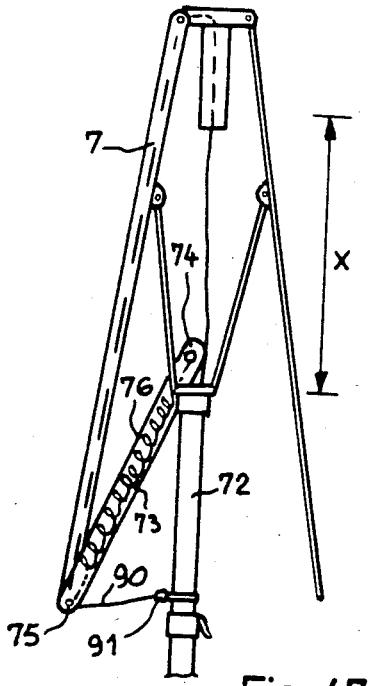
Figure 48:
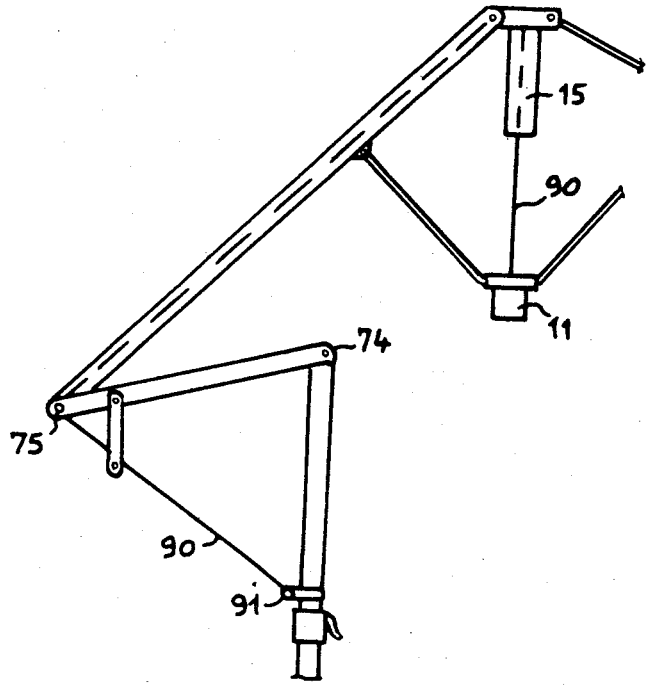
Figure 49:
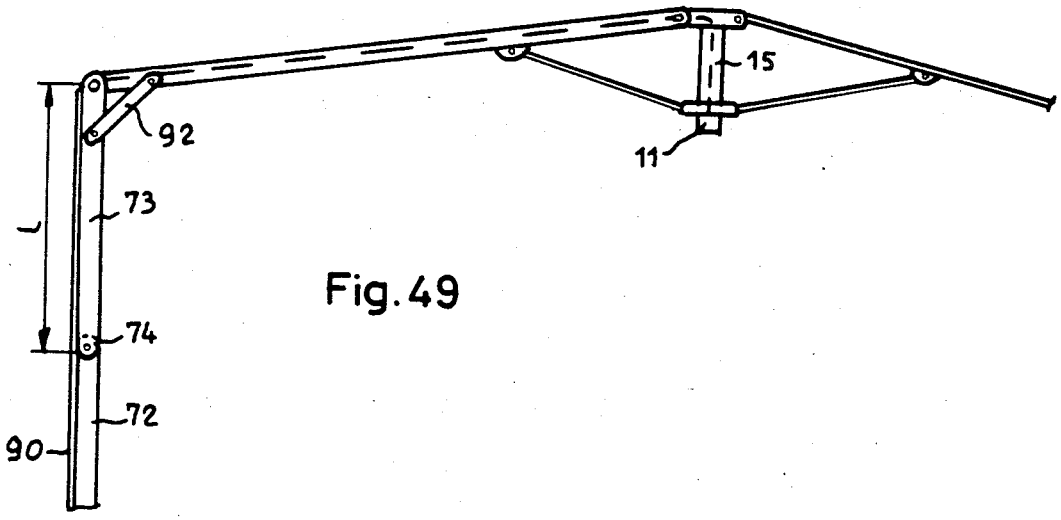

According to a particular embodiment of the invention there is fitted to a radial arm a frame of a current type, as shown in FIGS. 47 to 49. As in the preceding embodiment, a spring 76 is housed in a hinged tube 73 for facilitating the opening operations of the radial arms 7 and tube 73. A cable 90 is secured to mast 72 at a point 91 and to the lower hub 11 while passing over the required change of direction pulleys as shown in the figure. The more the end moves away from point 91, the closer the lower hub comes to the cut mast 15.

FIG. 49 shows the umbrella completely open, after the lower hub 11 has been fitted into the cut mast 15. The open position will be stabilized by support 92. The hinge 74 is designed so as to remain in the alignment of mast 72. Furthermore, the lengths "x" and "l" must be equal.

Figure 25:
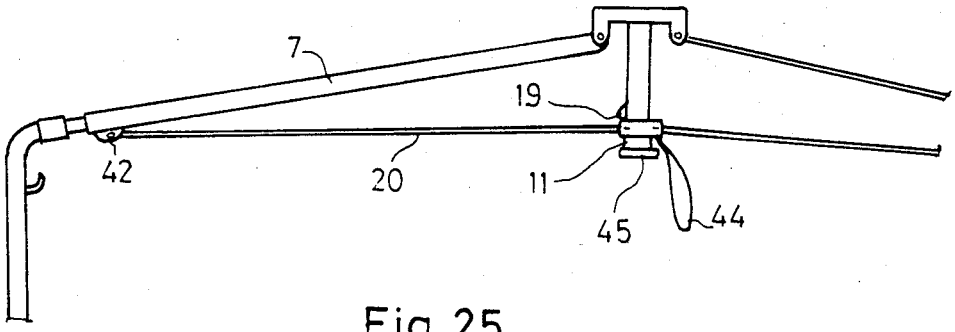
Figure 26:
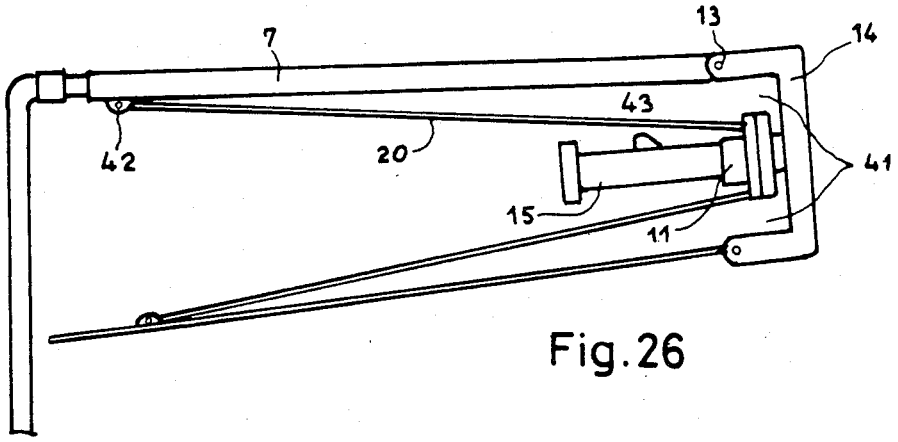
FIGS. 26 to 28 show another embodiment of short travel umbrellas in which a counter rib serves as radial arm.

According to another embodiment, the hinged mast system is fitted to a frame whose lower hub describes a short path on a truncated mast. FIGS. 50 to 53 illustrate such an embodiment: the mast system previously described in the embodiment of FIGS. 23 to 25 is used. The simultaneous movement for positioning the umbrella and opening the ribs is obtained by connecting, by means of a cable 93, lower hub 11 to a special piece 94 sliding in the radial arm 7. During passage over piece 63, piece 94 is driven and pushed back to the end of the radial arm, which results in pulling the cable and the lower hub. As shown in FIG. 53, the central cut mast 15 comprises a slit 95 for passing therethrough the fixing means 96 securing together the lower hub and the cable. This fixing means is provided so as to be able to transmit as well as possible the tension of the cable to the lower hub 11. On cable 93 is provided a traction spring 97 allowing extension thereof at the end of travel while continuing to exert a pull on the lower hub. Its force is then designed so that the cable pulls the lower hub before it is extended. A clip system 98 locks the radial arm in the opened out position.

To close the umbrella, a pull is exerted on the clip which frees the radial arm. The lower hub 11, under the effect of the weight of the ribs and of the cover is pushed upwardly of the cut mast. The angle of the ribs and of the counter ribs should not be a dead angle and should allow the lower hub 11 to slide. Spring 97 retracts and draws piece 94 to the center of the radial arm. To facilitate return of the lower hub upwardly, a compression spring 99 may be used shown in FIG. 53.

According to other embodiments of the present invention, a deformable radial arm is provided capable of being folded up. For example FIGS. 54 to 58 illustrate an embodiment in which the radial arm is placed above the fabric cover surface of the umbrella. The common part of the radial arm with a rib of the frame is limited to the part 100 the furthest away from the fixed support, the other part 101 of the radial arm being hinged to the vertical mast 4, the two parts of the radial arm being hinged together by means of a transverse pin 102. A cable 103 connects the end 104 of the radial arm to a handle 105 which slides on the vertical mast.

There is shown schematically in FIGS. 57 and 58 hinges 102 and 106 comprising torsion springs for opening thereof. For opening the umbrella, it is sufficient to push the handle 105 upwards. A second cable 107, shown in FIGS. 55 and 56, connects the vertical mast 4 to the lower hub 11 of the counter ribs, with the means used in the preceding embodiments. Handle 105, moving up the mast, frees the two parts 100 and 101 of the radial arm which opens. Simultaneously, cable 107 pulls the lower hub upwardly and the ribs open out. At the end of travel, the lower hub fits on to the cut mast 15 as in the preceding embodiments. To close the assembly it is sufficient to lower handle 105: the parts of the radial arm fold up and the frame, because of its weight, also closes.

In its development, the invention provides arrangements of the radial support and integration thereof in hinged systems.

Particularly, as shown in FIGS. 59 to 61, a giant strut may be provided formed by the radial arm 7 and by a counter rib 20 which should be extended so as to fit it by a hinge 108 to the fixed vertical mast 4. This strut thus formed is hinged at the middle at 109. The rib-radial arm 7 branch is secured at its upper part to the upper hub 14 and, at its lower part, to a handle 110 sliding on the vertical mast 4. A cable 111 connects a fixed point 112 on mast 4 to the lower hub 11 through the appropriate change of direction pulleys required as shown in the figures.

For operation, it is sufficient to slide the handle 110 on the mast for opening or closing the umbrella. In the open position, an appropriate system will lock the handle and hold the cover tensioned.

FIG. 61 shows schematically the required adaptation for the counter rib 20 to cross the surface of the cover. For that, the radial arm will be formed from two branches *7a–7b* in the middle of which the counter rib operates. Fixing of the cover 17 will be by stapling 113–114 on the edges of branches *7a–7b* forming the radial arm. The position will be noted of the adjacent ribs 115 and 116 directly connected together by the cover to branches *7a* and *7b* of the radial arm.

To improve the performance of the device, lever arms may be used for providing greater ease in operation of umbrellas of all sizes. More especially, the embodiment shown in FIGS. 62 to 65 allows such improvements: it comprises the same elements as the embodiment shown in FIGS. 34 to 37, with in addition an extension of links 59–60 on the other side of its hinge point 58 to the vertical mast. The extension thus formed allows traction spring 117 to be fitted between the end 118 of the extension and a lower fixed point 119 on the vertical mast 4. It will be noted that, in the out of service position shown in FIG. 62, the spring is substantially parallel to links 59–60 and so its action is neutralized. On the other hand, the whole force of the spring is used to a maximum when it pulls in cantilever fashion, as shown in FIG. 63, and provides better comfort for the user either for opening or for closing. Appropriate means already described will fix the umbrella in its final open position.

In FIGS. 66 to 69, the radial arm has been formed from vertical telescopic masts. FIG. 66 shows two vertical masts 305–306 fitted to a base 307; a handle 308 appropriately fitted to the two masts allows the telescopic tubes 309 and 310 to be opened out to a second position in which they are fixed by pin 311 shown in FIG. 67.

In FIG. 68 the umbrella is shown open. By the action of the flexible handle 312, the radial arm 7 is caused to swing from a vertical position such as shown in FIG. 66 to a substantially horizontal position such as shown in FIG. 68 while opening out the last part 314 of the telescopic assembly. This part is secured to the radial arm 7 by an appropriate hinge 315. The movement causes the radial arm 7 to slide on a piece 316 fitted to the end of the other part 317 of the telescopic mast 306. Piece 316 is rounded so as to allow swinging of the radial arm. FIG. 69 shows, in a section A—A of FIG. 68, piece 316 fitted into the radial arm 7. Pin 311*a* interlocks the two tubular parts 314 and 317.

As in some variations already described, positioning of the radial arm causes simultaneously opening of the umbrella by means of a cable 318 connected to the lower hub 11 and to a fixed point 320 on the vertical mast 305 while passing over appropriate change of direction pulleys. The travel distance of the lower hub "p" of FIG. 66 will be equal to or slightly less than the free movement "q" of the last part 314 of the telescopic assembly 305. To prevent the umbrella from being overturned by the effect of the wind, hinge 315 may be provided with a clamping means.

According to another embodiment, positioning of the radial arm and opening of the umbrella may be obtained simultaneously from a simple swinging movement of the radial arm on a vertical mast. FIGS. 70 to 73 show such an embodiment.

FIG. 70 shows the user who has just positioned mast 322 on the spike 323 fixed to base 324. Radial arm 7 is then extended by part 326 and the two parts are hinged by a known hinge device 327. The radial arm is secured to the vertical mast by an appropriate hinge 328.

FIG. 71 shows the beginning of the opening movement of the umbrella. The radial arm swings on hinge 328 and the user controls the downward movement under the effect of the weight of the umbrella by the extended part 326 of the support. simultaneously, a cable 329 connecting the lower hub 11 of the counter ribs to a fixed point on the mast 322, causes the frame of the umbrella to open out, as described in the preceding variations with equal lengths "r" and "s".

FIG. 72 shows the umbrella in its completely open position with the cover stretched, facilitated all the more since it is its own weight which contributes to this stretching. A stop 331 integral with mast 322 prevents the radial arm from continuing to move downwards. It is then sufficient to open hinge 327 of the two parts of the radial arm, as shown in FIG. 73, and thus to clip the extended part 326 on mast 322 by means of clip 332. Cable 329 is guided along the radial arm 7 and along the extended part, particularly by means of guides 333–333*a* on each side of hinge 327. Thus, when hinge 327 is open, the cable may be easily curved. Because of its lower position it will be subjected to a shrinkage coming from the tension exerted by the lower hub 11. But that does not adversely affect the proper behavior of the cover.

To close the umbrella, it is sufficient to slide the sliding ring 327*a* of the hinge 327 to close said hinge and obtain a radial arm extended by part 326; this part is used as a lever to bring the frame assembly back into a vertical position.

One of the advantages of the invention is the offset position of the vertical spike supporting the umbrella assembly, this supporting spike being fixedly located at the periphery of the umbrella. It is then advantageous to be able to vary the position of the vertical mast, from its offset position to a central position by means of a variable radial support. Three embodiments may thus more especially be proposed allowing these variations.

FIGS. 74 to 77 show one example of an extendable radial arm. The radial arm is formed of struts 334, here folded up. The vertical supporting mast 335 is fixed to a base not shown. FIGS. 75 to 76 show schematical top views illustrating the positioning of the struts with respect to the vertical support mast 335 with respect to central mast 15. FIG. 75 shows the assembly of struts closed and FIG. 76 shows the same assembly in an extension position of the struts. The vertical mast 335 is secured to the struts by a fixed pin 337 and by a sliding pin 339. Similarly, the cut mast 15 is secured to the struts by a fixed pin 338 and a sliding pin 340.

Thus, the user opens the frame of the umbrella according to the known procedures for fitting the lower hub 11 on to the cut mast 15 then, depending on his needs, he moves cut mast 15 with respect to the vertical support mast by opening the struts. To the strut assembly may be added a counterweight 342, shown in FIG. 77, moving away from the offset mast at the same time as the cut mast so as to oppose the weight of the umbrella and thus counterbalance the assembly.

FIGS. 78 and 82 show another embodiment in which the radial arm 7 is secured to the vertical mast 353 by a piece 354. This piece 354 is hinged and fixed to the vertical mast 353 by a pin 355 shown in FIG. 79. This pin also serves as means for clamping piece 354 to mast 353. Thus a possibility is obtained of orientating the radial arm 7 with respect to the vertical mast 353.

Furthermore, piece 354 and the radial arm 7 are secured together by means of a male-female assembly shown in FIG. 79. The radial arm may slide on the male part 356 of piece 354 and thus the position of one may be varied with respect to the other. Then piece 354 and the radial arm are interlocked by means of a screw 357 which penetrates into the holes 358–359 of the radial arm.

FIG. 78 shows three positions of the radial arm with respect to the vertical mast 353: an endmost position, an intermediate position and a substantially central position. FIG. 81 shows the frame of the umbrella in the closed position, the clamping screw 355 being loosened and piece 354 being in the central position. Thus, through its own weight the frame folds up against the vertical mast in accordance with the invention. FIG. 82 shows the movement for opening the frame from the outside. The user will grasp the peripheral end of the radial arm 7 and will rotate it about pin 355, which will result in partially opening the ribs. In the equilibrium or pre-opening position, it is then sufficient to tighten screw 355 and to fit the lower hub 11 into the cut mast 360 so as to obtain complete opening of the frame. Positioning of the radial arm and opening of the ribs may also be achieved simultaneously by connecting the lower hub to a fixed point on the mast by the means already described.

In a third embodiment, movement of the central mast with respect to the vertical fixed mast may be obtained by using a telescopic radial arm. This embodiment is shown in FIGS. 83 to 87. The telescopic tube 361 supports the frame through its hinged upper hub 14. The telescopic assembly 361 is itself hinged to a fixed part 364 integral with a vertical mast 365, by means of a pin 366. A torsion spring 367 is fitted as in known procedures between the two parts 361 and 364 so as to create a force which disposes the telescopic part horizontally. A cord 368 is fixed to the telescopic tube at a point 369 and allows the action of the torsion on spring 367 to be controlled and so this telescopic assembly to be disposed either in a vertical position for closure or a horizontal position for opening.

FIG. 85 shows an intermediate position in which the frame forms a cone. The two parts 364 and 361 become perpendicular and are secured together in this position by any known means; then the lower hub 11 is fitted into the cut mast 15 integral with the upper hub 14. A hook 372, shown in FIG. 84, integral with the lower hub 11 fits into a hole 373 in the cut mast 15. Stability is provided by means of a hollow tube 374 also integral with the lower hub 11, bearing on the flat part 375 of the last tube of the telescopic assembly.

FIG. 86 shows the umbrella open supported by the vertical mast 365 in a substantially central position. But the user has the possibility of extending the telescopic assembly and so moving the central cut mast 15 away from the vertical support mast 365 which will be offset to the periphery. For closing, it is sufficient to carry out a reverse action on the operating devices and to pull cord 368 so as to obtain a vertical out of use position and the cord will be attached to the mast on a special piece 376.

In all the embodiments of the present invention where it is necessary to provide means for guiding the mobile hub and preventing movement thereof towards the center of the cover, a first solution consists in providing a central mast sufficiently long to allow the hub to be guided over the whole of its travel. In the case of a short travel path, the mast may be of a fixed and relatively short length; on the other hand, in the case of a long travel path of the hub it may be preferable to connect the two hubs together by means of a central telescopic mast. Another solution consists in the mobile hub being floating, in the folded up position of the cover, and fitting on to the truncated central mast at the end of opening out of the ribs; in the case where the movement of the hub is controlled by a cable, it is advantageous to provide means for facilitating fitting of the hub on to the mast. FIG. 88 shows one embodiment of such means, in which the truncated mast 15 comprises at its lower end a rounded piece 199 comprising a central bore 200 in which slides cable 201. The rounded piece fits into a relatively long mobile hub 202. A lower ring 203 slides in the central bore 204 of the mobile hub and comprises a central perforation 205 through which the cable passes. Ring 203 is pushed upwardly by a spring 206 of appropriate length as far as the orifice of bore 204. When the hubs draw close together, cable 201 tends to present the central bore 200 and perforation 205 opposite each other. Ring 203 is driven in by the truncated mast during fitting.

The simplest embodiments of the present invention are adapted for use as beach sunshades planted in the sand. The central mast is particularly troublesome in the case of current sunshades, but because of the offset mast system, the space under the sunshade is quite free. FIGS. 89 to 92 illustrate such a use. A cover 403 contributes to breaking the wind and the sunshade is stabilized in the sand by means of a special foot, shown in FIG. 90, comprising in addition to the conventional spike 401 a second spike 402, the two spikes being secured together at point 401*a*. The attention of the user will be turned to fitting this support into the sand: a reciprocal movement must be effected in the plane defined by the two spikes 401–402 as shown by the double arrow in FIG. 90, and this movement is accompanied simultaneously by a thrust towards the ground as shown by the arrow in FIG. 90.

Figure 92:
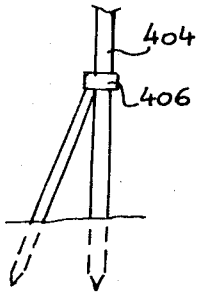
Figure 91:
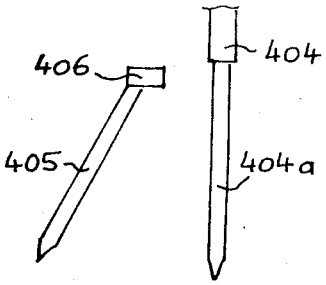

FIGS. 91 and 92 show a variation for easier carrying. The main spike is formed of two tubes of different sections 404 and 404*a;* spike 405 is introduced into spike 404 by means of the slide 406 which abuts on tube 404. An appropriate hing may even be provided for folding the second spike against the central spike after use.

The preceding embodiments have been described with respect to an application in which the umbrella comprises a frame and a fabric cover. The present invention however comprises arrangements for adapting multi-frame umbrellas or several umbrellas.

Thus, two umbrellas may be fitted on to the same fixed support, opening out thereof being achieved by means of a single lever exerting its action on the two radial arms at the same time. FIGS. 93 to 97 illustrate such an embodiment. Referring to FIG. 93, lever 269 actuates the two radial arms 270–271 through a common cross piece 272 hinged at its lower part to lever 269 through a hinge fork joint 273. This lever is fitted to mast 274 by means of a pin 275 and actuated by a traction spring 276.

The radial arms 270 and 271 will be chosen in accordance with the invention with a cavity so as to allow special pivots to slide as shown in FIGS. 94 and 95. The radial arms will be able to pivot at their low end on pins 277 and 278, as shown in FIGS. 93 and 100, integral with the cross piece 272. Mast 274 as split at its top part into two branches 274*a* and 274*b*. Thus each support 270 and 271 may bear thereon through special hinges, respectively, pivot 279 for support 270 and pivot 280 for support 271. The hinges may comprise rollers 281–281*a* connected together by a shaft 282–282*a* integral with a support 283–283*a*. The hinges may further rotate with respect to branches 274*a*–274*b* as shown by the double arrow in FIG. 95.

The radial arms 270–271 may then move in all directions, particularly in the plane which they form therebetween and move away from each other from a parallel position to a perpendicular position. In fact, under the action of the common lever 279, the radial arms are pushed over the hinges 281–281*a*, when passing from a vertical plane to a horizontal plane; their upper ends are simultaneously moved apart from each other by rotation of supports 283–283*a* until the two arms are practically perpendicular in the fully open position.

FIG. 98 shows the two umbrellas in an out of use position. The lever is not shown for the sake of clarity. FIG. 99 shows in profile the assembly of the two umbrellas at rest, the radial arms being held by a flexible handle 286 on the stick handle 284 according to all known procedures. The stick handle 284 and mast 274 are offset to allow handling. The stick handle 284 is integral with the concrete base 285. The flexible handle 286 serves for controlling the opening movement so that the spring does not expand suddenly, and serves as a return means for the radial arms during closing. In this embodiment, all kinds of umbrella mountings may be fitted to the radial arms, particularly those described in the preceding embodiments.

Figure 101:
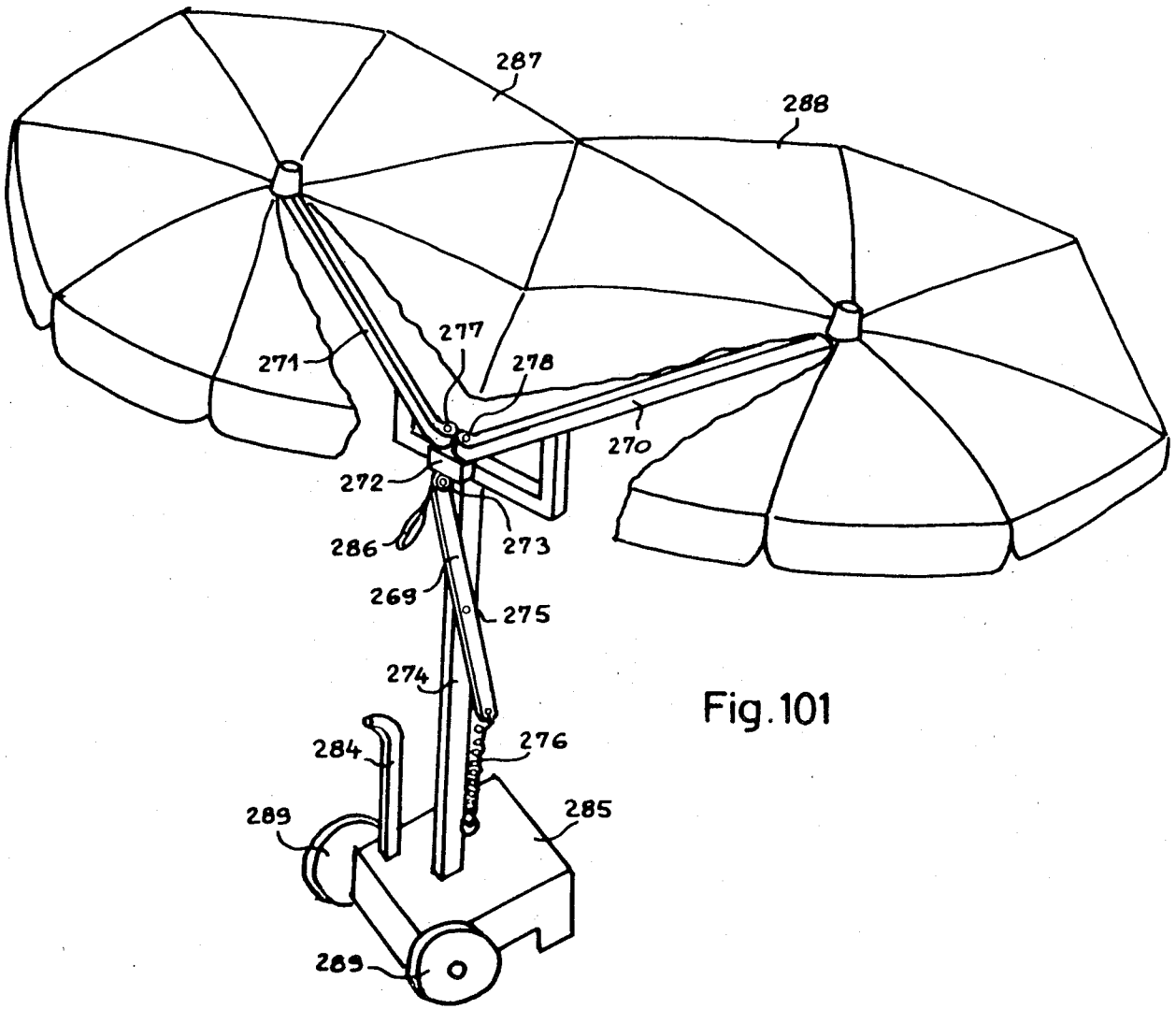

FIG. 101 shows in a three quarter rear view two umbrellas completely open actuated by the same lever. The two radial arms 270–271 are below the surface of the cover and they are visible in this figure because the covers 287 and 288 have been cut out for a better understanding of the device. Two wheels 289 have also been fitted to base 285 to facilitate handling of the assembly.

The following embodiments relate to offset umbrellas comprising a cover made from a single piece held in place and stretched by several partial frames.

Figure 102:
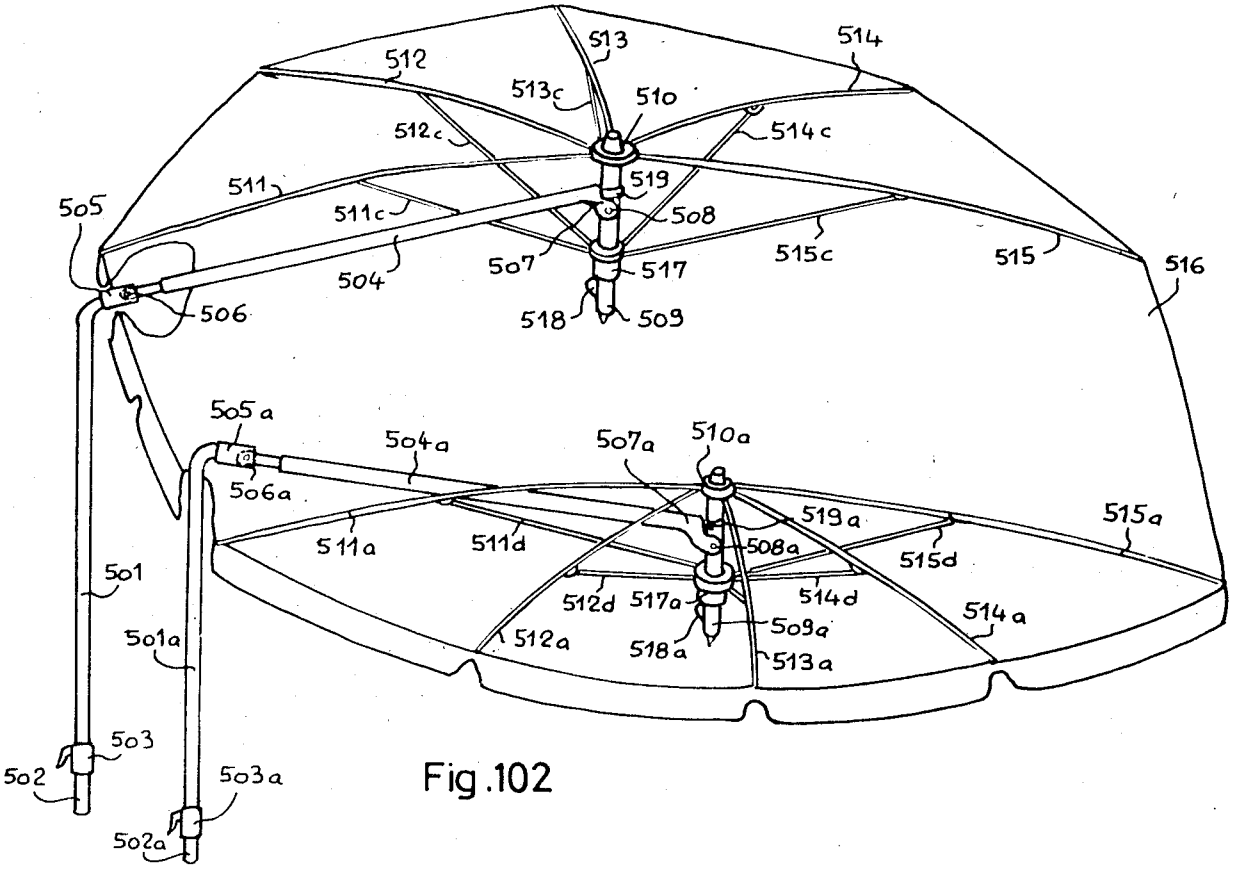

In the embodiment shown in FIG. 102, two masts 501 and 501*a* are connected to two spikes 502 and 502*a* by clamping means 503–503*a* comprising an eccentric lever fitted to the outer tube for clamping the inner tube.

Figure 103:
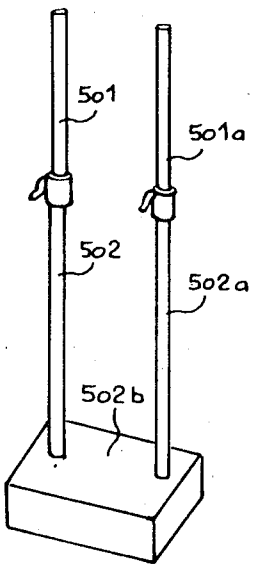
Figure 104:
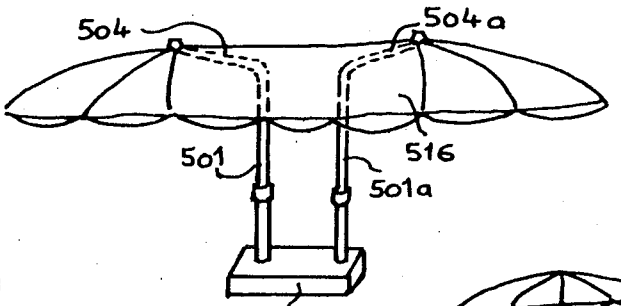
Figure 105:
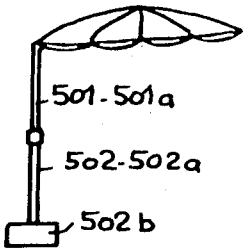

In FIG. 103 spikes 502 and 502*a* have been shown secured to a concrete base 502*b* for holding the assembly. In FIG. 102, two radial arms 504 and 504*a* are fitted to a structure formed of two vertical masts 501–501*a* by means of a hinge system formed of a ring 505–505*a* opening or closing hinge 506–506*a* with horizontal axis. The radial arms 504–504*a* comprise at their first end fork joints 507–507*a* for hingeing, by means of pins 508–508*a*, the central cut masts 509–509A. These truncated central masts are secured to the ribs by means of upper hubs 510–510*a* in a conventional way. Each of the hubs 510 and 510*a* only comprises the ribs required for supporting the half circumference of the umbrella, with possibly one or two ribs for holding the central part in place. By way of example, ribs 511 and 515 have been shown defining four sections of the cover of half an umbrella. Similarly, hub 510 ensures operation of ribs 511*a* to 515*a* forming the other four sections of the cover. The two cover halves are connected together by sewing at the central part 516 made from rectangular shaped fabric.

According to the embodiment shown in FIG. 102, the radial arms 504–504*a* are disposed so as to be divergent, so that the distance from the cut masts is greater than the spacing apart of the supporting masts 501–501*a*. The tension of the fabric is then provided when the two sliders 517 and 517*a* slide on masts 509–509*a* and are held by retractable studs 518–518*a* of a known type. The tension of the central part of the fabric cover is provided by moving apart the radial arms. To allow proper tension of the fabric, counter ribs are used connecting the ribs to a lower hub of each half frame, namely 511*c* to 515*c* and 511*d* to 515*d*. Clips 519 and 519*a* lock the central masts in the opened out position at the end of the radial arms.

Figure 106:
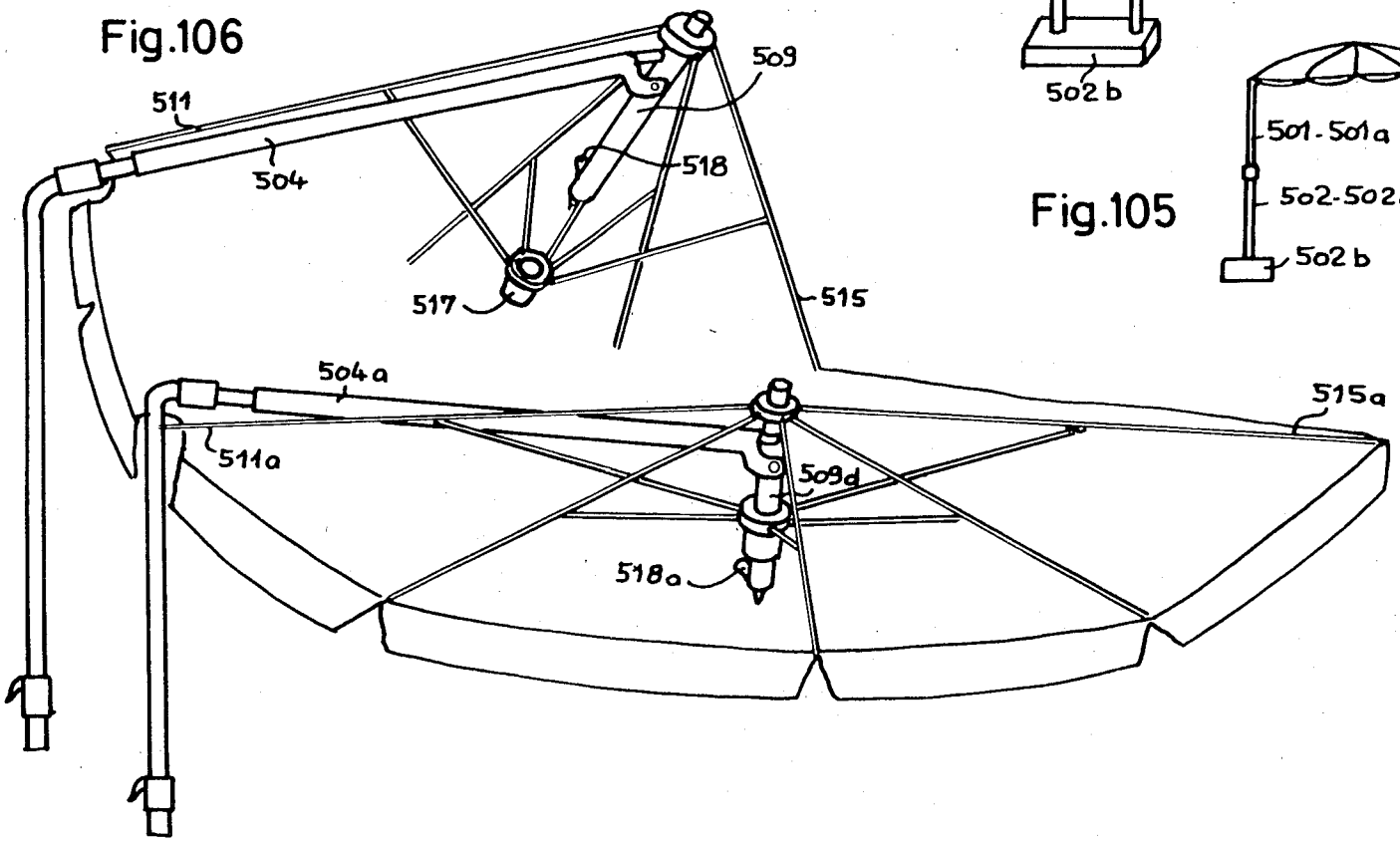

FIG. 106 shows the assembly in its first closure phase. The slider or lower hub 517 is released from the central truncated mast 509 by releasing the pressure of stud 518. The whole of the fabric cover is then slackened and the released part is disposed in a half cone shape. The other part remains as a semi-circumference but the ribs slacken and are practically straight because there is no longer any tension. Only the endmost ribs 515*a* 511*a* undergo a slight tension coming from the right-hand part, which has a tendency to retain the half cone formed by the bundle of ribs 511 and 515.

Figure 107:
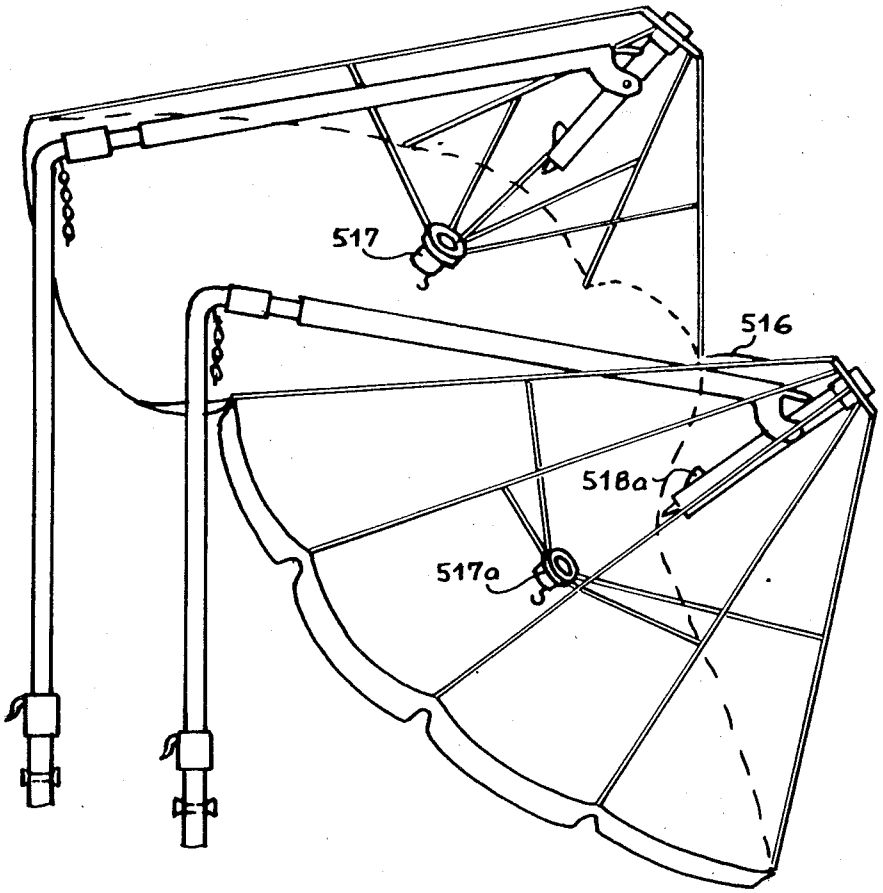

FIG. 107 shows the second half in the conical position, after freeing the lower rub 517*a* from stud 518*a*. The weight of the central part of the cover tends to draw the two half cones towards one another.

Figure 108:
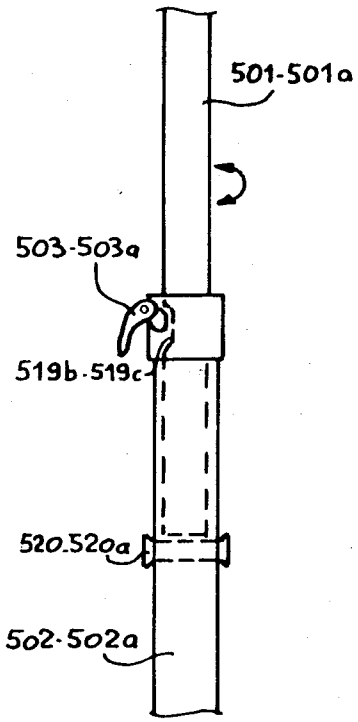

In FIG. 108 there is shown in detail the junction of each mast 501–501*a* with its spike or lower part of the support structure; levers 503 and 503*a* actuate an eccentric which is integral therewith so as to penetrate into a reservation 519–519*c* provided in masts 501–501*a*. When levers 503–503*a* are unclamped, masts 501–501*a* are nevertheless retained on spikes 502–502*a* by pins 520–520*a* secured to these spikes and allowing rotation of masts 501–501*a* in the spikes.

FIG. 109 shows the device after rotation of spikes 501*a*–501 to bring together the heads of the umbrella, the two half frames being brought into a closure position by coupling the lower hubs 517–517*a* to the spikes 501–501*a*, for example by means of a hook integral with the lower hub retained by a chain integral with the mast.

In FIG. 110, rings 505–505*a* are slid so as to free the hinges 506–506*a*, which allows the radial arms 504–504*a* to swing against the spikes 501–501*a*.

In FIG. 111 is shown the transport mode for the device in which the user may easily withdraw the two umbrella halves form the spikes because of their proximity on the same base 502*b*.

Moreover, the system for clamping the spikes may prove difficult to use for large sized umbrellas. Recourse may then be had to action on the end of the radial arms particularly on the central masts which are integral therewith.

FIG. 112 shows an embodiment in which the ends of the radial arms are moved apart while fitting on to the central truncated masts 509–509*a* sockets 521–521*a* to which are welded tube stubs 522–522*a* for receiving a telescopic assembly 523 formed from two tubes one of which 524 may slide on a large one 525. The telescopic assembly is fitted into tubes 522–522*a* by means of special slits 526–526*a*. Sockets 521–521*a* rest on the pins 521*b*–521*c* which pass through the central cut masts, preventing them from escaping from these masts without hindering rotation on the cut masts.

FIG. 113 shows the constructional detail of the telescopic assembly 523, in the drawn out position so as to spread out the central masts 509–509*a* as much as possible. This determines the tension of the cover of the two half umbrellas, and a fixing bolt 527 clamps the two tubes in a fixed position for locking them. The spreading out of the central masts by means of the telescopic bar 523 is accompanied by rotation of rings 521 and 521*a* on the central masts.

FIG. 114 shows the action of the telescopic assembly 523 causing rotation of masts 501 and 501*a*. To limit this rotation, stoppers 528 and 528*a* may be welded to masts 501–501*a* which, when they rotate through spacing apart of the telescopic bar 523, abut against rods 529–529*a* secured to spikes 502–502*a* which are fixed. Consequently, by tightening screw 527 which locks the two sliding tubes 524 and 525, the whole of the structure of the umbrella is locked. Thus, the force of the wind cannot cause the system to rotate.

According to a particular embodiment shown in FIG. 115, the two masts 501–501*a* may rotate in tubes 530–530*a* connected together by a fixed lower element 531. The assembly is carried by a larger diameter spike 532, itself able to rotate in a sleeve tube 533 having a clamping means 534 for fixing the assembly of the umbrella in the different positions required for protection from the sun. This sleeve 533 is secured to the concrete base 535 by any appropriate means.

Figure 116:
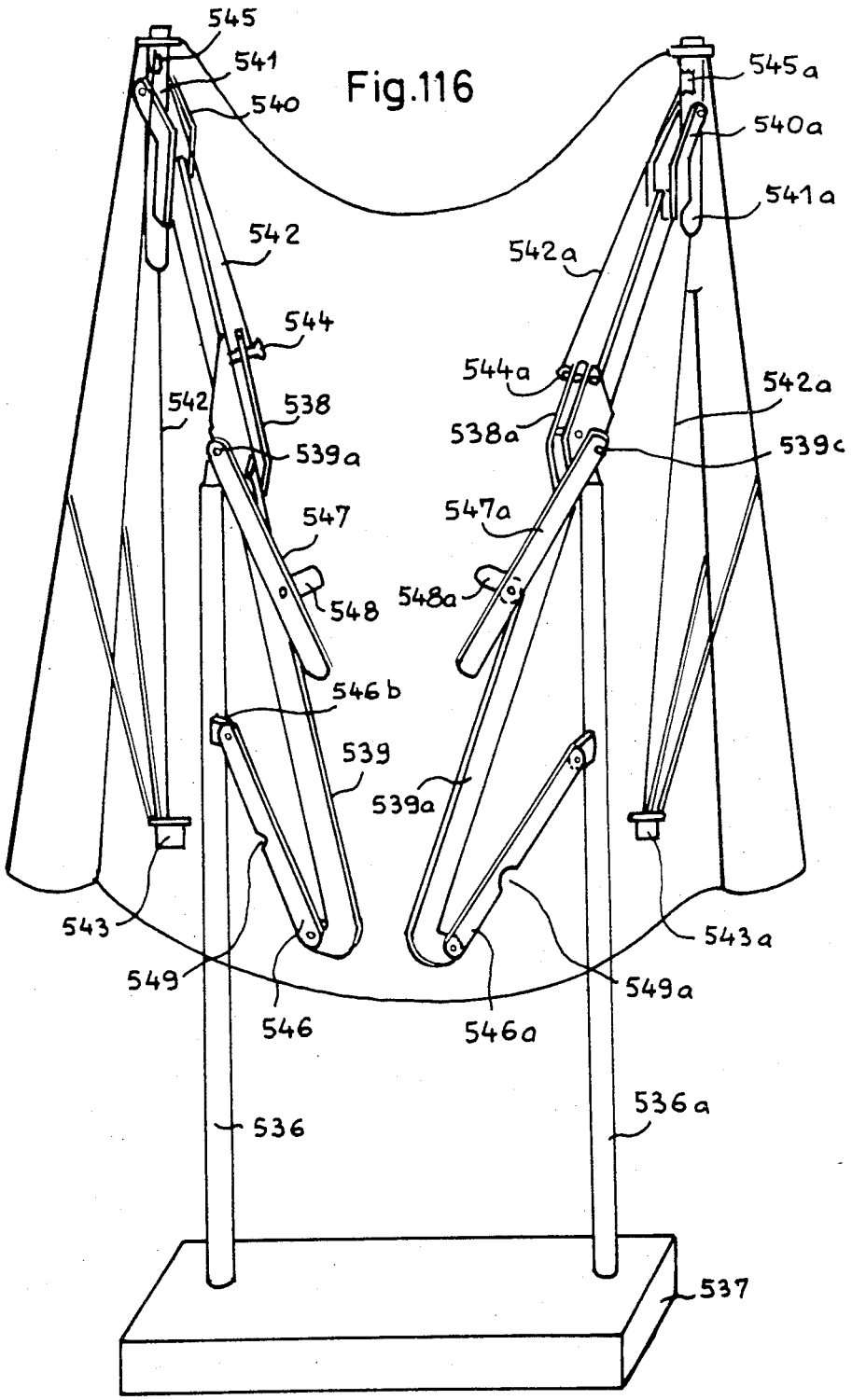
Figure 117:
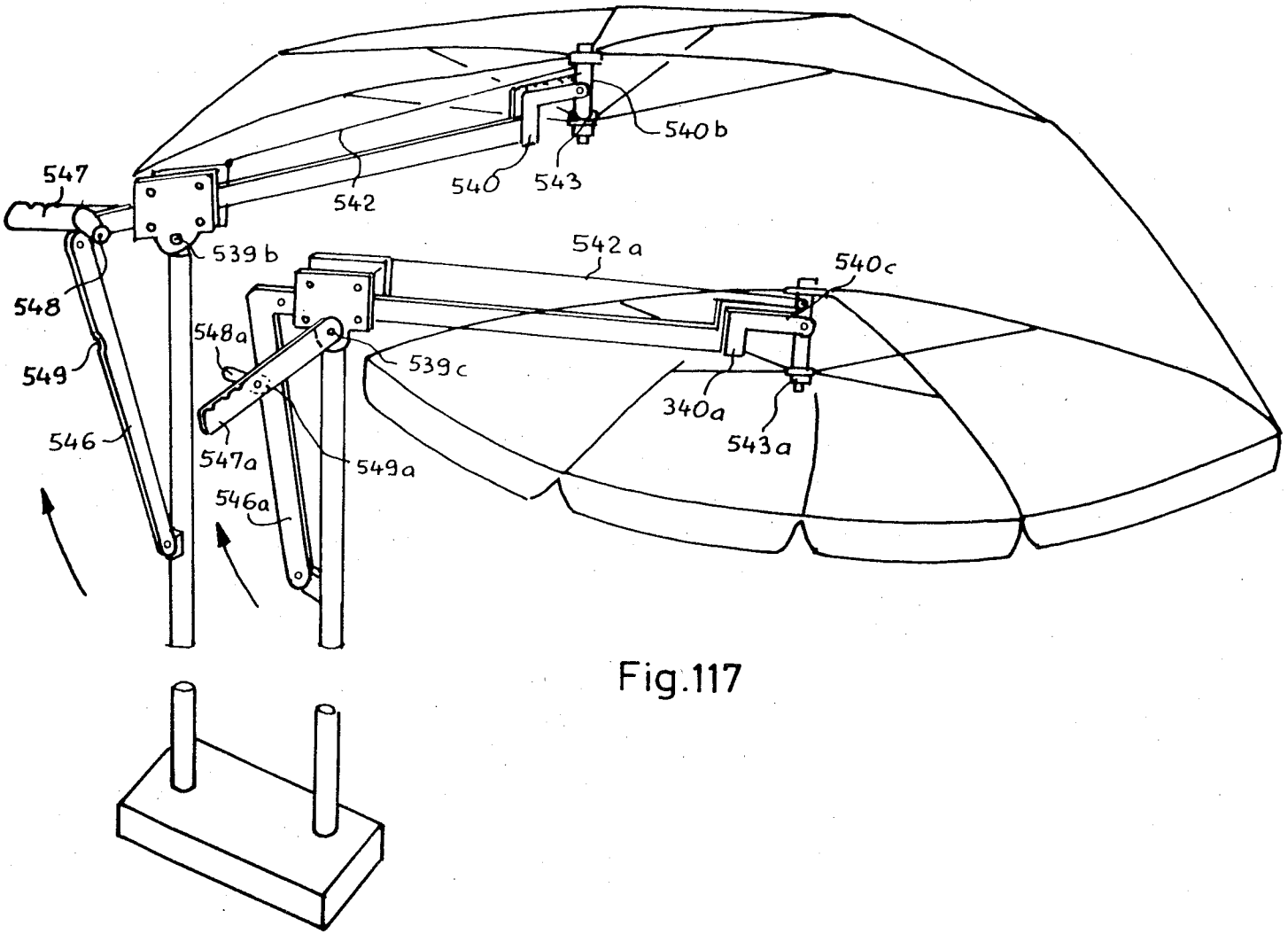

According to another embodiment, shown more particularly in FIG. 116, a different hinge is used for fixing the radial arms to the support structure. The device comprises two vertical masts 536–536*a* fixed to a base 537. At the top of these masts is provided a housing, for example by appropriate pieces 538 and 538*a*, allowing the radial arms 539 and 539*a* to pass slightly therethrough. These pieces may comprise rollers required for proper sliding of the radial arms, and are further hinged at 539*b* and 539*c* to follow the progressive slanting of the arms during opening out thereof. At the first end of each radial arm is mounted an appropriate fork joint 540–540*a* supporting the cut central masts 541–541*a* and hinged to these masts as described above. There are also shown cables 542 and 542*a* connecting the sliders 543–543*a* or lower hubs of the counter ribs to the fixed point 544–544*a* returned by pulleys 545–545*a* secured to the central masts. The cables allow automatic opening out of the ribs about the truncated masts under the opening out action of the radial arms, so as to reduce the number of operations required for opening and closing the umbrella. Links 546–546*a* connect the second end of the radial arms to the support structure as shown in FIGS. 116 and 117 so as to lift the second end of the radial arms during opening out thereof and to place them in a horizontal position. As in the preceding embodiment, links 546–546*a* and the radial support define planes which form therebetween a certain angle so that, when the radial supports are in the opened out position, they are divergent so as to stretch the fabric cover. Nevertheless, this angle should not be too open, nor should the vertical masts be too close together, so that the links may be operated alternately or at the same time without touching.

Two tubular or similar elements 547–547*a* are hinged to pins 539*b*–539*c*, and comprise cylindrical elements 548–548*a* made from a sliding material such as polyvinyl chloride, fixed perpendicularly to the edge of the elements for providing sliding, more especially on their respective radial support, during the operation passing from the vertical to the horizontal. Elements 547 and 547*a* then serve as a lever for locking the frames. In FIG. 117 is shown the end of the movement; links 546 and 546*a* no longer easily ensure advance of the radial arms because of the tension of the fabric. In this case, after sliding of the radial arms, it is possible to lower levers 547–547*a* against the links and, since the stoppers 548–548*a* describe an arc of a circle from pins 539*b*–539*c*, they thus transmit a pressure to the links which in their turn push the radial arms. Under the effect of cables 542–542*a*, the lower hubs 543–543*a* exert a tension on the ribs and the fabric is stretched. Stops 540*b* and 540*c*, secured to the end fork-joints 540–540*a* of the radial arms, stop the swinging of the truncated masts in the vertical position under the action of cables 542–542*a*, so that the subsequent tension of the cables allows an efficient tension of the fabric. Slits 549–549*a* are formed on the external edge of links 546–546*a* so that the stoppers are housed and locked therein. In FIG. 117 the lever 547 is sliding over the link. The other lever 547 has already exerted its pressure against the link and is in its locking position.

Figure 118:
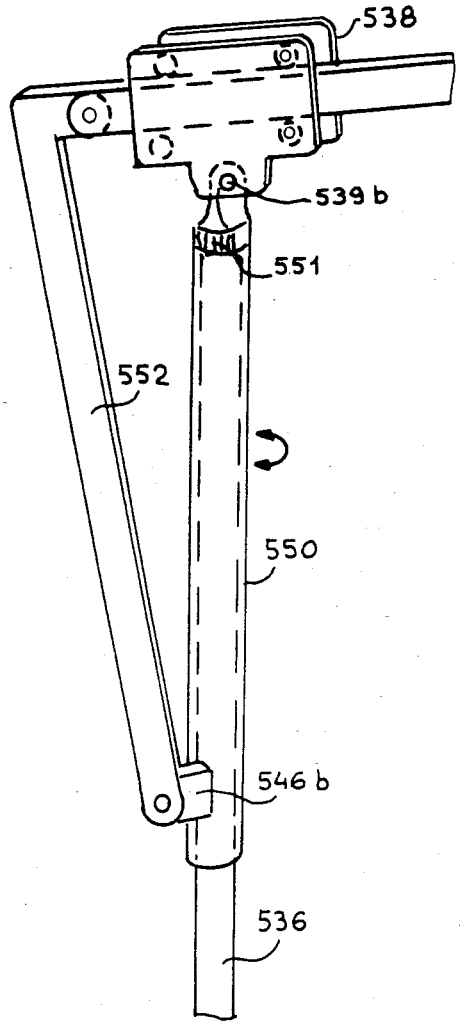

In another embodiment, it may be considered that the fictitious planes defined by the radial arms and the links are no longer fixed. So as to improve the performances of the device, and in particular to reduce the spacing apart of the vertical supporting masts, these planes will be made mobile. FIG. 118 shows by way of example this other embodiment. Piece 538 which ensures sliding of the radial arms, as well as the fork joint 546*b* to which link 552 is hinged, are mounted on a tube 550 which plays the role of a sleeve with respect to the carrier tube 536; thus rotation about tube 536 is possible because of piece 551, made from an unalterable material such as polyvinyl chloride, fixed to tube 536 at its end.

Figure 119:
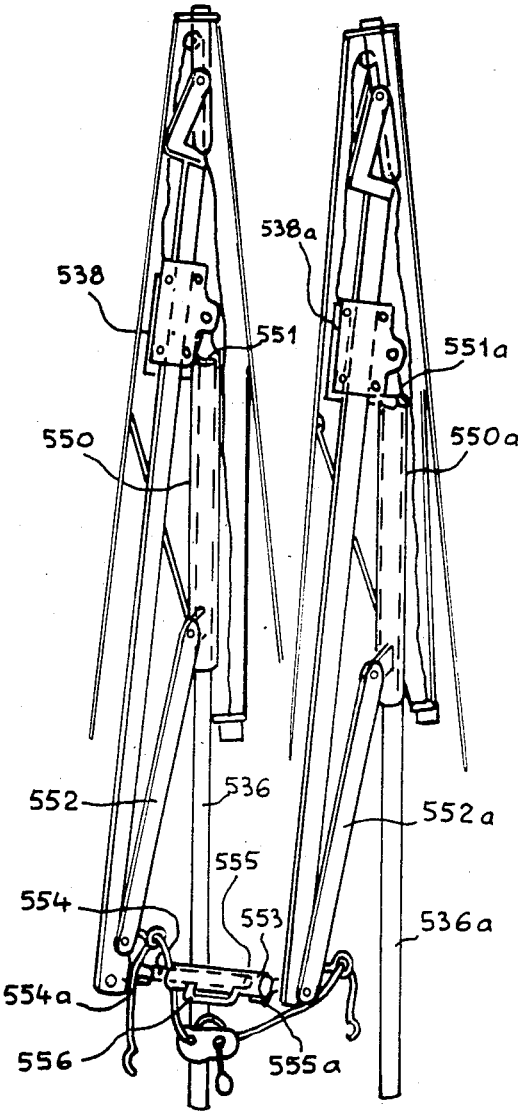

FIG. 119 shows an embodiment in which the assembly of the umbrella is mounted on vertical masts fixed to the concrete base as previously described. Tubular sleeves 550–550*a* are fitted to masts 536–536*a* which abut against pieces 551–551*a* fixed to tubes 536–536*a* at their upper ends. The radial arms comprise at their end the central masts and the corresponding hubs for operation of the rubs. Opening of the ribs occurs simultaneously with the movement of the radial arms. There is fitted to links 552–552*a* a telescopic assembly 553 formed by a tube 554 which slides in another tube 555. The two tubes are secured to the links, or to the radial arms in the vicinity of their second end and are provided with an operating handle 556 fixed to tube 555 for raising the whole of the mounting of the umbrella. The radial arms are thus brought parallel from the vertical position to their horizontal position of use. The half circumferences of the umbrella are then opened out under the effect of the pull exerted by the cable on the lower hubs, the central part of the fabric cover being however slack. Tensioning of the central part of the fabric cover is obtained by moving apart the ends of the radial arms.

Figure 120:
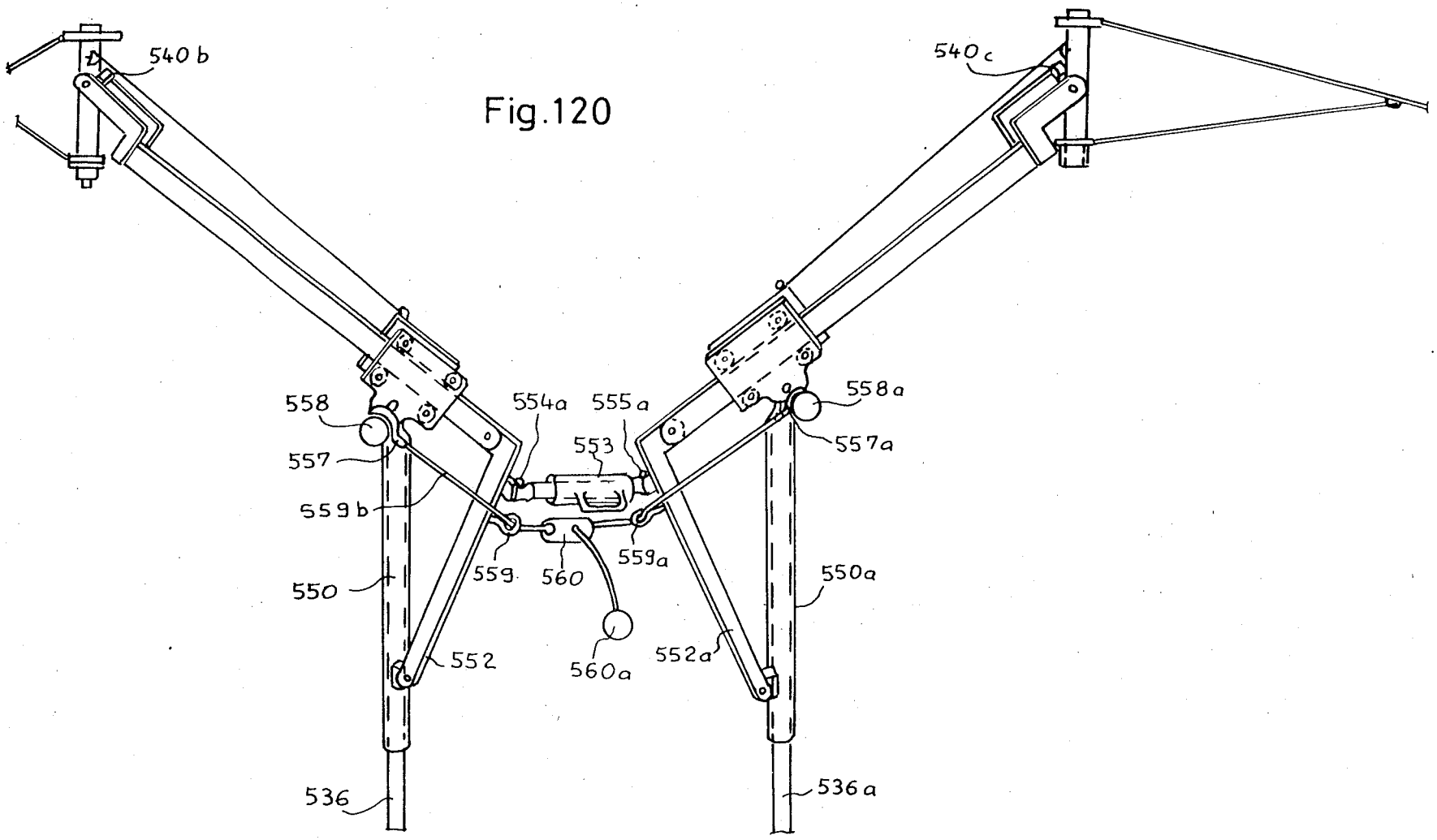
Figure 121:
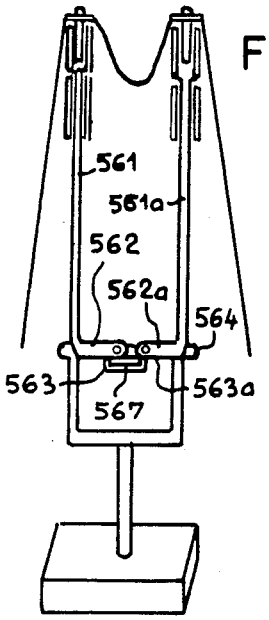

In FIG. 120 there is shown the divergence of the two radial arms by means of a clamping system given by way of example. For this purpose hooks 557,557*a* are provided fixed to the pins 558–558*a* which secure the hinges of the radial arm to their supporting masts but which project to allow fitting of these hooks. A nylon cord 559*b* is secured to these hooks by any known means and passes through the orifices of rings 559–559*a* fixed to the corresponding links. A part of cord 559*c* is moreover fixed to plate 560 through which passes the other piece of cord 559*b*. By pulling knob 560*a* the links are brought closer together and a sliding movement occurs in the telescopic assembly 553. By continuing the movement, each link is clamped against the corresponding masts until the required tension is obtained for the whole of the fabric of the umbrella. Plate 560 serves for locking and braking the cord. This movement is made possible because of the rotation of tubes 550–550*a* on tubes 536–536*a*. FIG. 121 shows another embodiment for ensuring divergence of the radial arms simultaneously with opening out thereof. The two radial arms 561–561*a* are substantially parallel in their vertical folded position. Each radial arm comprises a return 562–562*a* perpendicular to its second end. These returns are hinged by means of pins 563–563*a* to a tubular bar 564 of fixed length so that the spacing apart of the second ends remains less than the spacing apart of the housings of the support structure so as to cause divergence of the arms when they open out.

Figure 122:
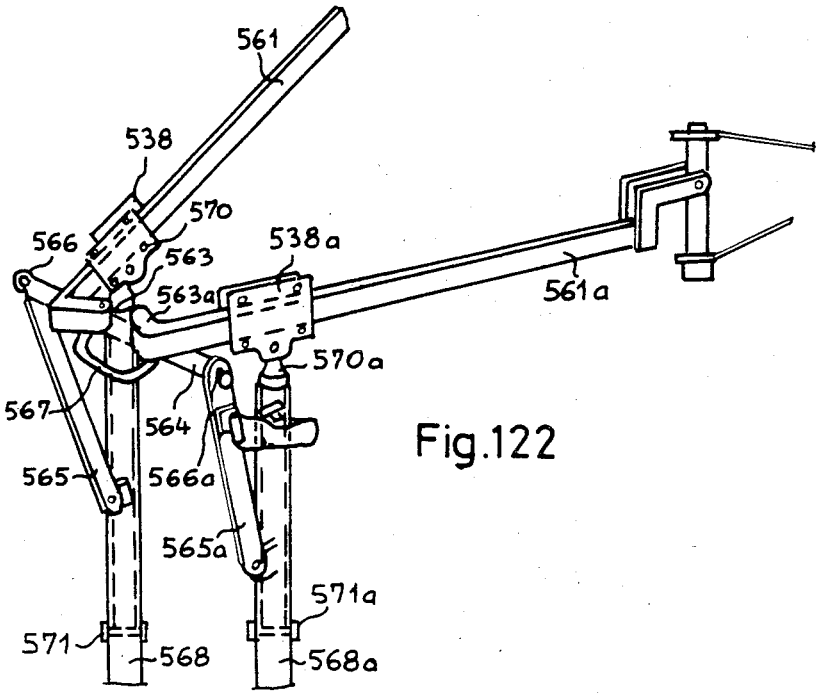

FIG. 122 shows this tubular bar 564 secured to links 565–565*a* by shafts 566–566*a* allowing the links and the tubular bar 564 to rotate during the downward movement of the links. A handle 567 is fixed to the tubular bar for lifting the two radial arms together. But when the links draw close to the vertical masts 568–568*a*, the radial arms pivot on their shafts 563–563*a* and cause the upper pieces 538–538*a* to rotate which are hinged by their pins to tubes 570–570*a* which may rotate in tubes 568–568*a* serving as a vertical support.

Stops 571-571*a* formed by pins through tubes 568–568*a* support tubes 570–570*a* while allowing them to pivot.

Figure 123:
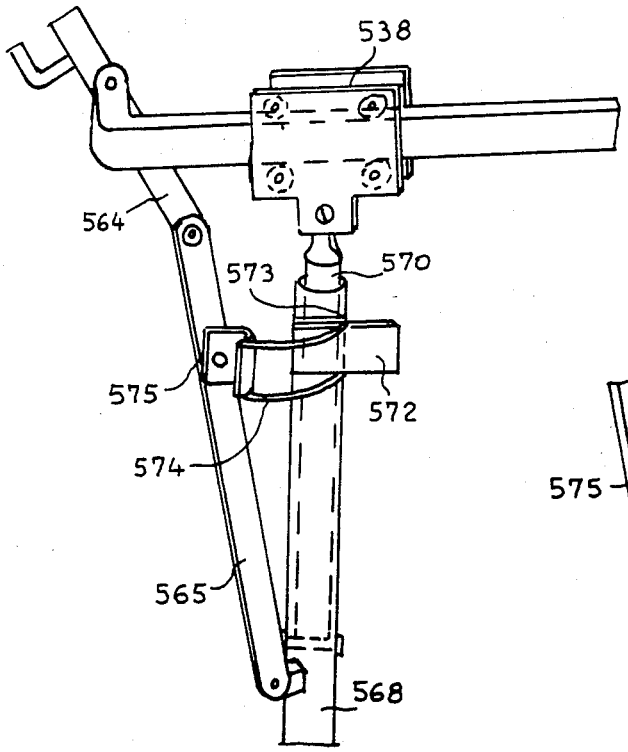
Figure 124:
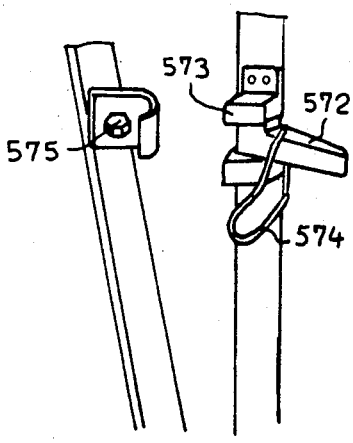

FIG. 123 shows in an enlarged view half of the system with a clamping means formed by a lever 572 hinged to a pin 573 secured to tubes 568. A loop 574 is fitted into the hook 575 firmly fixed to the link. By pressing the lever, the loop is pulled which clamps the closing and locks the device. The same operation repeated on the other link allows the umbrella to be stretched. FIG. 124 shows this locking device in the open position.

Figure 126:
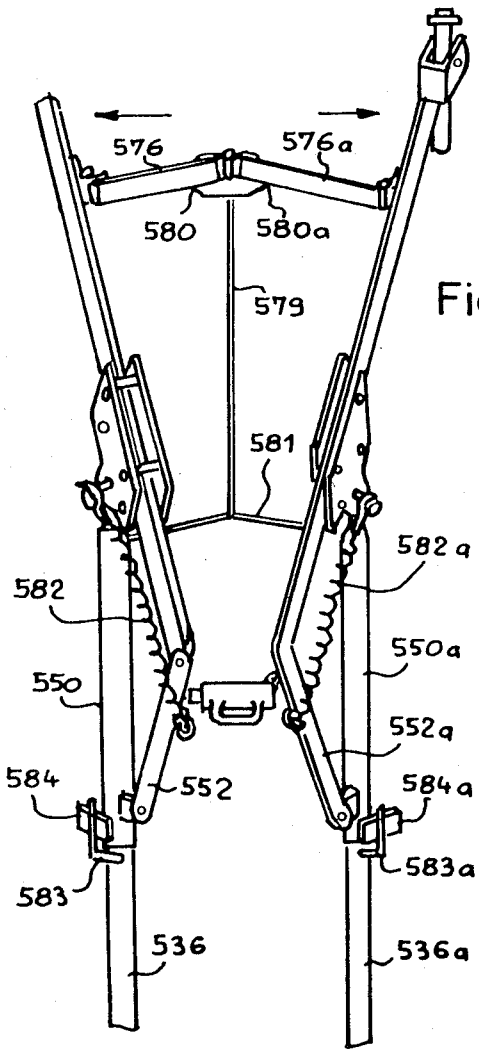
Figure 125:
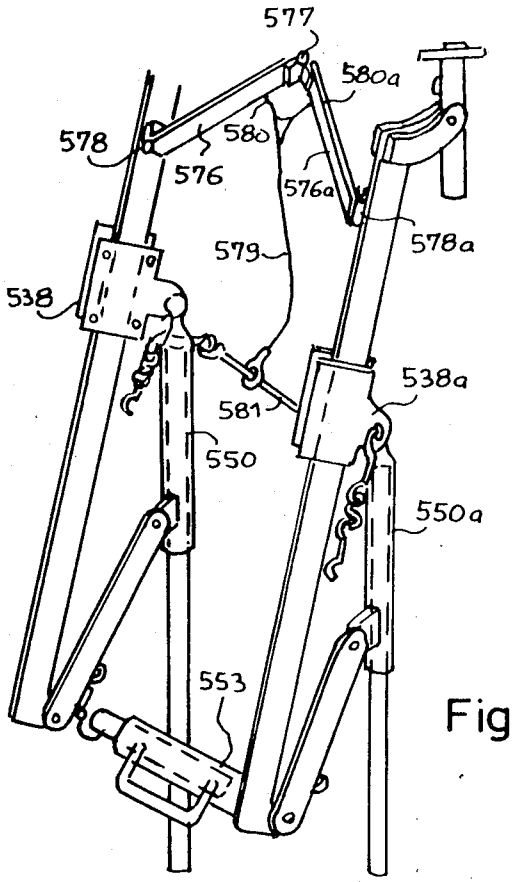

In FIG. 125 there is shown another embodiment for improving the tension provided by moving apart the radial arms, more particularly for large sized umbrellas. In this embodiment, two arms 576–576*a* hinged together by a pin 577 are fixed to the radial supports at their upper end by means of articulated hinges 578–578*a*. The two arms form therebetween an acute angle whose apex is directed towards the first ends of the radial arms. A cable 579 is fixed at two points 580–580*a* of each of the two arms and is connected to a cable 581 itself secured to masts 550–550*a*. When the link levers are actuated for opening out the radial arms, cable 579 whose length is shorter than the travel distance of the radial arms on the upper pieces 538–538*a* pulls the two arms 576–576*a*. FIG. 126 shows the action of cable 579 opening the angle of arms 576–576*a* and pushing back the radial arms outwardly until the desired spacing apart is obtained for tensioning the fabric cover. The closer the links 552–552*a* are brought to the vertical masts 550–550*a*, the greater the spacing apart. This proximity may be obtained by means of a spring 582–582*a*. Arms 576–576*a* should always leave a minimum angle so as to facilitate folding up. The movement of the assembly of radial arms may possibly be limited in their rotation with respect to masts 536–536*a* by means of rods 583–583*a* secured to the tubes. Pieces 584–584*a* integral with tubes 550–550*a* stops the tubes in the case of lateral movement of the assembly against rods 583–583*a*.

The opening operations may be improved by using systems such as hoisting gear. FIG. 127 shows the fitting of hoisting gear 585–585*a* secured on one side to a bar 586 which connects together the two vertical masts and on the other side by means of a hook 587 connected to the handle 556 of the telescopic tubular assembly 553. Bar 586 is mounted appropriately so as not to hinder rotation of the vertical masts.

In FIG. 128 the umbrella is shown in the fully open position, after the user has pulled the cord 588 of the hoisting gear. The two parts 585–585*a* forming the hoisting gear are brought closer to one another. As in the previously described embodiments, cable 589 pulls the two arms 590–590*a* thus moving the radial arms apart. The user jams the cord in a cleat 591 so as to lock the device.

In FIG. 130 is shown an embodiment in which a common radial arm 604 is extended by three secondary radial arms 605, 606 and 607. The secondary radial arms 605 and 607 move apart from the central arm 606 according to the previously described procedures by means of hinged arm assemblies 608–609 actuated by cables.

Figure 131:
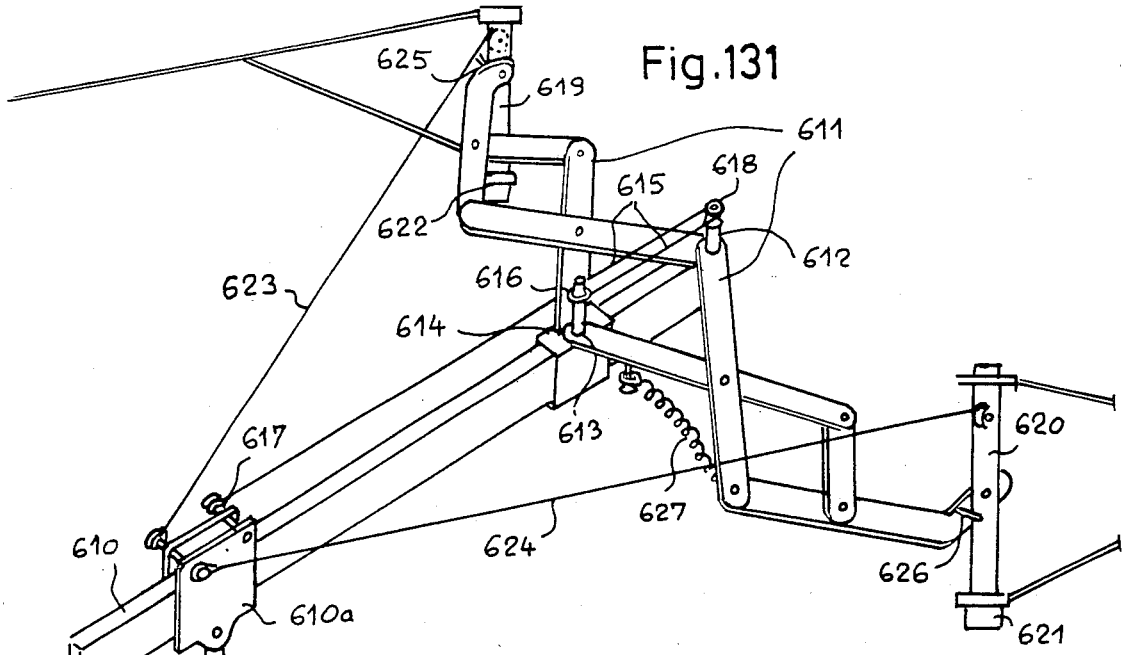

FIG. 131 shows another embodiment in which the umbrella comprises a single radial arm to which secondary arms are hinged. To radial arm 610 are secured the secondary arms in the form of struts or cross-pieces 611, joined together at a fixed point 612 on the radial arm and a point 613 on ring 614. The ring has a tubular profile of larger cross section than arm 610 and slides on this arm. Actuation of the strut arms is provided for example by means of a cable 615 connected to a point 616 of the sliding part and at 617 to the fork joint 610*a* of the device. When the radial arm slides in the fork joint or upper piece 610*a*, the cable is stretched and, because of pulley 618 integral with the radial arm at its end, the sliding ring is brought closer to fixed point 612 and opening of the strut arms is provided. The two cut masts 619 and 620 are then moved away from each other and contribute to stretching the fabric. Simultaneously, the sliders or lower hubs 621–622 are caused to engage in the cut masts 619–620 through the action of cables 623–624 secured to the fork joint 610*a*. Thus is obtained the general tension of the fabric, not shown in the figures for the sake of clarity. The cut masts 619 and 620 are connected to the ends of the struts by a shaft which allows pivoting thereof. Stops 625 and 626 stop the masts in their position perpendicular to the ground necessary for the correct disposition of the umbrella. Cables 615, 623 and 624 are of appropriate length so that the whole operates in a synchronized way. A closure device 610*b* interlocks the vertical mast and the link in an open position stretching the fabric cover for locking the device.

In a variation not shown, cables 623 and 624 are connected to the first end of the radial arm and not to the fork joint 610*a*, and the sliders are pulled during opening of the struts, that is to say during the travel of ring 614 over the radial arm. A number of struts must then be chosen sufficient for the spacing apart of the head, or cut central mast, from the radial arm to correspond to the distance from the slider to the cut mast.

Figure 132:
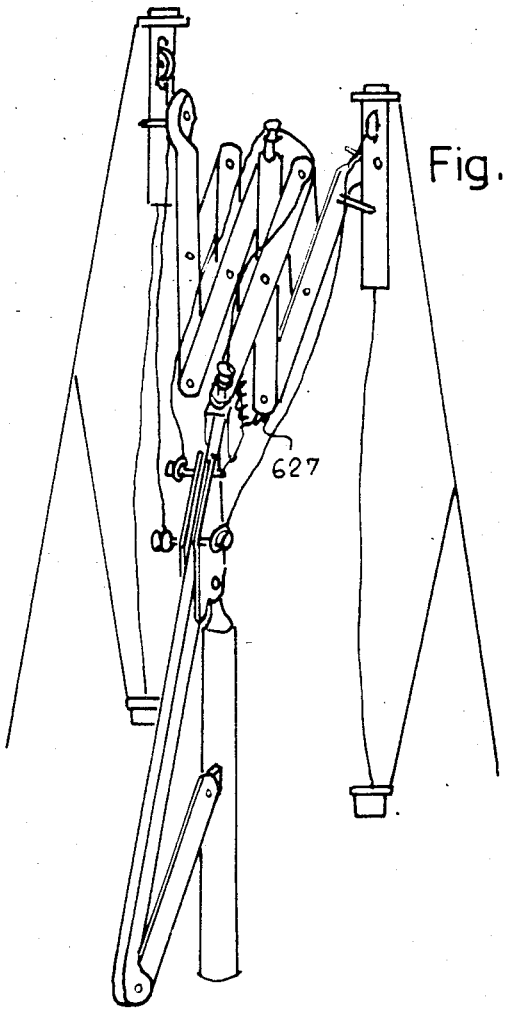

FIG. 132 shows the device in its out of use position. Support 610 is practically vertical. Return spring 627 facilitates folding up of the struts.

According to another embodiment, a variation of the previously described strut device, the umbrella heads may be moved apart by a strut arm device connecting them directly together. As shown in FIG. 133, the device is formed of a radial arm 628 associated by means of an appropriate hinge 629 with a cut mast 630. The strut assembly is secured to the cut mast at points 631–632 and at points 633–634 on a sliding ring 635 sliding on the cut mast 630. Similarly, the other cut masts 636 and 637 are secured to the strut system at fixed points 638 and 639 and at mobile points 640–641 fixed to sliding rings 642–643.

As in the preceding devices, sliders 644–645 and 646 will engage in the respective central masts under the action of cables 647, 648 and 649 when the radial arm advances into fork joint 610*a*.

FIG. 134 shows the device in the completely open position. Sliders 644, 645 and 646 after entering into the respective cut masts 630, 636 and 637 actuate the sliding rings 635, 642 and 643 and so control the opening of the strut system. The cut masts move apart and thus stretch the fabric simultaneously with opening of the ribs. A stop 650 limits the travel of the cut mast and stabilizes the device in a vertical position under the action of the cables. Cables 647, 648 and 649 are of appropriate length so as to act together on the respective sliding rings.

By way of variation, not shown, cables 647 and 648 may be secured to mast 630 and only initiate opening of the struts when slider 645 actuates ring 635. The number of struts depends on the travel of the ring so that there is sufficient length for pulling the sliders 646 and 647.

According to another embodiment, the radial arms may be disposed above the fabric cover.

FIG. 135 shows by way of non limiting example such a system in the open position; two radial supports 651–652 are secured to two spreading out arms 653–654 at the end thereof which respectively comprise the cut masts 655–656 according to the previously described principles and hinged to these parts by means of pins 657–658. But the upper hubs 659–660 are below these hinges so that unfolding of the fabric takes place under the radial supports 651–652 themselves connected to links 661–662, and the whole secured to the vertical masts according to the above described procedures.

The partially shown cables 663–664 connect the lower sliders 665–666 to fixed points 667–668 on the frame of the umbrella; this allows simultaneous opening of the ribs during swinging of the radial supports. The travel of the cut masts 655–656 is limited by stops 669–670 which thus permit a vertical position of these cut masts. The tension of fabric 671 is then provided by levers 672–673. Cable 674 is secured to the vertical masts of the frame according to the previously described procedures and contributes to opening of arms 653–654.

Handle 674*a* secured to the telescopic tube system 675 allows the two radial arms to be raised at the same time, in accordance with the above described procedures.

FIG. 136 shows this assembly in its closure phase and it will be noted that the fabric escapes from the assembly of the framework, thus offering the possibility of complete folding up. The cables are only partially shown for the sake of clarity.

According to one embodiment not shown in the figures, the hingeing of the truncated masts to the first ends of the radial arms may be provided on the upper hubs themselves. In this case, one of the ribs may be likened to the radial arm; that is to say that the radial arm serves as rib or the radial arm is firmly secured to the rib providing hingeing with the truncated mast. This arrangement may be used in all the previously described embodiments for permanently maintaining a radial portion of the fabric cover in the vicinity of the radial arm.

In the embodiments in which the framework subtends the fabric cover, a radial portion of this latter is constantly maintained in the vicinity of the radial arm, especially by the weight of the fabric when it is slackened.

FIG. 137 shows an embodiment in which the sliding hubs 676–676*a* have a short travel reversed with respect to the preceding embodiments: the slant of the counter ribs is reversed, and folding up of the fabric is obtained by bringing the hubs close to one another whereas moving the hubs 676–676*a* away from each other causes the fabric 682 to be opened out. This arrangement may be advantageously used in combination with the means for opening out the radial rams 681–681*a* already described: a cable 677–677*a*, integral with the mobile hub 676–676*a*, passes through a return pulley 678–678*a*, into the central tubular mast, and is returned by a pulley 679–679*a* to the second end of the radial arm where it is firmly secured to the clamping lever 680–680*a*. Thus, the short travel of the cable is compatible with movement of the clamping lever, whose operation produces both the thrust of the radial arm and complete pulling of the mobile hub by the cable. By way of illustration, FIG. 137 shows such a device in an intermediate position in which a half cover is stretched and the other simply hung at the end of the opened out radial arm before tensioning. Of course, without departing from the scope of the present invention, such an arrangement of short travel hubs could be used in other previously described embodiments.

In the preceding embodiments, the radial arms were formed by a one-piece bar, hinged to the support structure.

FIG. 138 shows a method of projection into space of the frames of the umbrella, by means of radial arms formed from segments hinged as struts 683–683*a*. These are hinged at their first end both to the fixed ring 684–684*a* of the support structure and to the pins 685–685*a* on sliding rings 686–686*a* sliding on the support structure.

A system for pulling by cable 687–687*a* in a sheath 687*b*–687*c*, known for operating fanlights, allows the movements of the sliding rings 686–686*a* to be controlled by means of a handle 688 and so the operation of the struts to be initiated.

Similarly to what has already been described, cables 689–689*a* may possibly be fitted to the lower hubs of the frame for simultaneously initiating opening of the ribs with movement of the radial supports.

Stops 690–690*a* brake the movement of masts 691–691*a* with respect to the radial arms.

These arms may be fitted above or below the cover.

The cover and the frame are only partially shown for the sake of clarity.

Means not shown may be fitted between the two frame heads for promoting movement apart thereof.

FIG. 139 shows another method of projecting the frame into space by means of radial arms 691–691*a* hinged in two or more elements or segments, folding up together. The connecting system with the frame is here chosen by way of non limiting example, by the partial coupling from underneath of ribs 692–692*a* with the second part 691*b*–691*c* of the radial supports. Springs 693–693*a* give a certain tension for stretching the parts of the radial supports. Return means 694–694*a* integral with the support structure allow the assembly to be folded up. The radial supports are also hinged to the support structure by known means and are brought into the horizontal position by appropriate springs 694*a*–694*c*.

As in the previously described variations, it may be advantageous to open out the frame of the umbrella simultaneously with opening of the radial supports, according to the different means already described.

The cut masts 695–695*a* remain vertical, because of the counter ribs 696–696*a* which serve as bearing points for them on the radial supports.

FIG. 139 shows a part of the cover fully opened, whereas the other part is being unfolded.

It will be readily understood that such a system for hingeing the radial supports may be fitted to the frame according to the different possibilities already described.

Means not shown may be fitted to the radial supports for promoting moving apart thereof.

According to another embodiment not shown in the figures, the radial arms may be formed by a telescopic assembly of tubes sliding in each other.

In all the embodiments of the present invention, it is necessary to provide means for guiding the mobile hub and preventing movement thereof towards the center of the cover. Thus one of the means described with reference to FIG. 88 may be used.

Another solution, for guiding the mobile hub, consists in connecting it to the radial arm by means of a link which only allows it to move in a vertical plane.

Another embodiment consists in using two fixed hubs and counter ribs with hinged segments to produce a variable length for actuating the ribs. In this case, the guiding problem does not arise.

FIGS. 140 to 142 show schematically an example of a motor device controlled by photoelectric cells for following the movement of the sun so as to obtain a constant shaded zone.

A heavy concrete base 377, to which is fitted a general mast 378 supporting three offset masts 379, 380, 381, of three umbrellas 382, 383, 384, disposed in different horizontal planes, provides such a construction. The general mast 378 and the base are formed by a tubular motor 385 using appropriate fixing means **385–385*b*. This motor is supplied by a battery or by the mains. The photoelectric cell assembly 386–387, shown in FIG. 141, is disposed on the umbrellas and is connected to the motor by any known means transmitting data thereto. The motor is thus rotated and drives the general mast to orientate it depending on the settings provided. FIG. 142 shows schematically, in a top view, the umbrella assembly in a first position 388, then in a second position 389** after rotation. Such a rotational device may of course be fitted to any of the umbrella embodiments comprising partial frames.

The present invention is not limited to the embodiments which have been explicitly described, but it includes all the different variations and generalizations contained in the scope of the following claims. It will in particular be noted that the means for maintaining a radial portion of the cover in the vicinity of the radial arm may be formed in different ways. Thus, a cable 67 for pulling the hub 11 may at the same time cause erection of the central mast and thus maintain a cover portion against the radial arm. Gravity may provide the same effect by providing hingeing of mast 15 sufficiently high for the center of gravity of the umbrella to remain below.

I claim:

1. An unbrella with offset mast, comprising a fixed support structure (1) and at least one fabric cover (17) maintained in position by at least one frame formed of radial ribs hinged to a first hub (14) and counter ribs (20) hinged to a second hub (11) and to the ribs, at least one radial arm (7) hinged to said fixed structure and able to open out between a first position in which the arm is folded against the support structure (1) and an opened out position in which it is held stretched substantially horizontally, locking means for selectively maintaining the radial arm in one or the other of the endmost position, one of the frames at least being mounted at the end of the radial arm so as to be offset with respect to the support structure, the ribs of the frame forming a cone and means for permanently maintaining a radial portion of the fabric cover in close proximity to the radial arm, one of the hubs being attached to said radial arm, the other hub being mobile so as to allow opening out and folding up of the ribs, the mobile hub being urged by guide means limiting movement thereof towards the center of the cover with respect to the fixed hub, the frame comprising a central truncated mast (15) integral with said one of the hubs (14), said mast to receive the other hub, further comprising a cable (67) fixed to the mobile hub (11), which passes into the tubular central mast (15), is guided by a pulley along the radial arm, and is fixed to the support structure, producing the automatic opening out of the ribs during opening out of the radial arm.

2. The umbrella according to claim 1, wherein the radial arm comprises a one-piece bar which is hinged to the support structure and to the first end of which is hinged the corresponding central mast for orientation between a first position in which the central mast is parallel to the arm with the lower hub (11) directed towards the second end (61) of the radial arm and a second position in which the central mast is maintained substantially perpendicular to the arm by locking means (30,31).

3. The umbrella according to claim 1, wherein the radial arm comprises several hinged segments forming a foldable structure actuated by means of cables.

4. The umbrella according to claim 1, wherein the radial arm comprises a succession of hinged segments forming struts to form an extendable structure actuated by a ring sliding on the support structure.

5. The umbrella according to claim 1, wherein the radial arm comprises an assembly of tubes fitting into one another to define a telescopic structure.

6. The umbrella according to claim 2, wherein the radial arm is connected to the support structure at its second end by a purely rotational hinge with horizontal axis, locking in the opened out position being provided by a ring **(5*a*) sliding on the arm and covering the hinge (5)**.

7. The umbrella according to claim 2, wherein the radial arm is slidably mounted with respect to the upper end of the support structure (57), with its second end connected to the support structure by means of a link (59-60) hinged both to the arm and to the support structure below the housing and at a distance substantially equal to the length of the link.

8. The umbrella according to claim 1, wherein it further comprises secondary transverse extendable arms mounted at the first end of the radial arm and supporting central masts, and means for causing opening out thereof during opening out of the radial arm.

9. The umbrella according to claim 1, wherein the support comprises an intermediate part (4) rotatable about a vertical axis on the fixed lower part (1) and on which are mounted the members for hingeing the radial arm.

10. The umbrella according to claim 1, wherein it is set up in the sand of a beach by means of a foot formed of two interlocked spikes planted in a given way by lateral reciprocal movements and vertical downward thrusts.

11. The umbrella according to claim 1, wherein it comprises several covers supported by separate frames which are mounted at the end of radial arms hinged to the same fixed support structure, means (378) being provided for orientation of the radial arms in a horizontal plane.

12. The umbrella according to claim 1, wherein it comprises a one-piece cover held in place by at least two partial frames formed of ribs, counter ribs and hubs, one of the partial frames at least being mounted at the end of the radial arm and in that it comprises means for holding the partial frames spaced apart from each other in the opened out position of the arms.

13. The umbrella according to claim 12, wherein each offset partial frame is mounted on a different radial arm.

14. The umbrella according to claim 13, wherein the radial arms are opened out in two fixed radial directions diverging by an angle such that, in the opened out position of the arms, complete opening of the partial frames tensions the whole of the cover.

15. The umbrella according to one of claims 12 or 13, wherein the radial arms are opened out in two radial directions and are further orientatable through a rotational movement with vertical axis for moving them apart and together and in that means hold them spaced apart from each other when they are in the opened out position.

16. The umbrella according to claim 15, wherein the support structure comprises elements (501,501*a*) orientatable with respect to a fixed part (502,502*a*) along a vertical axis of rotation and to which are hinged the radial arms, the orientatable elements being locked in position by locking means (519,519*a*) which secure them firmly to the fixed part.

17. The umbrella according to claim 15, wherein the central masts are connected together by a telescopic bar (523,524,525) allowing the spacing apart thereof to be adjusted and maintained.

18. The umbrella according to claim 15, wherein it comprises legs or arms (576,576*a*) hinged to the radial arms in the vicinity of their first end and connected together by a central hinge (577) so as to form an acute angle whose apex is directed towards the first end of the arms, a cable (579) connecting together the central hinge and the support structure so that, when the radial arms extend through the housings of the support structure, the cable retains the central hinge and causes the hinged legs to open out so as to move the central masts apart.

19. The umbrella according to claim 15, wherein it further comprises a telescopic bar (553,554,555) connecting together the radial arms in the vicinity of their second end, and clamping means (559*b*,559*c*,560) for bringing together the second ends of the radial arms so as to cause the central masts to move apart and the cover to be tensioned, an operating handle (556) being mounted on the telescopic bar, the housings (538,538*a*) being able to rock about vertical axes so as to allow the radial arms to move apart.

20. The umbrella according to claim 15, wherein the second ends of the radial arms are hinged together by means of a bar of fixed length (564) so that the spacing between the second ends remains less than the spacing between the housings of the support structure so as to cause the central masts to move apart during opening out of the radial arms.

* * * * *